US008947347B2

(12) United States Patent
Mao et al.

(10) Patent No.: US 8,947,347 B2
(45) Date of Patent: Feb. 3, 2015

(54) CONTROLLING ACTIONS IN A VIDEO GAME UNIT

(75) Inventors: Xiaodong Mao, Foster City, CA (US); Richard L. Marks, Foster City, CA (US); Gary M. Zalewski, Oakland, CA (US)

(73) Assignee: Sony Computer Entertainment Inc., Tokyo (JP)

( * ) Notice: Subject to any disclaimer, the term of this patent is extended or adjusted under 35 U.S.C. 154(b) by 2004 days.

(21) Appl. No.: 11/381,721

(22) Filed: May 4, 2006

(65) Prior Publication Data

US 2006/0239471 A1 Oct. 26, 2006

Related U.S. Application Data

(63) Continuation-in-part of application No. 10/820,469, filed on Apr. 7, 2004, now Pat. No. 7,970,147, and a continuation-in-part of application No. 10/759,782, filed on Jan. 16, 2004, now Pat. No. 7,623,115, and a (Continued)

(51) Int. Cl.
*G09G 5/00* (2006.01)
*H04R 1/40* (2006.01)
(Continued)

(52) U.S. Cl.
CPC ..... *H04R 1/406* (2013.01); *H04R 3/005* (2013.01); *H04R 29/005* (2013.01); *H04R 2201/401* (2013.01); *H04R 2201/403* (2013.01); *H04R 2430/23* (2013.01)
USPC ..... 345/156; 345/161

(58) Field of Classification Search
CPC ..... G06F 3/00; G06F 3/03; G06F 3/033; G06F 3/0346
USPC ..... 345/156–158, 161; 273/148
See application file for complete search history.

(56) References Cited

U.S. PATENT DOCUMENTS 4,624,012 A 11/1986 Lin et al.
5,113,449 A 5/1992 Blanton et al.
(Continued)

FOREIGN PATENT DOCUMENTS

EP 0353200 A 1/1990
EP 0613294 A 8/1994
(Continued)

OTHER PUBLICATIONS

Final Office Action issued in U.S. Appl. No. 11/418,989 mailed Jan. 27, 2009, 8 pages.
(Continued)

*Primary Examiner* — Jason Mandeville
(74) *Attorney, Agent, or Firm* — Joshua D. Isenberg; JDI Patent

(57) ABSTRACT

Sound processing methods and apparatus are provided. A sound capture unit is configured to identify one or more sound sources. The sound capture unit generates data capable of being analyzed to determine a listening zone at which to process sound to the substantial exclusion of sounds outside the listening zone. Sound captured and processed for the listening zone may be used for interactivity with the computer program. The listening zone may be adjusted based on the location of a sound source. One or more listening zones may be pre-calibrated. The apparatus may optionally include an image capture unit configured to capture one or more image frames. The listening zone may be adjusted based on the image. A video game unit may be controlled by generating inertial, optical and/or acoustic signals with a controller and tracking a position and/or orientation of the controller using the inertial, acoustic and/or optical signal.

28 Claims, 27 Drawing Sheets

Related U.S. Application Data continuation-in-part of application No. 10/650,409, filed on Aug. 27, 2003, now Pat. No. 7,613,310.

(60) Provisional application No. 60/718,145, filed on Sep. 15, 2005, provisional application No. 60/678,413, filed on May 5, 2005.

(51) Int. Cl.
*H04R 3/00* (2006.01)
*H04R 29/00* (2006.01)

(56) References Cited

U.S. PATENT DOCUMENTS 5,128,671 A 7/1992 Thomas, Jr.
5,181,181 A * 1/1993 Glynn ..... 702/141
5,214,615 A 5/1993 Bauer
5,227,985 A 7/1993 DeMenthon
5,262,777 A 11/1993 Low et al.
5,296,871 A 3/1994 Paley
5,327,521 A 7/1994 Savic et al.
5,335,011 A 8/1994 Addeo et al. ..... 348/15
5,388,059 A * 2/1995 DeMenthon ..... 702/153
5,394,168 A 2/1995 Smith, III et al.
5,425,130 A 6/1995 Morgan
5,435,554 A 7/1995 Lipson
5,453,758 A 9/1995 Sato
5,454,043 A 9/1995 Freeman
5,485,273 A 1/1996 Mark et al.
5,534,917 A 7/1996 MacDougall
5,554,980 A 9/1996 Hashimoto et al.
5,563,988 A 10/1996 Maes et al.
5,602,566 A 2/1997 Motosyuku et al.
5,611,731 A 3/1997 Bouton et al.
5,626,140 A 5/1997 Feldman et al.
5,649,021 A 7/1997 Matey et al.
5,694,474 A 12/1997 Ngo et al.
5,768,415 A 6/1998 Jagadish et al.
5,850,222 A 12/1998 Cone
5,861,910 A 1/1999 McGarry et al.
5,900,863 A 5/1999 Numazaki
5,913,727 A 6/1999 Ahdoot
5,917,936 A 6/1999 Katto
5,930,383 A 7/1999 Netzer
5,930,741 A 7/1999 Kramer
5,991,693 A 11/1999 Zalewski
5,993,314 A 11/1999 Dannenberg et al.
6,002,776 A 12/1999 Bhadkamkar et al.
6,009,210 A 12/1999 Kang
6,009,396 A 12/1999 Nagata
6,014,167 A 1/2000 Suito et al.
6,014,623 A 1/2000 Wu et al.
6,022,274 A 2/2000 Takeda et al.
6,057,909 A 5/2000 Yahav et al.
6,061,055 A 5/2000 Marks
6,069,594 A 5/2000 Barnes et al.
6,075,895 A 6/2000 Qiao et al.
6,081,780 A 6/2000 Lumelsky
6,100,895 A 8/2000 Miura et al.
6,115,684 A 9/2000 Kawahara et al.
6,144,367 A * 11/2000 Berstis ..... 345/158
6,173,059 B1 1/2001 Huang et al. ..... 381/92
6,176,837 B1 * 1/2001 Foxlin ..... 600/595
6,184,847 B1 2/2001 Fateh et al.
6,195,104 B1 2/2001 Lyons
6,243,491 B1 6/2001 Andersson
6,304,267 B1 10/2001 Sata
6,317,703 B1 11/2001 Linsker
6,332,028 B1 12/2001 Marash
6,336,092 B1 1/2002 Gibson et al.
6,339,758 B1 1/2002 Kanazawa et al.
6,346,929 B1 2/2002 Fukushima et al.
6,371,849 B1 4/2002 Togami
6,392,644 B1 5/2002 Miyata et al.
6,394,897 B1 5/2002 Togami
6,400,374 B2 6/2002 Lanier
6,411,744 B1 6/2002 Edwards
6,417,836 B1 7/2002 Kumar et al.
6,441,825 B1 8/2002 Peters
6,489,948 B1 12/2002 Lau
6,533,420 B1 3/2003 Eichenlaub
6,545,706 B1 4/2003 Edwards et al.
6,573,883 B1 6/2003 Bartlett
6,597,342 B1 7/2003 Haruta
6,611,141 B1 * 8/2003 Schulz et al. ..... 324/226
6,618,073 B1 9/2003 Lambert et al.
6,681,629 B2 * 1/2004 Foxlin et al. ..... 73/488
6,699,123 B2 3/2004 Matsuura et al.
6,720,949 B1 * 4/2004 Pryor et al. ..... 345/158
6,746,124 B2 6/2004 Fischer et al.
6,757,068 B2 * 6/2004 Foxlin ..... 356/620
6,791,531 B1 9/2004 Johnston et al.
6,890,262 B2 5/2005 Oishi et al.
6,931,362 B2 8/2005 Beadle et al.
6,934,397 B2 8/2005 Madievski et al.
6,990,639 B2 1/2006 Wilson ..... 715/863
7,035,415 B2 4/2006 Belt et al.
7,038,661 B2 * 5/2006 Wilson et al. ..... 345/158
7,042,440 B2 5/2006 Pryor et al.
7,088,831 B2 8/2006 Rosca et al.
7,092,882 B2 8/2006 Arrowood et al.
7,102,615 B2 9/2006 Marks
7,212,956 B2 5/2007 Bruno et al.
7,233,316 B2 6/2007 Smith et al.
7,259,375 B2 8/2007 Tichit et al.
7,280,964 B2 10/2007 Wilson et al.
7,373,242 B2 * 5/2008 Yamane ..... 701/509
D571,367 S 6/2008 Goto et al.
D571,806 S 6/2008 Goto
7,386,135 B2 6/2008 Fan
D572,254 S 7/2008 Goto
7,414,596 B2 * 8/2008 Satoh et al. ..... 345/8
7,489,299 B2 * 2/2009 Liberty et al. ..... 345/163
7,646,372 B2 1/2010 Marks et al.
7,850,526 B2 12/2010 Zalewski et al.
7,918,733 B2 * 4/2011 Zalewski et al. ..... 463/39
8,303,405 B2 11/2012 Zalewski et al.
2002/0015137 A1 2/2002 Hasegawa
2002/0018582 A1 2/2002 Hagiwara et al.
2002/0021277 A1 2/2002 Kramer et al.
2002/0024500 A1 2/2002 Howard
2002/0036617 A1 3/2002 Pryor
2002/0041327 A1 4/2002 Hildreth et al.
2002/0048376 A1 4/2002 Ukita
2002/0051119 A1 5/2002 Sherman et al.
2002/0065121 A1 5/2002 Fukunaga et al.
2002/0109680 A1 8/2002 Orbanes et al.
2002/0110273 A1 8/2002 Dufour
2003/0020718 A1 1/2003 Marshall et al.
2003/0022716 A1 1/2003 Park et al.
2003/0031333 A1 2/2003 Cohen et al.
2003/0032466 A1 2/2003 Watashiba
2003/0032484 A1 2/2003 Ohshima et al.
2003/0046038 A1 3/2003 Deligne et al.
2003/0047464 A1 3/2003 Sun et al. ..... 379/392.01
2003/0055646 A1 3/2003 Yoshioka et al.
2003/0063065 A1 4/2003 Lee et al. ..... 345/156
2003/0100363 A1 5/2003 Ali
2003/0160862 A1 8/2003 Charlier et al. ..... 348/14.08
2003/0193572 A1 * 10/2003 Wilson et al. ..... 348/207.99
2004/0029640 A1 2/2004 Masuyama et al.
2004/0046736 A1 3/2004 Pryor et al.
2004/0070564 A1 4/2004 Dawson et al.
2004/0075677 A1 4/2004 Loyall et al.
2004/0155962 A1 8/2004 Marks
2004/0178576 A1 9/2004 Hillis et al.
2004/0207597 A1 10/2004 Marks
2004/0208497 A1 10/2004 Seger
2004/0212589 A1 10/2004 Hall et al.
2004/0213419 A1 10/2004 Varma et al. ..... 381/92
2004/0239670 A1 12/2004 Marks
2004/0240542 A1 12/2004 Yeredor et al.
2005/0037844 A1 2/2005 Shum et al.
2005/0047611 A1 3/2005 Mao ..... 381/94.7

(56) References Cited

U.S. PATENT DOCUMENTS

| | | | | |
|---|---|---|---|---|
| 2005/0059488 | A1 | 3/2005 | Larsen | |
| 2005/0075167 | A1 | 4/2005 | Beaulieu et al. | |
| 2005/0114126 | A1 | 5/2005 | Geiger et al. | |
| 2005/0115383 | A1 | 6/2005 | Chang | |
| 2005/0174324 | A1 | 8/2005 | Liberty et al. | |
| 2005/0212766 | A1* | 9/2005 | Reinhardt et al. | 345/157 |
| 2005/0226431 | A1 | 10/2005 | Mao | 381/61 |
| 2005/0256391 | A1* | 11/2005 | Satoh et al. | 600/407 |
| 2006/0035710 | A1 | 2/2006 | Festejo et al. | |
| 2006/0115103 | A1 | 6/2006 | Feng et al. | |
| 2006/0136213 | A1 | 6/2006 | Hirose et al. | |
| 2006/0139322 | A1 | 6/2006 | Marks | |
| 2006/0204012 | A1 | 9/2006 | Marks | |
| 2006/0233389 | A1 | 10/2006 | Mao | |
| 2006/0239471 | A1 | 10/2006 | Mao | |
| 2006/0252474 | A1 | 11/2006 | Zalewski | |
| 2006/0252475 | A1 | 11/2006 | Zalewski | |
| 2006/0252477 | A1 | 11/2006 | Zalewski | |
| 2006/0252541 | A1* | 11/2006 | Zalewski et al. | 463/36 |
| 2006/0256081 | A1 | 11/2006 | Zalewski | |
| 2006/0264258 | A1 | 11/2006 | Zalewski | |
| 2006/0264259 | A1 | 11/2006 | Zalewski | |
| 2006/0264260 | A1 | 11/2006 | Zalewski | |
| 2006/0269072 | A1 | 11/2006 | Mao | |
| 2006/0269073 | A1 | 11/2006 | Mao | |
| 2006/0274032 | A1* | 12/2006 | Mao et al. | 345/156 |
| 2006/0274911 | A1 | 12/2006 | Mao | |
| 2006/0277571 | A1 | 12/2006 | Marks et al. | |
| 2006/0280312 | A1 | 12/2006 | Mao | |
| 2006/0282873 | A1* | 12/2006 | Zalewski et al. | 725/133 |
| 2006/0287084 | A1* | 12/2006 | Mao et al. | 463/37 |
| 2006/0287085 | A1* | 12/2006 | Mao et al. | 463/37 |
| 2006/0287086 | A1 | 12/2006 | Zalewski | |
| 2006/0287087 | A1 | 12/2006 | Zalewski | |
| 2007/0015558 | A1 | 1/2007 | Zalewski | |
| 2007/0015559 | A1 | 1/2007 | Zalewski | |
| 2007/0021208 | A1 | 1/2007 | Mao | |
| 2007/0025562 | A1 | 2/2007 | Zalewski | |
| 2007/0027687 | A1 | 2/2007 | Turk et al. | |
| 2007/0060350 | A1 | 3/2007 | Osman | |
| 2007/0061413 | A1 | 3/2007 | Larsen | |
| 2007/0081695 | A1* | 4/2007 | Foxlin et al. | 382/103 |
| 2007/0213987 | A1 | 9/2007 | Turk et al. | |
| 2007/0223732 | A1 | 9/2007 | Mao | |
| 2007/0233489 | A1 | 10/2007 | Hirose et al. | |
| 2007/0258599 | A1 | 11/2007 | Mao | |
| 2007/0260340 | A1 | 11/2007 | Mao | |
| 2007/0260517 | A1 | 11/2007 | Zalewski | |
| 2007/0261077 | A1 | 11/2007 | Zalewski et al. | |
| 2007/0265075 | A1 | 11/2007 | Zalewski | |
| 2007/0274535 | A1 | 11/2007 | Mao | |
| 2007/0298882 | A1 | 12/2007 | Marks | |
| 2008/0096654 | A1 | 4/2008 | Mondesir | |
| 2008/0096657 | A1 | 4/2008 | Benoist | |
| 2008/0098448 | A1 | 4/2008 | Mondesir | |
| 2008/0100825 | A1* | 5/2008 | Zalewski | 356/29 |
| 2008/0120115 | A1 | 5/2008 | Mao | |
| 2009/0016642 | A1 | 1/2009 | Hart | |
| 2009/0062943 | A1 | 3/2009 | Nason et al. | |

FOREIGN PATENT DOCUMENTS

| | | | | |
|---|---|---|---|---|
| EP | 0 652 686 | | 5/1995 | H04R 3/00 |
| EP | 0750202 | A | 12/1996 | |
| EP | 0823683 | | 2/1998 | |
| EP | 0835676 | A | 4/1998 | |
| EP | 0867798 | | 9/1998 | G06F 3/033 |
| EP | 0869458 | | 10/1998 | |
| EP | 1033882 | | 9/2000 | H04N 7/18 |
| EP | 1074934 | | 2/2001 | G06K 11/08 |
| EP | 1180384 | | 2/2002 | |
| EP | 1279425 | | 1/2003 | |
| EP | 1 335 338 | | 8/2003 | G08C 17/00 |
| EP | 1358918 | | 11/2003 | |
| EP | 1 411 461 | | 4/2004 | G06K 11/18 |
| EP | 1 489 596 | | 12/2004 | G10L 11/02 |
| FR | 2780176 | | 6/1988 | |
| FR | 2832892 | | 5/2003 | |
| GB | 2376397 | | 12/2002 | |
| JP | 03288898 | A | 12/1991 | |
| JP | 06042971 | | 2/1994 | |
| JP | H0682242 | A | 3/1994 | |
| JP | 06198075 | | 7/1994 | |
| JP | 11316646 | A | 11/1999 | |
| JP | 11333139 | A | 12/1999 | |
| JP | 2000148380 | A | 5/2000 | |
| JP | 2000259340 | A | 9/2000 | |
| JP | 2001246161 | A | 9/2001 | |
| JP | 2002090384 | A | 3/2002 | |
| JP | 2002153673 | A | 5/2002 | |
| JP | 2002515976 | A | 5/2002 | |
| JP | 2002306846 | A | 10/2002 | |
| JP | 2002320772 | A | 11/2002 | |
| JP | 2006031515 | A | 2/2006 | |
| JP | 2006110382 | A | 4/2006 | |
| WO | 8805942 | A | 8/1988 | |
| WO | 9732641 | A | 9/1997 | |
| WO | 9926198 | A | 5/1999 | |
| WO | 0118563 | A | 3/2001 | |
| WO | WO 2004/073814 | | 9/2004 | A63F 13/00 |
| WO | WO 2004/073815 | | 9/2004 | A63F 13/02 |
| WO | 2006/121681 | | 11/2006 | |
| WO | WO 2006/121896 | | 11/2006 | G10L 21/02 |

OTHER PUBLICATIONS

Office Action issued in U.S. Appl. No. 11/429,047 mailed Aug. 20, 2009, 9 pages.
Office Action issued on U.S. Appl. No. 11/600,938 mailed Nov. 5, 2009, 17 pages.
Final Office Action issued in U.S. Appl. No. 11/717,269 mailed Aug. 19, 2009, 9 pages.
Office Action issued in U.S. Appl. No. 11/418,986 mailed Sep. 21, 2009.
Advisory Action issued in U.S. Appl. No. 11/418,989 mailed Jun. 4, 2003, 3 pages.
Office Action issued in U.S. Appl. No. 11/418,989 mailed Jun. 12, 2009, 8 pages.
Office Action issued in U.S. Appl. No. 11/429,047 mailed Jan. 23, 2009, 10 pages.
Office Action issued in U.S. Appl. No. 11/717,269 mailed Feb. 10, 2009, 8 pages.
Advisory Action issued in U.S. Appl. No. 11/418,988 mailed Jul. 1, 2009.
Final Office Action issued in U.S. Appl. No. 11/418,988 mailed Feb. 23, 2009.
Office Action issued in U.S. Appl. No. 11/418,989 mailed Aug. 6, 2008, 9 pages.
Office Action issued in U.S. Appl. No. 11/429,047 mailed Aug. 6, 2008, 9 pages.
Office Action issued U.S. Appl. No. 11/418,988 mailed Aug. 26, 2008.
U.S. Appl. No. 29/259,348, filed on May 6, 2006.
U.S. Appl. No. 29/259,349, filed on May 6, 2006.
U.S. Appl. No. 29/259,350, filed May 6, 2006.
U.S. Appl. No. 60/789,031, filed May 6, 2006.
U.S. Appl. No. 60/718,145, filed Sep. 15, 2005.
U.S. Appl. No. 60/678,413, filed May 5, 2005.
U.S. Appl. No. 29/246,744, filed May 5, 2005.
U.S. Appl. No. 29/246,762, filed May 8, 2006.
U.S. Appl. No. 29/246,759, filed May 8, 2006.
U.S. Appl. No. 29/246,763, filed May 8, 2006.
U.S. Appl. No. 29/246,764, filed May 8, 2006.
U.S. Appl. No. 29/246,765, filed May 8, 2006.
U.S. Appl. No. 29/246,766, filed May 8, 2006.
Patent Cooperation Treaty: "International Search Report" for PCT Application No. PCT/US2006/016670, which corresponds to U.S. Pub. No. 2006-0206012; mailed Aug. 30, 2006, 2 Pages.

(56) References Cited

OTHER PUBLICATIONS

Patent Cooperation Treaty: "Written Opinion of the International Searching Authority" for PCT Application No. PCT/US2006/016670, which corresponds to U.S. Pub. No. 2006-0204012, mailed Aug. 30, 2006; 4 Pages.
Notice Allowance issued in U.S. Appl. No. 11/381,725 mailed Dec. 18, 2009.
Notice of Allowance issued in U.S. Appl. No. 11/381,729 mailed Jan. 19, 2010.
Notice of Allowance issued in U.S. Appl. No. 11/381,724 mailed Feb. 5, 2010.
Office Action issued in U.S. Appl. No. 11/418,989 mailed Jan. 5, 2010.
International Application No. PCT/US2006/017483—International Search Report.
Non-final Office Action dated Sep. 29, 2008 for U.S. Appl. No. 11/381,729.
Non-final Office Action dated Mar. 13, 2009 for U.S. Appl. No. 11/381,729.
Final Office Action dated Sep. 17, 2009 for U.S. Appl. No. 11/381,729.
Non-final Office Action dated Aug. 19, 2008 for U.S. Appl. No. 11/381,725.
Non-final Office Action dated Feb. 18, 2009 for U.S. Appl. No. 11/381,725.
Final Office Action dated Aug. 20, 2009 for U.S. Appl. No. 11/381,725.
Non-final Office Action dated Aug. 20, 2008 for U.S. Appl. No. 11/381,724.
Non-final Office Action dated Feb. 24, 2009 for U.S. Appl. No. 11/381,724.
Non-final Office Action dated Aug. 19, 2009 for U.S. Appl. No. 11/381,724.
J. Benesty, "Adaptive Eigenvalue Decomposition Algorithm for Passive Acoustic Source Localization." J. Acoust. Soc. Amer., vol. 107, No. 1, pp. 384-391, Jan. 2000.
Y. Ephraim and D. Malah, "Speech Enhancement Using a Minimum Mean-square Error Short-time Spectral Amplitude Estimator," IEEE Trans. Acoust., Speech, Signal Processing, vol. ASSP-32, pp. 1109-1121.
Y. Ephraim and D. Malah, "Speech Enhancement Using a Minimum Mean-square Error Log- Spectral Amplitude Estimator," IEEE Trans. Acoust, Speech, Signal Processing, vol. ASSP-33, pp. 443-445, Apr. 1985.
Non-Final Office Action for U.S. Appl. No. 11/382,256 dated Sep. 25, 2009.
U.S. Appl. No. 10/759,782, entitled "Method and Apparatus for Light Input Device", to Richard L. Mark, filed Jan. 16, 2004.
U.S. Appl. No. 11/429,414, entitled "Computer Image and Audio Processing of Intensity and Input Device When Interfacing With a Computer Program", to Richard L. Marks et al, filed May 4, 2006.
U.S. Appl. No. 11/381,729, entitled "Ultra Small Microphone Array", to Xiadong Mao, filed May 4, 2006.
U.S. Appl. No. 11/381,728, entitled "Echo and Noise Cancellation", to Xiadong Mao, filed May 4, 2006.
U.S. Appl. No. 11/381,725, entitled "Methods and Apparatus for Targeted Sound Detection", to Xiadong Mao, filed May 4, 2006.
U.S. Appl. No. 11/381,727, entitled "Noise Removal for Electronic Device With Far Field Microphone on Console", to Xiadong Mao, filed May 4, 2006.
U.S. Appl. No. 11/381,724, entitled "Methods and Apparatus for Targeted Sound Detection and Characterization", to Xiadong Mao, filed May 4, 2006.
U.S. Appl. No. 11/418,988, entitled "Methods and Apparatuses for Adjusting a Listening Area for Capturing Sounds", to Xiadong Mao, filed May 4, 2006.
U.S. Appl. No. 11/418,989, entitled "Methods and Apparatuses for Capturing an Audio Signal Based on Visual Image", to Xiadong Mao, filed May 4, 2006.
U.S. Appl. No. 11/429,047, entitled "Methods and Apparatuses for Capturing an Audio Signal Based on a Location of the Signal", to Xiadong Mao, filed May 4, 2006.
U.S. Appl. No. 11/418,993, entitled "System and Method for Control by Audible Device", to Steven Osman, filed May 4, 2006.
Mark Fiala et al., "A Panoramic Video and Acoustic Beamforming Sensor for Videoconferencing", IEEE, Oct. 2-3, 2004, pp. 47-52.
Kevin W. Wilson et al., "Audio-Video Array Source Localization for Intelligent Environments", IEEE 2002, vol. 2, pp. 2109-2112.
Office Action dated Jun. 21, 2011 issued for U.S. Appl. No. 11/382,033.
Office Action dated Jun. 21, 2011 issued for U.S. Appl. No. 11/382,035.
"European Search Report" for European Application No. 07251651.1, dated Oct. 18, 2007.
"The Tracking Cube: A Three Dimensional Input Device", IBM Technical Disclosure Bulletin, Aug. 1, 1989, pp. 91-95, vol. 32, No. 3b, IBM Corp. new York, US.
CFS and FS95/98/2000: How to Use the Trim Controls to Keep Your Aircraft level—http://support.microsoft.com/?scid=kb%3Ben-us%3B175195&x=13&y=15, downloaded on Aug. 10, 2007.
Definition of "mount" —Merriam-Webster Online Dictionary; downloaded from the Internet <http://www.M-w.com/dictionary/mountable>, downloaded on Nov. 8, 2007.
European Patent Office report mailed date Jun. 6, 2013, issued for European Patent Application No. 07760946.9.
Final Office Action for U.S. Appl. No. 11/382,035, dated Dec. 6, 2013.
Final Office Action mailed date Dec. 19, 2012 issued for U.S. Appl. No. 11/382,033.
Final Office Action mailed date Jan. 3, 2013 issued for U.S. Appl. No. 11/382,036.
Iddan et al. "3D Imaging in the Studio (and Elswhere . . . )", Proceedings of the SPIE, SPIE, Bellingham, VA, US, vol. 4298, Jan. 24, 2001, pp. 48-55, XP008005351.
International Search Report and Written Opinion for International Application No. PCT/US06/61056 dated Mar. 3, 2008.
International Search Report and Written Opinion of the International Searching Authority for International Patent Application No. PCT/US07/67004, dated Jul. 28, 2008.
Japanese Final Office Action for JP Application No. 2009-509932 dated Aug. 20, 2013.
Japanese Final Office Action mailed date Jun. 26, 12, issued for Japanese Patent application No. 2009-509931.
Japanese Office action for JP application No. 2012-080340 Dated Sep. 10, 2013.
Japanese Office Action for JP application No. 2012-257118 Dated Dec. 17, 2013.
Japanese Office Action mailed date Feb. 28, 2012, issued for Japanese Patent application No. 2009-509931.
Japanese Office Action mailed date Jun. 26, 2012, issued for Japanese Patent application No. 2012-080329.
Jaron Lanier, "Virtually There", Scientific American: New Horizons for Information Technology,2003.
Jojie et al., Tracking self-occluding Articulated Objects in Dense Disparity Maps, Computer Vision, 1999. The Proceedings of the seventh IEEE International Conference on Kerkyra, Greece Sep. 20-27, 1999, Los Alamitos, CA, USA, IEEE Comput. Soc, Us, Sep. 20, 1999, pp. 123-130.
Klinker et al., "Distribute User Tracking Concepts for Augmented Reality Applications" pp. 37-44, Augmented Reality, 2000, IEEE and ACM Int'l Symposium, Oct. 2000, XP010520308, ISBN: 0-7695-0846-4, Germany.
Non Final Office Action dated Apr. 2, 2012 for U.S. Appl. No. 12/975,126.
Notice of Allowance for U.S. Appl. No. 11/382,033, dated Nov. 6, 2013.
Notice of Allowance for U.S. Appl. No. 11/382,035, dated Mar. 26, 2014.

* cited by examiner

FIG. 25C
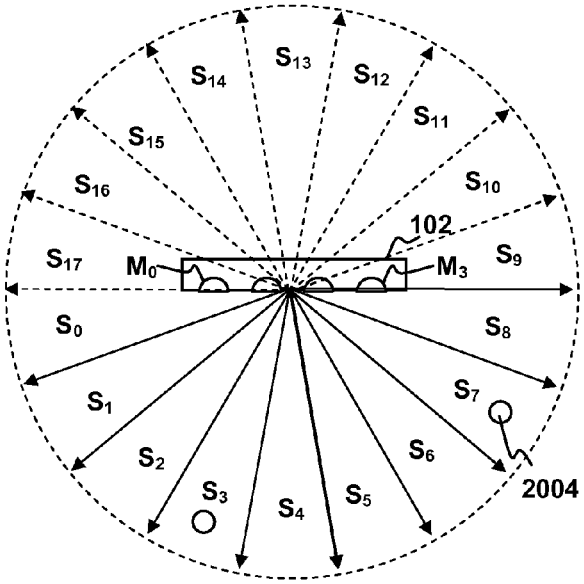
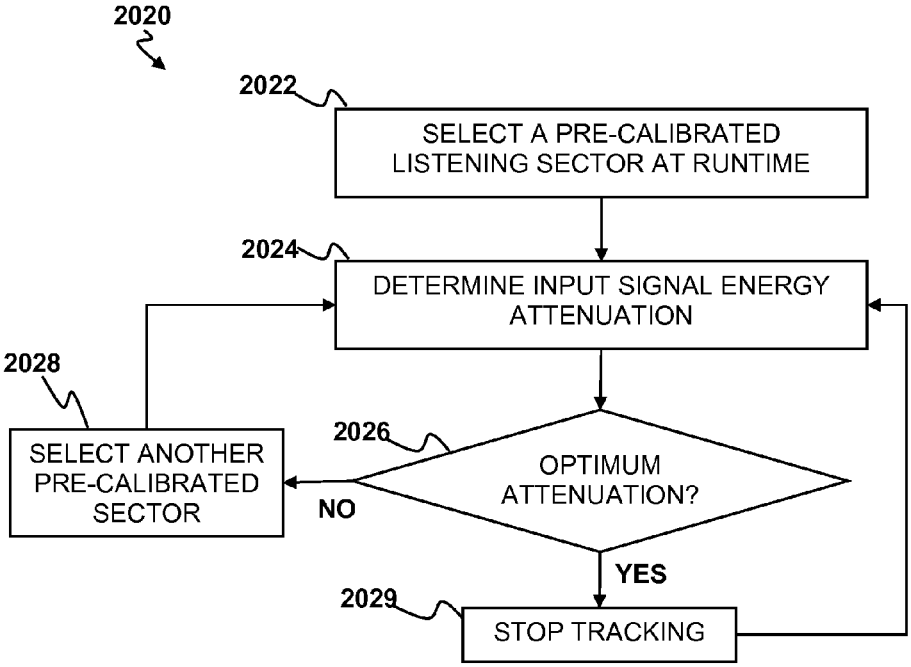
FIG. 25D

CONTROLLING ACTIONS IN A VIDEO GAME UNIT

CROSS-REFERENCE TO RELATED APPLICATIONS

This Application claims the benefit of priority of U.S. Provisional Patent Application No. 60/678,413, filed May 5, 2005, the entire disclosures of which are incorporated herein by reference. This Application claims the benefit of priority of U.S. Provisional Patent Application No. 60/718,145, filed Sep. 15, 2005, the entire disclosures of which are incorporated herein by reference. This application is a continuation-in-part of and claims the benefit of priority of commonly-assigned U.S. patent application Ser. No. 10/650,409, filed Aug. 27, 2003 and published on Mar. 3, 2005 as US Patent Application Publication No. 2005/0047611, the entire disclosures of which are incorporated herein by reference. This application is a continuation-in-part of and claims the benefit of priority of commonly-assigned, U.S. patent application Ser. No. 10/759,782 to Richard L. Marks, filed Jan. 16, 2004 and entitled: METHOD AND APPARATUS FOR LIGHT INPUT DEVICE, which is incorporated herein by reference in its entirety. This application is a continuation-in-part of and claims the benefit of priority of commonly-assigned U.S. patent application Ser. No. 10/820,469, to Xiadong Mao entitled "METHOD AND APPARATUS TO DETECT AND REMOVE AUDIO DISTURBANCES", which was filed Apr. 7, 2004 and published on Oct. 13, 2005 as US Patent Application Publication 20050226431, the entire disclosures of which are incorporated herein by reference.

This application is related to commonly-assigned U.S. patent application Ser. No. 11/429,414, to Richard L. Marks et al., entitled "COMPUTER IMAGE AND AUDIO PROCESSING OF INTENSITY AND INPUT DEVICES WHEN INTERFACING WITH A COMPUTER PROGRAM", filed the same day as the present application, the entire disclosures of which are incorporated herein by reference in its entirety. This application is related to commonly-assigned, co-pending application Ser. No. 11/381,729, to Xiao Dong Mao, entitled ULTRA SMALL MICROPHONE ARRAY, filed the same day as the present application, the entire disclosures of which are incorporated herein by reference. This application is also related to commonly-assigned, co-pending application Ser. No. 11/381,728, to Xiao Dong Mao, entitled ECHO AND NOISE CANCELLATION, filed the same day as the present application, the entire disclosures of which are incorporated herein by reference. This application is also related to commonly-assigned, co-pending application Ser. No. 11/381,725, to Xiao Dong Mao, entitled "METHODS AND APPARATUS FOR TARGETED SOUND DETECTION", filed the same day as the present application, the entire disclosures of which are incorporated herein by reference. This application is also related to commonly-assigned, co-pending application Ser. No. 11/381,727, to Xiao Dong Mao, entitled "NOISE REMOVAL FOR ELECTRONIC DEVICE WITH FAR FIELD MICROPHONE ON CONSOLE", filed the same day as the present application, the entire disclosures of which are incorporated herein by reference. This application is also related to commonly-assigned, co-pending application Ser. No. 11/381,724, to Xiao Dong Mao, entitled "METHODS AND APPARATUS FOR TARGETED SOUND DETECTION AND CHARACTERIZATION", filed the same day as the present application, the entire disclosures of which are incorporated herein by reference. This application is also related to commonly-assigned, co-pending application Ser. No. 11/418,988, to Xiao Dong Mao, entitled "METHODS AND APPARATUSES FOR ADJUSTING A LISTENING AREA FOR CAPTURING SOUNDS", filed the same day as the present application, the entire disclosures of which are incorporated herein by reference. This application is also related to commonly-assigned, co-pending application Ser. No. 11/418,989, to Xiao Dong Mao, entitled "METHODS AND APPARATUSES FOR CAPTURING AN AUDIO SIGNAL BASED ON VISUAL IMAGE", filed the same day as the present application, the entire disclosures of which are incorporated herein by reference. This application is also related to commonly-assigned, co-pending application Ser. No. 11/429,047, to Xiao Dong Mao, entitled "METHODS AND APPARATUSES FOR CAPTURING AN AUDIO SIGNAL BASED ON A LOCATION OF THE SIGNAL", filed the same day as the present application, the entire disclosures of which are incorporated herein by reference.

BACKGROUND

1. Field of the Invention

Embodiments of the present invention are directed to audio signal processing and more particularly to processing of audio signals from microphone arrays.

2. Description of the Related Art

The video game industry has seen many changes over the years. As computing power has expanded, developers of video games have likewise created game software that takes advantage of these increases in computing power. To this end, video game developers have been coding games that incorporate sophisticated operations and mathematics to produce a very realistic game experience.

Example gaming platforms may be the Sony Playstation or Sony Playstation2 (PS2), each of which is sold in the form of a game console. As is well known, the game console is designed to connect to a monitor (usually a television) and enable user interaction through handheld controllers. The game console is designed with specialized processing hardware, including a CPU, a graphics synthesizer for processing intensive graphics operations, a vector unit for performing geometry transformations, and other glue hardware, firmware, and software. The game console is further designed with an optical disc tray for receiving game compact discs for local play through the game console. Online gaming is also possible, where a user can interactively play against or with other users over the Internet.

As game complexity continues to intrigue players, game and hardware manufacturers have continued to innovate to enable additional interactivity. In reality, however, the way in which users interact with a game has not changed dramatically over the years.

In view of the foregoing, there is a need for methods and systems that enable more advanced user interactivity with game play.

SUMMARY OF THE INVENTION

Broadly speaking, the present invention fills these needs by providing an apparatus and method that facilitates interactivity with a computer program. In one embodiment, the computer program is a game program, but without limitation, the apparatus and method can find applicability in any computer environment that may take in sound input to trigger control, input, or enable communication. More specifically, if sound is used to trigger control or input, the embodiments of the present invention will enable filtered input of particular sound sources, and the filtered input is configured to omit or focus away from sound sources that are not of interest. In the video game environment, depending on the sound source selected, the video game can respond with specific responses after processing the sound source of interest, without the distortion or noise of other sounds that may not be of interest. Commonly, a game playing environment will be exposed to many background noises, such as, music, other people, and the movement of objects. Once the sounds that are not of interest are substantially filtered out, the computer program can better respond to the sound of interest. The response can be in any form, such as a command, an initiation of action, a selection, a change in game status or state, the unlocking of features, etc.

In one embodiment, an apparatus for capturing image and sound during interactivity with a computer program is provided. The apparatus includes an image capture unit that is configured to capture one or more image frames. Also provided is a sound capture unit. The sound capture unit is configured to identify one or more sound sources. The sound capture unit generates data capable of being analyzed to determine a zone of focus at which to process sound to the substantial exclusion of sounds outside of the zone of focus. In this manner, sound that is captured and processed for the zone of focus is used for interactivity with the computer program.

In another embodiment, a method for selective sound source listening during interactivity with a computer program is disclosed. The method includes receiving input from one or more sound sources at two or more sound source capture microphones. Then, the method includes determining delay paths from each of the sound sources and identifying a direction for each of the received inputs of each of the one or more sound sources. The method then includes filtering out sound sources that are not in an identified direction of a zone of focus. The zone of focus is configured to supply the sound source for the interactivity with the computer program.

In yet another embodiment, a game system is provided. The game system includes an image-sound capture device that is configured to interface with a computing system that enables execution of an interactive computer game. The image-capture device includes video capture hardware that is capable of being positioned to capture video from a zone of focus. An array of microphones is provided for capturing sound from one or more sound sources. Each sound source is identified and associated with a direction relative to the image-sound capture device. The zone of focus associated with the video capture hardware is configured to be used to identify one of the sound sources at the direction that is in the proximity of the zone of focus.

In general, the interactive sound identification and tracking is applicable to the interfacing with any computer program of any computing device. Once the sound source is identified, the content of the sound source can be further processed to trigger, drive, direct, or control features or objects rendered by a computer program.

In one embodiment, the methods and apparatuses adjust a listening area of a microphone includes detecting an initial listening zone; capture a captured sound through a microphone array; identify an initial sound based on the captured sound and the initial listening zone wherein the initial sound includes sounds within the initial listening zone; adjust the initial listening zone and forming the adjusted listening zone; and identify an adjusted sound based on the captured sound and the adjusted listening zone wherein the adjusted sound includes sounds within the adjusted listening zone.

In another embodiment, the methods and apparatus detect an initial listening zone wherein the initial listening zone represents an initial area monitored for sounds; detect a view of a image capture unit; compare the view of the visual with the initial area of the initial listening zone; and adjust the initial listening zone and forming the adjusted listening zone having an adjusted area based on comparing the view and the initial area.

In one embodiment, the methods and apparatus detect an initial listening zone wherein the initial listening zone represents an initial area monitored for sounds; detect an initial sound within the initial listening zone; and adjust the initial listening zone and forming the adjusted listening zone having an adjusted area based wherein the initial sound emanates from within the adjusted listening zone.

Other embodiments of the invention are directed to methods and apparatus for targeted sound detection using pre-calibrated listening zones. Such embodiments may be implemented with a microphone array having two or more microphones. Each microphone is coupled to a plurality of filters. The filters are configured to filter input signals corresponding to sounds detected by the microphones thereby generating a filtered output. One or more sets of filter parameters for the plurality of filters are pre-calibrated to determine one or more corresponding pre-calibrated listening zones. Each set of filter parameters is selected to detect portions of the input signals corresponding to sounds originating within a given listening zone and filter out sounds originating outside the given listening zone. A particular pre-calibrated listening zone may be selected at a runtime by applying to the plurality of filters a set of filter coefficients corresponding to the particular pre-calibrated listening zone. As a result, the microphone array may detect sounds originating within the particular listening sector and filter out sounds originating outside the particular listening zone.

In certain embodiments of the invention, actions in a video game unit may be controlled by generating an inertial signal and/or an optical signal with a joystick controller and tracking a position and/or orientation of the joystick controller using the inertial signal and/or optical signal.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings.

FIG. 25C is a schematic diagram illustrating targeted sound detection according to a preferred embodiment of the present invention.

FIG. 25D is a flow diagram illustrating a method for targeted sound detection according to the preferred embodiment of the present invention.

DETAILED DESCRIPTION

Embodiments of the present invention relate to methods and apparatus for facilitating the identification of specific sound sources and filtering out unwanted sound sources when sound is used as an interactive tool with a computer program.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to obscure the present invention.

References to "electronic device", "electronic apparatus" and "electronic equipment" include devices such as personal digital video recorders, digital audio players, gaming consoles, set top boxes, computers, cellular telephones, personal digital assistants, specialized computers such as electronic interfaces with automobiles, and the like.

Figure 1:
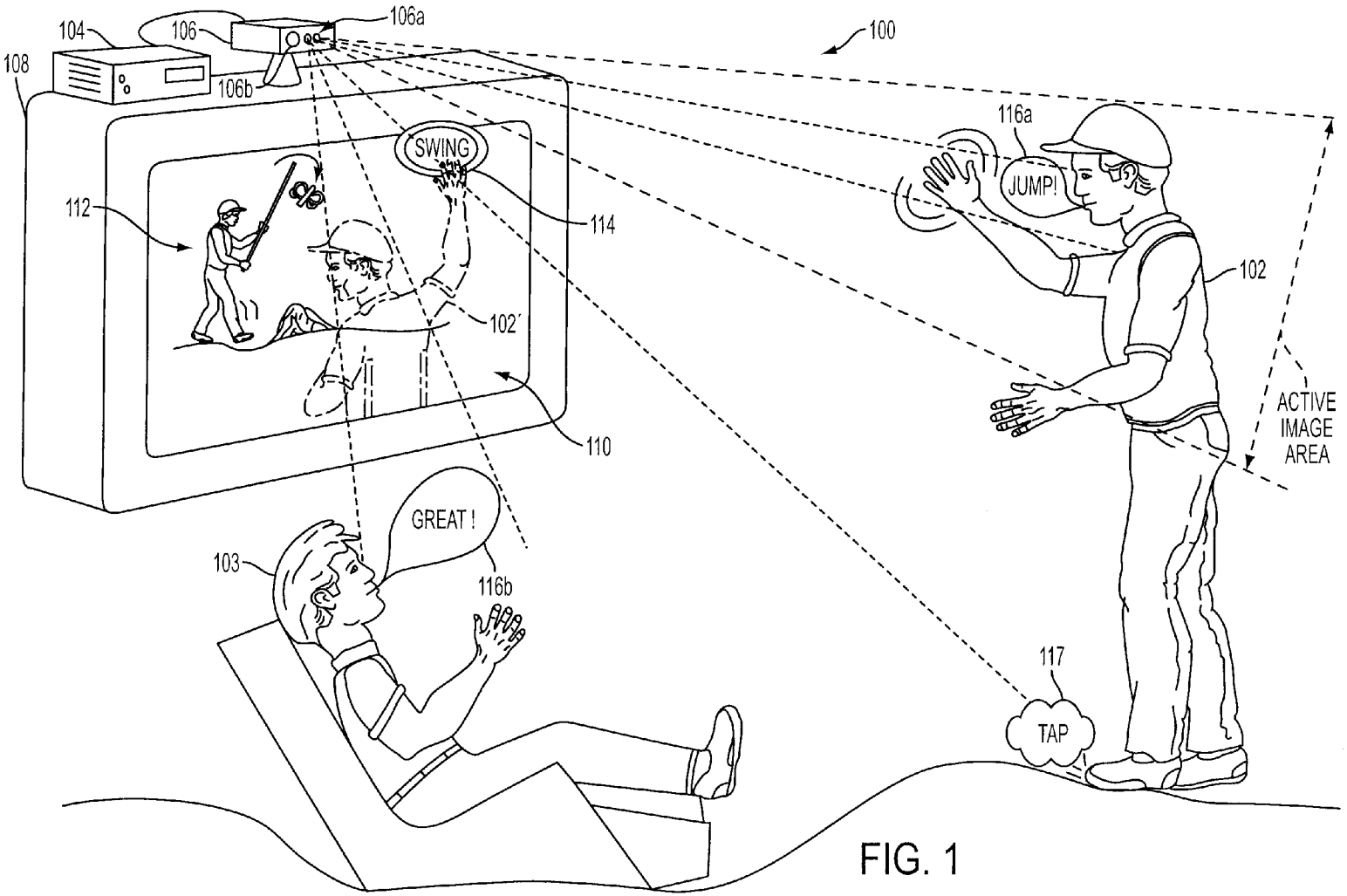
FIG. 1 shows a game environment in which a video game program may be executed for interactivity with one or more users, in accordance with one embodiment of the present invention.

FIG. 1 shows a game environment 100 in which a video game program may be executed for interactivity with one or more users, in accordance with one embodiment of the present invention. As illustrated, player 102 is shown in front of a monitor 108 that includes a display 110. The monitor 108 is interconnected with a computing system 104. The computing system can be a standard computer system, a game console or a portable computer system. In a specific example, but not limited to any brand, the game console can be a one manufactured by Sony Computer Entertainment Inc., Microsoft, or any other manufacturer.

Figure 2:
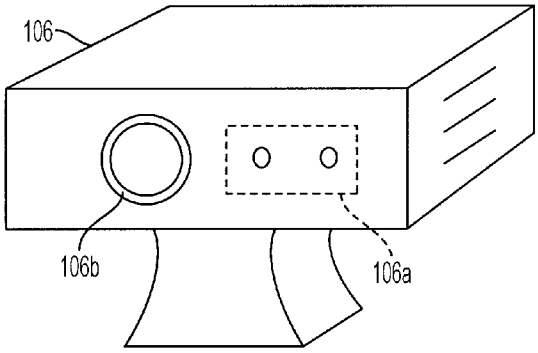
FIG. 2 illustrates a three-dimensional diagram of an example image-sound capture device, in accordance with one embodiment of the present invention.

Computing system 104 is shown interconnected with an image-sound capture device 106. The image-sound capture device 106 includes a sound capture unit 106a and an image capture unit 106*b* as shown in FIG. 2. The player 102 is shown interactively communicating with a game FIG. 112 on the display 110. The video game being executed is one in which input is at least partially provided by the player 102 by way of the image capture unit 106*b*, and the sound capture unit 106*a*. As illustrated, the player 102 may move his hand so as to select interactive icons 114 on the display 110. A translucent image of the player 102' is projected on the display 110 once captured by the image capture unit 106*b*. Thus, the player 102 knows where to move his hand in order to cause selection of icons or interfacing with the game FIG. 112. Techniques for capturing these movements and interactions can vary, but exemplary techniques are described in United Kingdom Applications GB 0304024.3 (PCT/GB2004/000693) and GB 0304022.7 (PCT/GB2004/000703), each filed on Feb. 21, 2003, and each of which is hereby incorporated by reference.

In the example shown, the interactive icon 114 is an icon that would allow the player to select "swing" so that the game FIG. 112 will swing the object being handled. In addition, the player 102 may provide voice commands that can be captured by the sound capture unit 106*a* and then processed by the computing system 104 to provide interactivity with the video game being executed. As shown, the sound source 116*a* is a voice command to "jump!". The sound source 116*a* will then be captured by the sound capture unit 106*a*, and processed by the computing system 104 to then cause the game FIG. 112 to jump. Voice recognition may be used to enable the identification of the voice commands. Alternatively, the player 102 may be in communication with remote users connected to the internet or network, but who are also directly or partially involved in the interactivity of the game.

In accordance with one embodiment of the present invention, the sound capture unit 106*a* may be configured to include at least two microphones which will enable the computing system 104 to select sound coming from particular directions. By enabling the computing system 104 to filter out directions which are not central to the game play (or the focus), distracting sounds in the game environment 100 will not interfere with or confuse the game execution when specific commands are being provided by the player 102. For example, the game player 102 may be tapping his feet and causing a tap noise which is a non-language sound 117. Such sound may be captured by the sound capture unit 106*a*, but then filtered out, as sound coming from the player's feet 102 is not in the zone of focus for the video game.

As will be described below, the zone of focus is preferably identified by the active image area that is the focus point of the image capture unit 106*b*. In an alternative manner, the zone of focus can be manually or automatically selected from a choice of zones presented to the user after an initialization stage. The choice of zones may include one or more pre-calibrated listening zones. A pre-calibrated listening zone containing the sound source may be determined as set forth below. Continuing with the example of FIG. 1, a game observer 103 may be providing a sound source 116*b* which could be distracting to the processing by the computing system during the interactive game play. However, the game observer 103 is not in the active image area of the image capture unit 106*b* and thus, sounds coming from the direction of game observer 103 will be filtered out so that the computing system 104 will not erroneously confuse commands from the sound source 116*b* with the sound sources coming from the player 102, as sound source 116*a*.

The image-sound capture device 106 includes an image capture unit 106*b*, and the sound capture unit 106*a*. The image-sound capture device 106 is preferably capable of digitally capturing image frames and then transferring those image frames to the computing system 104 for further processing. An example of the image capture unit 106*b* is a web camera, which is commonly used when video images are desired to be captured and then transferred digitally to a computing device for subsequent storage or communication over a network, such as the internet. Other types of image capture devices may also work, whether analog or digital, so long as the image data is digitally processed to enable the identification and filtering. In one preferred embodiment, the digital processing to enable the filtering is done in software, after the input data is received. The sound capture unit 106*a* is shown including a pair of microphones (MIC 1 and MIC 2). The microphones are standard microphones, which can be integrated into the housing that makes up the image-sound capture device 106.

Figure 3A:
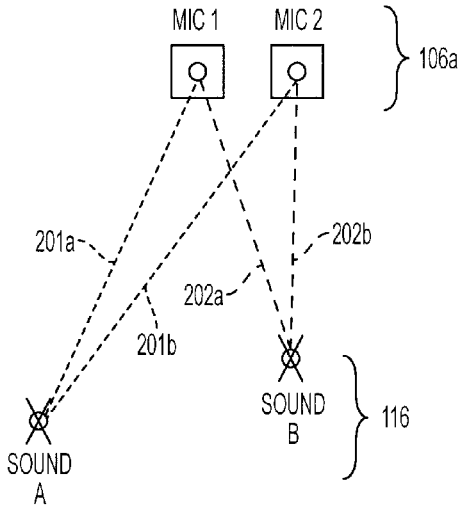
FIGS. 3A and 3B illustrate the processing of sound paths at different microphones that are designed to receive the input, and logic for outputting the selected sound source, in accordance with one embodiment of the present invention.
Figure 3B:
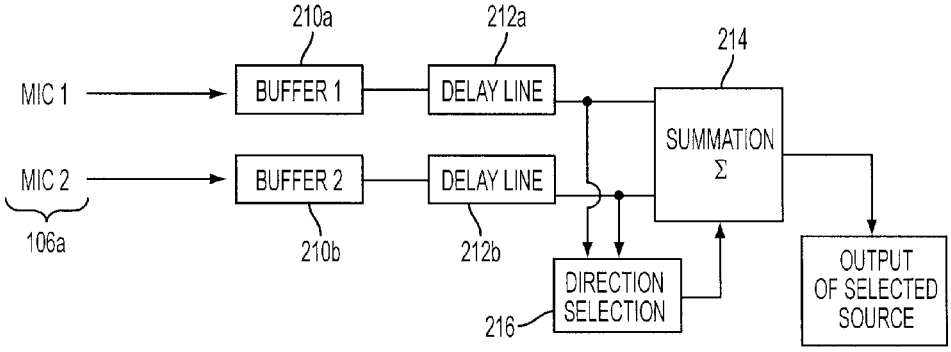

FIG. 3A illustrates sound capture units 106*a* when confronted with sound sources 116 from sound A and sound B. As shown, sound A will project its audible sound and will be detected by MIC 1 and MIC 2 along sound paths 201*a* and 201*b*. Sound B will be projected toward MIC 1 and MIC 2 over sound paths 202*a* and 202*b*. As illustrated, the sound paths for sound A will be of different lengths, thus providing for a relative delay when compared to sound paths 202*a* and 202*b*. The sound coming from each of sound A and sound B may then be processed using a standard triangulation algorithm so that direction selection can occur in box 216, shown in FIG. 3B. The sound coming from MIC 1 and MIC 2 will each be buffered in buffers 1 and 2 (210*a*, 210*b*), and passed through delay lines (212*a*, 212*b*). In one embodiment, the buffering and delay process will be controlled by software, although hardware can be custom designed to handle the operations as well. Based on the triangulation, direction selection 216 will trigger identification and selection of one of the sound sources 116.

The sound coming from each of MIC 1 and MIC 2 will be summed in box 214 before being output as the output of the selected source. In this manner, sound coming from directions other than the direction in the active image area will be filtered out so that such sound sources do not distract processing by the computer system 104, or distract communication with other users that may be interactively playing a video game over a network, or the internet.

Figure 4:
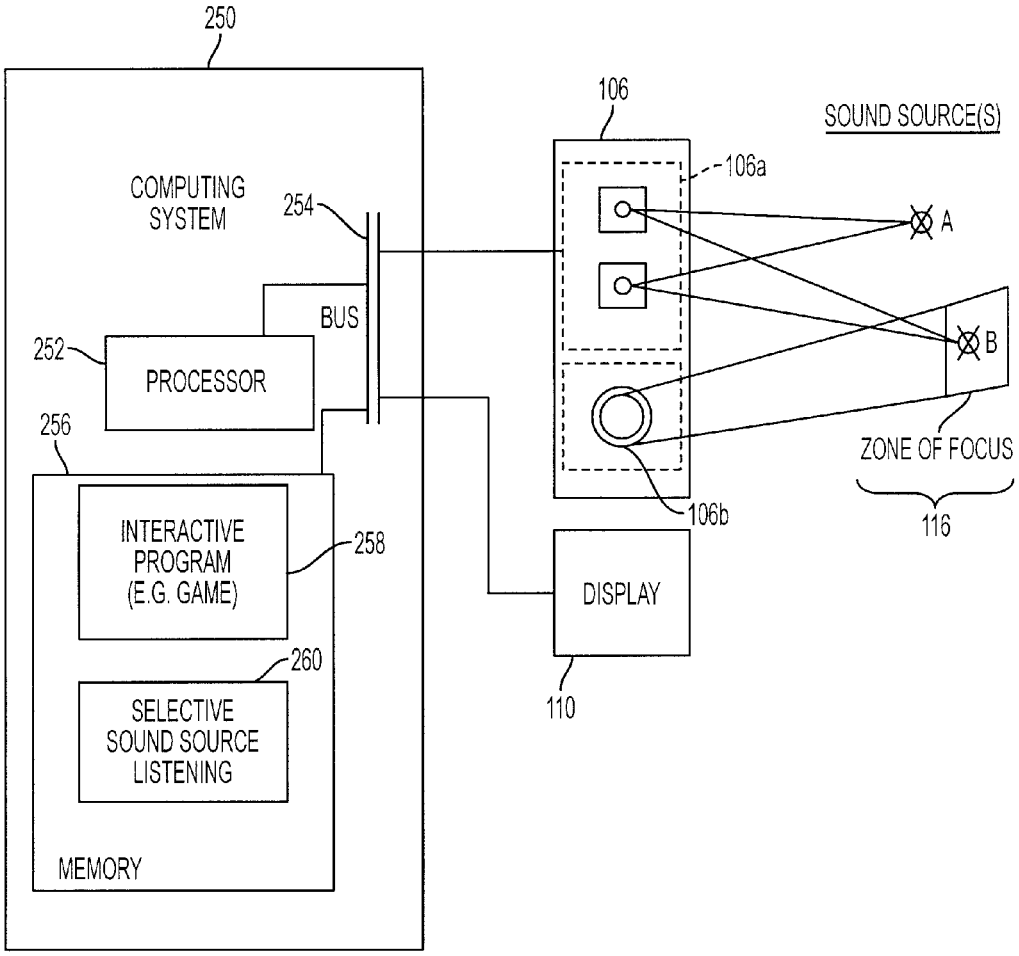
FIG. 4 illustrates an example computing system interfacing with an image-sound capture device for processing input sound sources, in accordance with one embodiment of the present invention.

FIG. 4 illustrates a computing system 250 that may be used in conjunction with the image-sound capture device 106, in accordance with one embodiment of the present invention. The computing system 250 includes a processor 252, and memory 256. A bus 254 will interconnect the processor and the memory 256 with the image-sound capture device 106. The memory 256 will include at least part of the interactive program 258, and also include selective sound source listening logic or code 260 for processing the received sound source data. Based on where the zone of focus is identified to be by the image capture unit 106*b*, sound sources outside of the zone of focus will be selectively filtered by the selective sound source listening logic 260 being executed (e.g., by the processor and stored at least partially in the memory 256). The computing system is shown in its most simplistic form, but emphasis is placed on the fact that any hardware configuration can be used, so long as the hardware can process the instructions to effect the processing of the incoming sound sources and thus enable the selective listening.

The computing system 250 is also shown interconnected with the display 110 by way of the bus. In this example, the zone of focus is identified by the image capture unit being focused toward the sound source B. Sound coming from other sound sources, such as sound source A will be substantially filtered out by the selective sound source listening logic 260 when the sound is captured by the sound capture unit 106*a* and transferred to the computing system 250.

In one specific example, a player can be participating in an internet or networked video game competition with another user where each user's primary audible experience will be by way of speakers. The speakers may be part of the computing system or may be part of the monitor 108. Suppose, therefore, that the local speakers are what is generating sound source A as shown in FIG. 4. In order not to feedback the sound coming out of the local speakers for sound source A to the competing user, the selective sound source listening logic 260 will filter out the sound of sound source A so that the competing user will not be provided with feedback of his or her own sound or voice. By supplying this filtering, it is possible to have interactive communication over a network while interfacing with a video game, while advantageously avoiding destructive feedback during the process.

Figure 5:
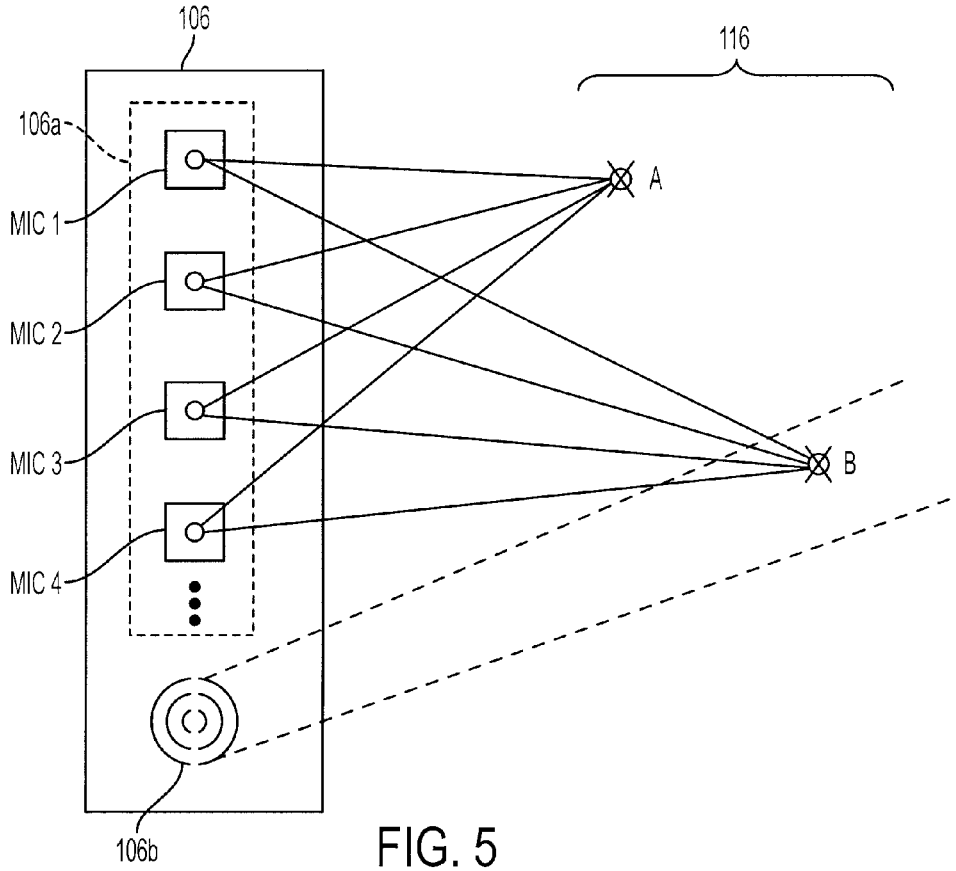
FIG. 5 illustrates an example where multiple microphones are used to increase the precision of the direction identification of particular sound sources, in accordance with one embodiment of the present invention.

FIG. 5 illustrates an example where the image-sound capture device 106 includes at least four microphones (MIC 1 through MIC 4). The sound capture unit 106*a*, is therefore capable of triangulation with better granularity to identify the location of sound sources 116 (A and B). That is, by providing an additional microphone, it is possible to more accurately define the location of the sound sources and thus, eliminate and filter out sound sources that are not of interest or can be destructive to game play or interactivity with a computing system. As illustrated in FIG. 5, sound source 116 (B) is the sound source of interest as identified by the video capture unit 106*b*. Continuing with example of FIG. 5, FIG. 6 identifies how sound source B is identified to a spatial volume.

The spatial volume at which sound source B is located will define the volume of focus 274. By identifying a volume of focus, it is possible to eliminate or filter out noises that are not within a specific volume (i.e., which are not just in a direction). To facilitate the selection of a volume of focus 274, the image-sound capture device 106 will preferably include at least four microphones. At least one of the microphones will be in a different plane than three of the microphones. By maintaining one of the microphones in plane 271 and the remainder of the four in plane 270 of the image-sound capture device 106, it is possible to define a spatial volume.

Consequently, noise coming from other people in the vicinity (shown as 276*a* and 276*b*) will be filtered out as they do not lie within the spatial volume defined in the volume focus 274. Additionally, noise that may be created just outside of the spatial volume, as shown by speaker 276*c*, will also be filtered out as it falls outside of the spatial volume.

Figure 7:
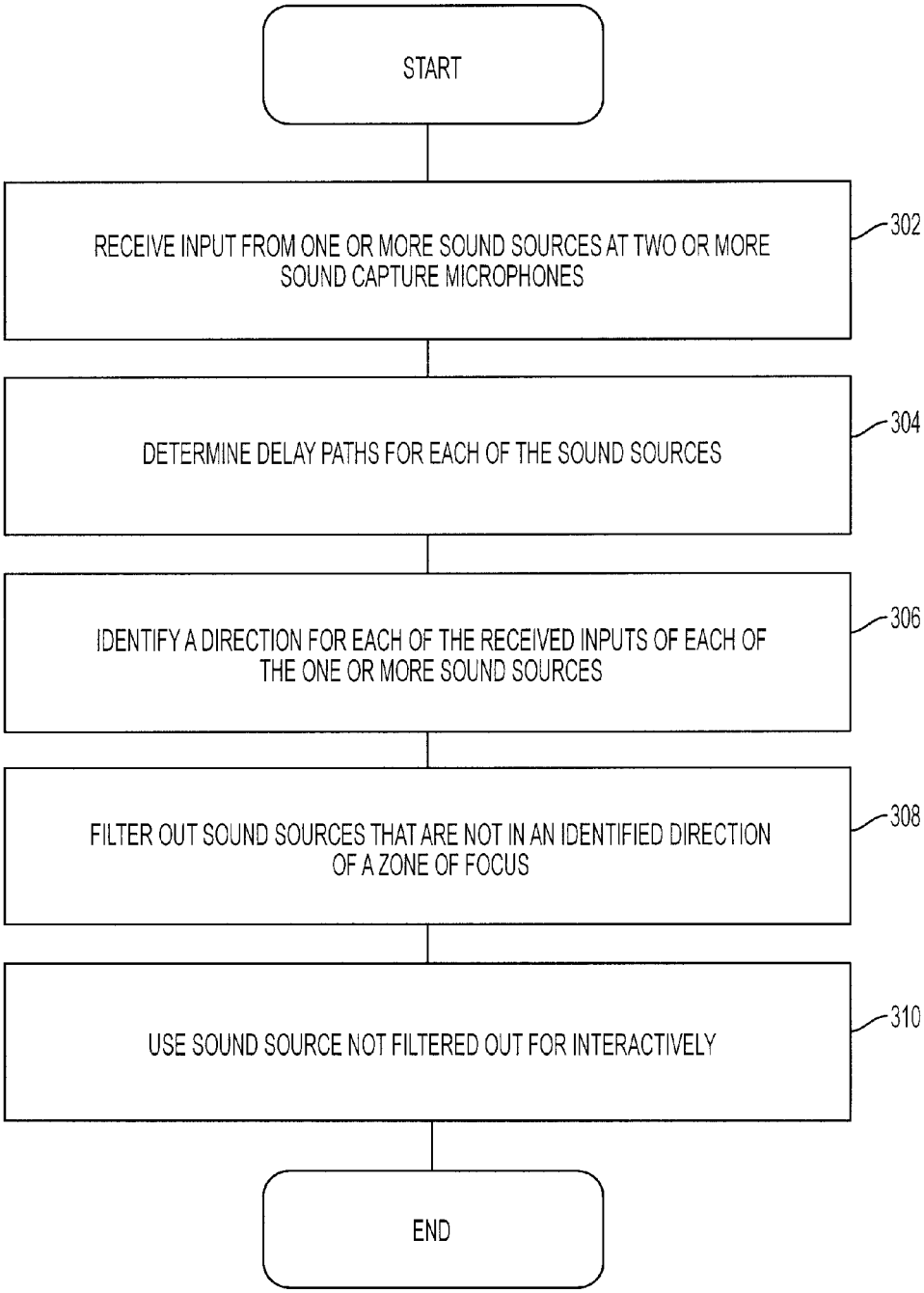
FIGS. 7 and 8 illustrates exemplary method operations that may be processed in the identification of sound sources and exclusion of non-focus sound sources, in accordance with one embodiment of the present invention.

FIG. 7 illustrates a flowchart diagram in accordance with one embodiment of the present invention. The method begins at operation 302 where input is received from one or more sound sources at two or more sound capture microphones. In one example, the two or more sound capture microphones are integrated into the image-sound capture device 106. Alternatively, the two or more sound capture microphones can be part of a second module/housing that interfaces with the image capture unit 106*b*. Alternatively, the sound capture unit 106*a* can include any number of sound capture microphones, and sound capture microphones can be placed in specific locations designed to capture sound from a user that may be interfacing with a computing system.

The method moves to operation 304 where a delay path for each of the sound sources may be determined. Example delay paths are defined by the sound paths 201 and 202 of FIG. 3A. As is well known, the delay paths define the time it takes for sound waves to travel from the sound sources to the specific microphones that are situated to capture the sound. Based on the delay it takes sound to travel from the particular sound sources 116, the microphones can determine what the delay is and approximate location from which the sound is emanating from using a standard triangulation algorithm.

The method then continues to operation 306 where a direction for each of the received inputs of the one or more sound sources is identified. That is, the direction from which the sound is originating from the sound sources 116 is identified relative to the location of the image-sound capture device, including the sound capture unit 106*a*. Based on the identified directions, sound sources that are not in an identified direction of a zone (or volume) of focus are filtered out in operation 308. By filtering out the sound sources that are not originating from directions that are in the vicinity of the zone of focus, it is possible to use the sound source not filtered out for interactivity with a computer program, as shown in operation 310.

For instance, the interactive program can be a video game in which the user can interactively communicate with features of the video game, or players that may be opposing the primary player of the video game. The opposing player can either be local or located at a remote location and be in communication with the primary user over a network, such as the internet. In addition, the video game can also be played between a number of users in a group designed to interactively challenge each other's skills in a particular contest associated with the video game.

Figure 8:
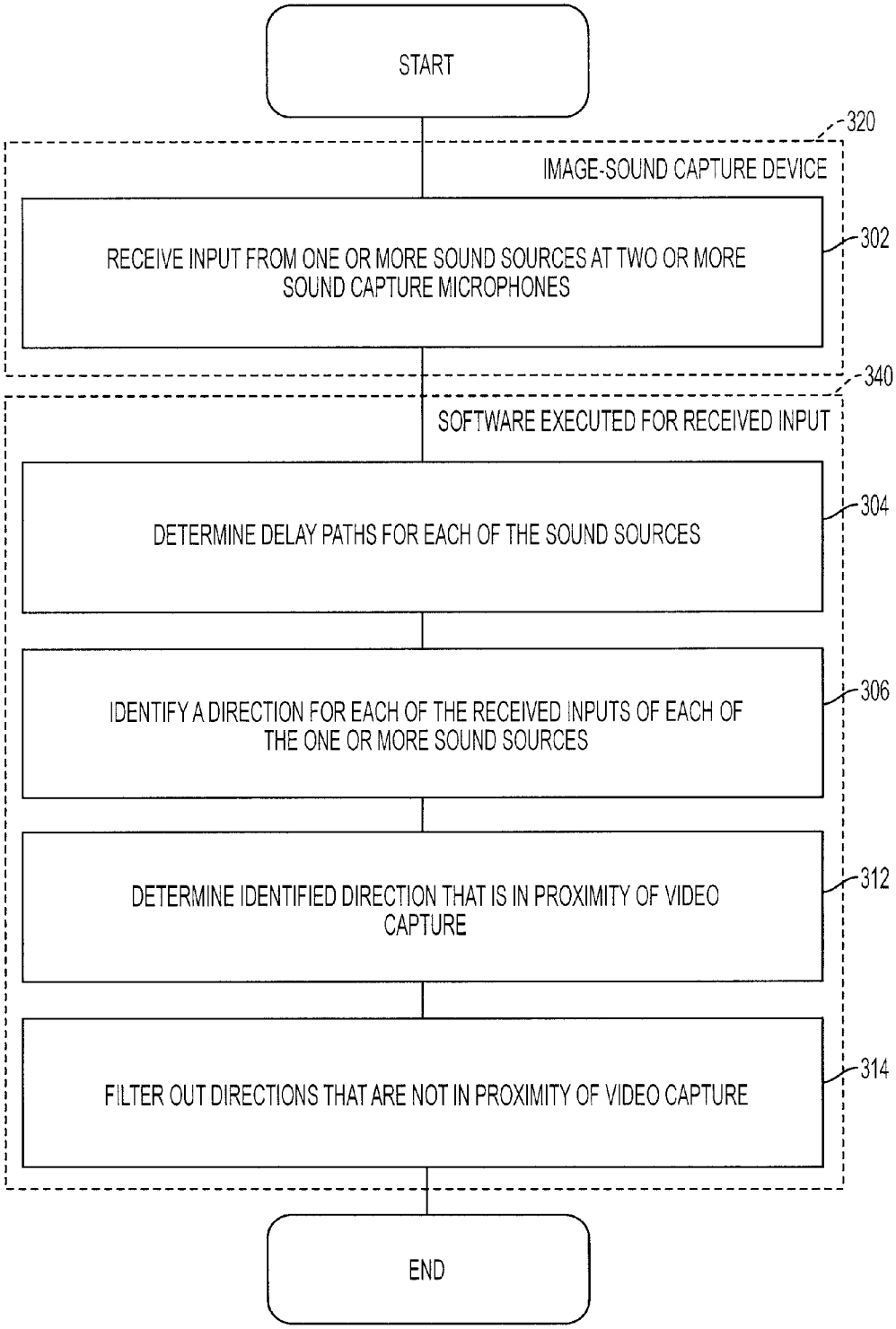

FIG. 8 illustrates a flowchart diagram in which image-sound capture device operations 320 are illustrated separate from the software executed operations that are performed on the received input in operations 340. Thus, once the input from the one or more sound sources at the two or more sound capture microphones is received in operation 302, the method proceeds to operation 304 where in software, the delay path for each of the sound sources is determined. Based on the delay paths, a direction for each of the received inputs is identified for each of the one or more sound sources in operation 306, as mentioned above.

At this point, the method moves to operation 312 where the identified direction that is in proximity of video capture is determined. For instance, video capture will be targeted at an active image area as shown in FIG. 1. Thus, the proximity of video capture would be within this active image area (or volume), and any direction associated with a sound source that is within this or in proximity to this, image-active area, will be determined. Based on this determination, the method proceeds to operation 314 where directions (or volumes) that are not in proximity of video capture are filtered out. Accordingly, distractions, noises and other extraneous input that could interfere in video game play of the primary player will be filtered out in the processing that is performed by the software executed during game play.

Consequently, the primary user can interact with the video game, interact with other users of the video game that are actively using the video game, or communicate with other users over the network that may be logged into or associated with transactions for the same video game that is of interest. Such video game communication, interactivity and control will thus be uninterrupted by extraneous noises and/or observers that are not intended to be interactively communicating or participating in a particular game or interactive program.

It should be appreciated that the embodiments described herein may also apply to on-line gaming applications. That is, the embodiments described above may occur at a server that sends a video signal to multiple users over a distributed network, such as the Internet, to enable players at remote noisy locations to communicate with each other. It should be further appreciated that the embodiments described herein may be implemented through either a hardware or a software implementation. That is, the functional descriptions discussed above may be synthesized to define a microchip having logic configured to perform the functional tasks for each of the modules associated with the noise cancellation scheme.

Also, the selective filtering of sound sources can have other applications, such as telephones. In phone use environments, there is usually a primary person (i.e., the caller) desiring to have a conversation with a third party (i.e., the callee). During that communication, however, there may be other people in the vicinity who are either talking or making noise. The phone, being targeted toward the primary user (by the direction of the receiver, for example) can make the sound coming from the primary user's mouth the zone of focus, and thus enable the selection for listening to only the primary user. This selective listening may therefore enable the substantial filtering out of voices or noises that are not associated with the primary person, and thus, the receiving party may be able to receive a more clear communication from the primary person using the phone.

Additional technologies may also include other electronic equipment that can benefit from taking in sound as an input for control or communication. For instance, a user can control settings in an automobile by voice commands, while avoiding other passengers from disrupting the commands. Other applications may include computer controls of applications, such as browsing applications, document preparation, or communications. By enabling this filtering, it is possible to more effectively issue voice or sound commands without interruption by surrounding sounds. As such, any electronic apparatus may be controlled by voice commands in conjunction with any of the embodiments described herein.

Further, the embodiments of the present invention have a wide array of applications, and the scope of the claims should be read to include any such application that can benefit from such embodiments.

For instance, in a similar application, it may be possible to filter out sound sources using sound analysis. If sound analysis is used, it is possible to use as few as one microphone. The sound captured by the single microphone can be digitally analyzed (in software or hardware) to determine which voice or sound is of interest. In some environments, such as gaming, it may be possible for the primary user to record his or her voice once to train the system to identify the particular voice. In this manner, exclusion of other voices or sounds will be facilitated. Consequently, it would not be necessary to identify a direction, as filtering could be done based one sound tones and/or frequencies.

All of the advantages mentioned above with respect to sound filtering, when direction and volume are taken into account, are equally applicable.

In one embodiment, methods and apparatuses for adjusting a listening area for capturing sounds may be configured to identify different areas or volumes that encompass corresponding listening zones. Specifically, a microphone array may be configured to detect sounds originating from areas or volumes corresponding to these listening zones. Further, these areas or volumes may be a smaller subset of areas or volumes that are capable of being monitored for sound by the microphone array. In one embodiment, the listening zone that is detected by the microphone array for sound may be dynamically adjusted such that the listening zone may be enlarged, reduced, or stay the same size but be shifted to a different location. For example, the listening zone may be further focused to detect a sound in a particular location such that the zone that is monitored is reduced from the initial listening zone. Further, the level of the sound may be compared against a threshold level to validate the sound. The sound source from the particular location is monitored for continuing sound. In one embodiment, by reducing from the initial area to the reduced area, unwanted background noises are minimized. In some embodiments, the adjustment to the area or volume that is detected may be determined based on a zone of focus or field of view of an image capture device. For example, the field of view of the image capture device may zoom in (magnified), zoom out (minimized), and/or rotate about a horizontal or vertical axis. In one embodiment, the adjustments performed to the area that is detected by the microphone tracks the area associated with the current view of the image capture unit.

Figure 9:
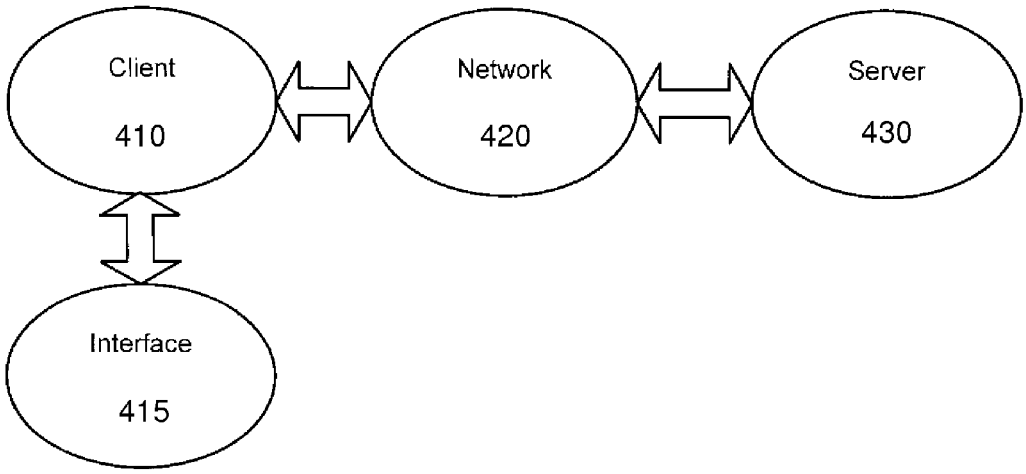
FIG. 9 is a diagram illustrating an environment within which the methods and apparatuses for adjusting a listening area for capturing sounds or capturing audio signals based on a visual image or capturing an audio signal based on a location of the signal, are implemented.

FIG. 9 is a diagram illustrating an environment within which the methods and apparatuses for adjusting a listening area for capturing sounds, or capturing audio signals based on a visual image or a location of source of a sound signal are implemented. The environment may include an electronic device 410 (e.g., a computing platform configured to act as a client device, such as a personal digital video recorder, digital audio player, computer, a personal digital assistant, a cellular telephone, a camera device, a set top box, a gaming console), a user interface 415, a network 420 (e.g., a local area network, a home network, the Internet), and a server 430 (e.g., a computing platform configured to act as a server). In one embodiment, the network 420 may be implemented via wireless or wired solutions.

In one embodiment, one or more user interface 415 components may be made integral with the electronic device 410 (e.g., keypad and video display screen input and output interfaces in the same housing as personal digital assistant electronics (e.g., as in a Clie® manufactured by Sony Corporation). In other embodiments, one or more user interface 415 components (e.g., a keyboard, a pointing device such as a mouse and trackball, a microphone, a speaker, a display, a camera) may be physically separate from, and are conventionally coupled to, electronic device 410. The user may utilize interface 415 to access and control content and applications stored in electronic device 410, server 430, or a remote storage device (not shown) coupled via network 420.

In accordance with the invention, embodiments of capturing an audio signal based on a location of the signal as described below are executed by an electronic processor in electronic device 410, in server 430, or by processors in electronic device 410 and in server 430 acting together. Server 430 is illustrated in FIG. 1 as being a single computing platform, but in other instances are two or more interconnected computing platforms that act as a server.

Methods and apparatuses for, adjusting a listening area for capturing sounds, or capturing audio signals based on a visual image or a location of a source of a sound signal may be shown in the context of exemplary embodiments of applications in which a user profile is selected from a plurality of user profiles. In one embodiment, the user profile is accessed from an electronic device 410 and content associated with the user profile can be created, modified, and distributed to other electronic devices 410. In one embodiment, the content associated with the user profile may includes customized channel listing associated with television or musical programming and recording information associated with customized recording times.

In one embodiment, access to create or modify content associated with the particular user profile may be restricted to authorized users. In one embodiment, authorized users may be based on a peripheral device such as a portable memory device, a dongle, and the like. In one embodiment, each peripheral device may be associated with a unique user identifier which, in turn, may be associated with a user profile.

Figure 10:
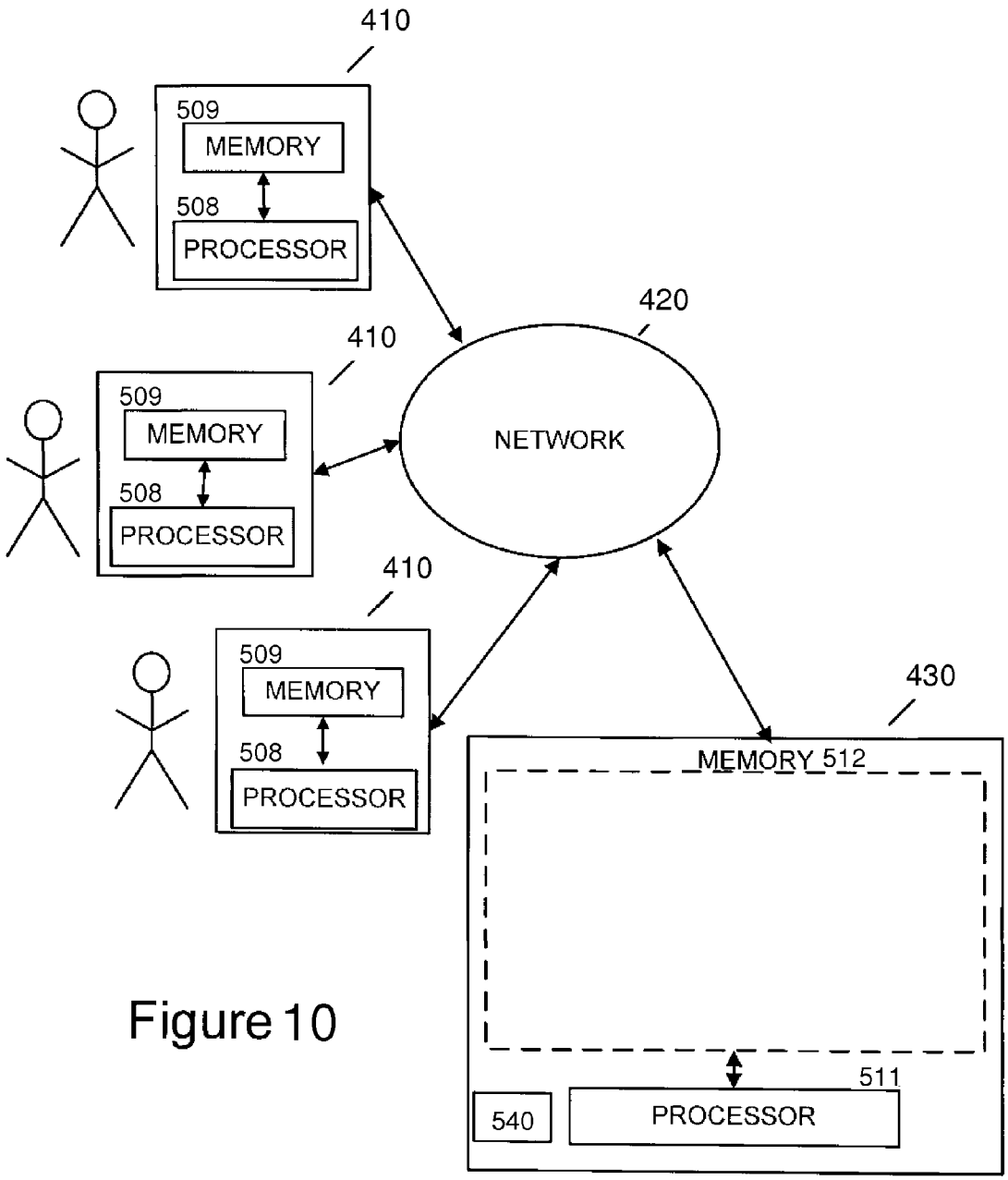
FIG. 10 is a simplified block diagram illustrating one embodiment in which the methods and apparatuses for adjusting a listening area for capturing sounds or capturing audio signals based on a visual image or capturing an audio signal based on a location of the signal, are implemented are implemented.

FIG. 10 is a simplified diagram illustrating an exemplary architecture in which the methods and apparatuses for capturing an audio signal based on a location of the signal are implemented. The exemplary architecture includes a plurality of electronic devices 410, a server device 430, and a network 420 connecting electronic devices 410 to server device 430 and each electronic device 410 to each other. The plurality of electronic devices 410 may each be configured to include a computer-readable medium 509, such as random access memory, coupled to an electronic processor 508. Processor 508 executes program instructions stored in the computer-readable medium 509. A unique user operates each electronic device 410 via an interface 415 as described with reference to FIG. 9.

Server device 430 includes a processor 511 coupled to a computer-readable medium, such as a server memory 512. In one embodiment, the server device 430 is coupled to one or more additional external or internal devices, such as, without limitation, a secondary data storage element, such as database 540.

In one instance, processors 508 and 511 may be manufactured by Intel Corporation, of Santa Clara, Calif. In other instances, other microprocessors are used.

The plurality of client devices 410 and the server 430 include instructions for a customized application for capturing an audio signal based on a location of the signal. In one embodiment, the plurality of computer-readable media, e.g. memories 509 and 512 may contain, in part, the customized application. Additionally, the plurality of client devices 410 and the server device 430 are configured to receive and transmit electronic messages for use with the customized application. Similarly, the network 420 is configured to transmit electronic messages for use with the customized application.

One or more user applications may be stored in memories 509, in server memory 512, or a single user application is stored in part in one memory 509 and in part in server memory 512. In one instance, a stored user application, regardless of storage location, is made customizable based on capturing an audio signal based on a location of the signal as determined using embodiments described below.

Figure 11A:
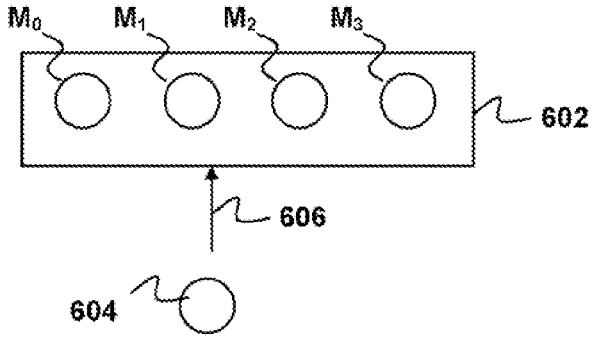
FIG. 11A is schematic diagram of a microphone array illustrating determination of a listening direction according to an embodiment of the present invention.

Part of the preceding discussion refers to receiving input from one or more sound sources at two or more sound source capture microphones, determining delay paths from each of the sound sources and identifying a direction for each of the received inputs of each of the one or more sound sources and filtering out sound sources that are not in an identified direction of a zone of focus. By way of example, and without limitation, such processing of sound inputs may proceed as discussed below with respect to Figures. 11A, 11B, 12A, 12B and 13. As depicted in FIG. 11A, a microphone array 602 may include four microphones $M_0$, $M_1$, $M_2$, and $M_3$. In general, the microphones $M_0$, $M_1$, $M_2$, and $M_3$ may be omni-directional microphones, i.e., microphones that can detect sound from essentially any direction. Omni-directional microphones are generally simpler in construction and less expensive than microphones having a preferred listening direction. An audio signal 606 arriving at the microphone array 602 from one or more sources 604 may be expressed as a vector $x=[x_0, x_1, x_2, x_3]$, where $x_0$, $x_1$, $x_2$ and $x_3$ are the signals received by the microphones $M_0$, $M_1$, $M_2$ and $M_3$ respectively. Each signal $x_m$ generally includes subcomponents due to different sources of sounds. The subscript m range from 0 to 3 in this example and is used to distinguish among the different microphones in the array. The subcomponents may be expressed as a vector $s=[s_1, s_2, \ldots s_k]$, where K is the number of different sources. To separate out sounds from the signal s originating from different sources one must determine the best filter time delay of arrival (TDA) filter. For precise TDA detection, a state-of-art yet computationally intensive Blind Source Separation (BSS) is preferred theoretically. Blind source separation separates a set of signals into a set of other signals, such that the regularity of each resulting signal is maximized, and the regularity between the signals is minimized (i.e., statistical independence is maximized or decorrelation is minimized).

The blind source separation may involve an independent component analysis (ICA) that is based on second-order statistics. In such a case, the data for the signal arriving at each microphone may be represented by the random vector $x_m=[x_1, \ldots x_n]$ and the components as a random vector $s=[s_1, \ldots s_n]$. The task is to transform the observed data $x_m$, using a linear static transformation $s=Wx$, into maximally independent components s measured by some function $F(s_1, \ldots s_n)$ of independence.

The components $x_{mi}$ of the observed random vector $x_m=(x_{m1}, \ldots, x_{mn})$ are generated as a sum of the independent components $s_{mk}$, $k=1, \ldots, n$, $x_{mi}=a_{mi1}s_{m1}+\ldots+a_{mik}s_{mk}+\ldots+a_{min}s_{mn}$, weighted by the mixing weights $a_{mik}$. In other words, the data vector $x_m$ can be written as the product of a mixing matrix A with the source vector $s^T$, i.e., $x_m=A\cdot s^T$ or $$\begin{bmatrix} x_{m1} \\ \vdots \\ x_{mn} \end{bmatrix} = \begin{bmatrix} a_{m11} & \cdots & a_{m1n} \\ \vdots & \cdots & \vdots \\ a_{mn1} & \cdots & a_{mnn} \end{bmatrix} \cdot \begin{bmatrix} s_1 \\ \vdots \\ s_n \end{bmatrix}$$

The original sources s can be recovered by multiplying the observed signal vector $x_m$ with the inverse of the mixing matrix $W=A^{-1}$, also known as the unmixing matrix. Determination of the unmixing matrix $A^{-1}$ may be computationally intensive. Some embodiments of the invention use blind source separation (BSS) to determine a listening direction for the microphone array. The listening direction and/or one or more listening zones of the microphone array can be calibrated prior to run time (e.g., during design and/or manufacture of the microphone array) and re-calibrated at run time.

By way of example, the listening direction may be determined as follows. A user standing in a listening direction with respect to the microphone array may record speech for about 10 to 30 seconds. The recording room should not contain transient interferences, such as competing speech, background music, etc. Pre-determined intervals, e.g., about every 8 milliseconds, of the recorded voice signal are formed into analysis frames, and transformed from the time domain into the frequency domain. Voice-Activity Detection (VAD) may be performed over each frequency-bin component in this frame. Only bins that contain strong voice signals are collected in each frame and used to estimate its $2^{nd}$-order statistics, for each frequency bin within the frame, i.e. a "Calibration Covariance Matrix" $Cal_Cov(j,k)=E((X'_{jk})^T*X'_{jk})$, where E refers to the operation of determining the expectation value and $(X'_{jk})^T$ is the transpose of the vector $X'_{jk}$. The vector $X'_{jk}$ is a M+1 dimensional vector representing the Fourier transform of calibration signals for the $j^{th}$ frame and the $k^{th}$ frequency bin.

The accumulated covariance matrix then contains the strongest signal correlation that is emitted from the target listening direction. Each calibration covariance matrix Cal_Cov(j,k) may be decomposed by means of "Principal Component Analysis" (PCA) and its corresponding eigenmatrix C may be generated. The inverse $C^{-1}$ of the eigenmatrix C may thus be regarded as a "listening direction" that essentially contains the most information to de-correlate the covariance matrix, and is saved as a calibration result. As used herein, the term "eigenmatrix" of the calibration covariance matrix Cal_Cov(j,k) refers to a matrix having columns (or rows) that are the eigenvectors of the covariance matrix.

At run time, this inverse eigenmatrix $C^{-1}$ may be used to de-correlate the mixing matrix A by a simple linear transformation. After de-correlation, A is well approximated by its diagonal principal vector, thus the computation of the unmixing matrix (i.e., $A^{-1}$) is reduced to computing a linear vector inverse of: $A1=A*C^{-1}$, where A1 is the new transformed mixing matrix in independent component analysis (ICA). The principal vector is just the diagonal of the matrix A1.

Recalibration in runtime may follow the preceding steps. However, the default calibration in manufacture takes a very large amount of recording data (e.g., tens of hours of clean voices from hundreds of persons) to ensure an unbiased, person-independent statistical estimation. While the recalibration at runtime requires small amount of recording data from a particular person, the resulting estimation of $C^{-1}$ is thus biased and person-dependant.

As described above, a principal component analysis (PCA) may be used to determine eigenvalues that diagonalize the mixing matrix A. The prior knowledge of the listening direction allows the energy of the mixing matrix A to be compressed to its diagonal. This procedure, referred to herein as semi-blind source separation (SBSS) greatly simplifies the calculation the independent component vector $s^T$.

Figure 11B:
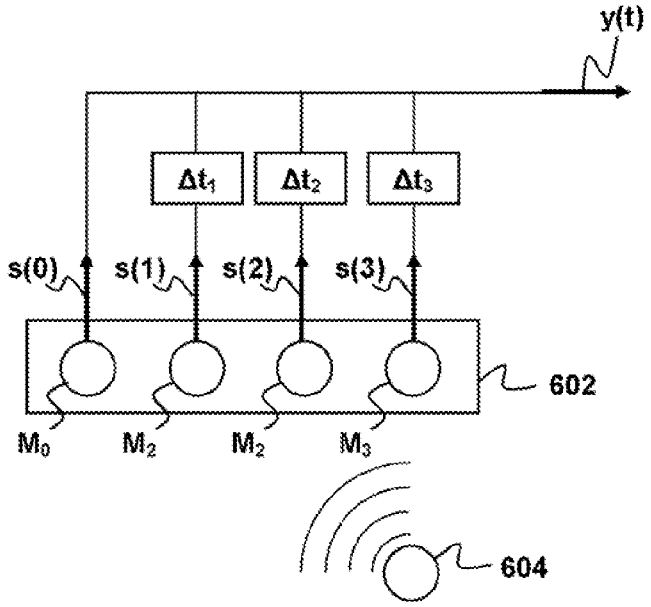
FIG. 11B is a schematic diagram of a microphone array illustrating anti-causal filtering in conjunction with embodiments of the present invention.

Embodiments of the invention may also make use of anti-causal filtering. The problem of causality is illustrated in FIG. 11B. In the microphone array 602 one microphone, e.g., $M_0$ is chosen as a reference microphone. In order for the signal x(t) from the microphone array to be causal, signals from the source 604 must arrive at the reference microphone $M_0$ first. However, if the signal arrives at any of the other microphones first, $M_0$ cannot be used as a reference microphone. Generally, the signal will arrive first at the microphone closest to the source 604. Embodiments of the present invention adjust for variations in the position of the source 604 by switching the reference microphone among the microphones $M_0$, $M_1$, $M_2$, $M_3$ in the array 602 so that the reference microphone always receives the signal first. Specifically, this anti-causality may be accomplished by artificially delaying the signals received at all the microphones in the array except for the reference microphone while minimizing the length of the delay filter used to accomplish this.

For example, if microphone $M_0$ is the reference microphone, the signals at the other three (non-reference) microphones $M_1$, $M_2$, $M_3$ may be adjusted by a fractional delay $\Delta t_m$, (m=1, 2, 3) based on the system output y(t). The fractional delay $\Delta t_m$ may be adjusted based on a change in the signal to noise ratio (SNR) of the system output y(t). Generally, the delay is chosen in a way that maximizes SNR. For example, in the case of a discrete time signal the delay for the signal from each non-reference microphone $\Delta t_m$ at time sample t may be calculated according to: $\Delta t_m(t)=\Delta t_m(t-1)+\mu\Delta SNR$, where ΔSNR is the change in SNR between t−2 and t−1 and μ is a pre-defined step size, which may be empirically determined. If Δt(t)>1 the delay has been increased by 1 sample. In embodiments of the invention using such delays for anti-causality, the total delay (i.e., the sum of the $\Delta t_m$) is typically 2-3 integer samples. This may be accomplished by use of 2-3 filter taps. This is a relatively small amount of delay when one considers that typical digital signal processors may use digital filters with up to 512 taps. It is noted that applying the artificial delays $\Delta t_m$ to the non-reference microphones is the digital equivalent of physically orienting the array 602 such that the reference microphone $M_0$ is closest to the sound source 604.

Figure 12A:
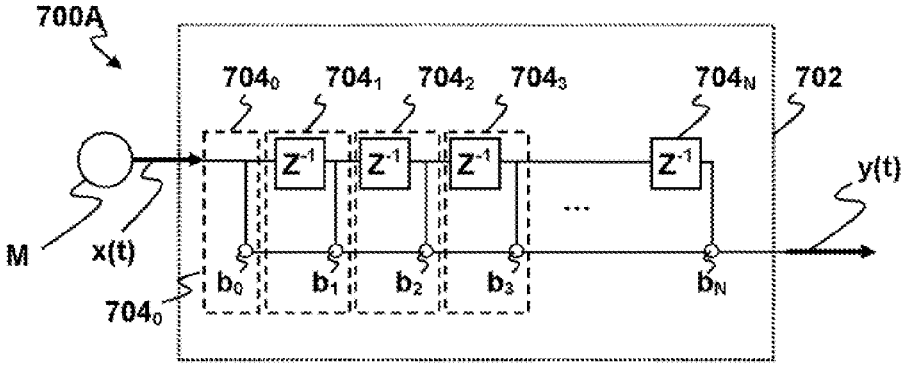
FIG. 12A is a schematic diagram of a microphone array and filter apparatus with which methods and apparatuses according to certain embodiments of the invention may be implemented.

FIG. 12A illustrates filtering of a signal from one of the microphones $M_0$ in the array 602. In an apparatus 700A the signal from the microphone $x_0(t)$ is fed to a filter 702, which is made up of N+1 taps $\mathbf{704}_0 \ldots \mathbf{704}_N$. Except for the first tap $\mathbf{704}_0$ each tap $\mathbf{704}_i$ includes a delay section, represented by a z-transform $z^{-1}$ and a finite response filter. Each delay section introduces a unit integer delay to the signal x(t). The finite impulse response filters are represented by finite impulse response filter coefficients $b_0, b_1, b_2, b_3, \ldots b_N$. In embodiments of the invention, the filter 702 may be implemented in hardware or software or a combination of both hardware and software. An output y(t) from a given filter tap $\mathbf{704}_i$ is just the convolution of the input signal to filter tap $\mathbf{704}_i$ with the corresponding finite impulse response coefficient $b_i$. It is noted that for all filter taps $\mathbf{704}_i$ except for the first one $\mathbf{704}_0$ the input to the filter tap is just the output of the delay section $z^{-1}$ of the preceding filter tap $\mathbf{704}_{i-1}$. Thus, the output of the filter 402 may be represented by:

$$y(t)=x(t)*b_0+x(t-1)*b_1+x(t-2)*b_2+\ldots+x(t-N)b_N.$$

Where the symbol "*" represents the convolution operation. Convolution between two discrete time functions f(t) and g(t) is defined as $$(f*g)(t)=\sum_n f(n)g(t-n).$$

The general problem in audio signal processing is to select the values of the finite impulse response filter coefficients $b_0$, $b_1, \ldots, b_N$ that best separate out different sources of sound from the signal y(t).

If the signals x(t) and y(t) are discrete time signals each delay $z^{-1}$ is necessarily an integer delay and the size of the delay is inversely related to the maximum frequency of the microphone. This ordinarily limits the resolution of the apparatus 400A. A higher than normal resolution may be obtained if it is possible to introduce a fractional time delay Δ into the signal y(t) so that:

$$y(t+\Delta)=x(t+\Delta)*b_0+x(t-1+\Delta)*b_1+x(t-2+\Delta)*b_2+\ldots+x(t-N+\Delta)b_N,$$

where Δ is between zero and ±1. In embodiments of the present invention, a fractional delay, or its equivalent, may be obtained as follows. First, the signal x(t) is delayed by j samples. each of the finite impulse response filter coefficients $b_i$ (where i=0, 1, . . . N) may be represented as a (J+1)-dimensional column vector $$b_i = \begin{bmatrix} b_{i0} \\ b_{i1} \\ \vdots \\ b_{iJ} \end{bmatrix}$$

and y(t) may be rewritten as:

$$y(t) = \begin{bmatrix} x(t) \\ x(t-1) \\ \vdots \\ x(t-J) \end{bmatrix}^T * \begin{bmatrix} b_{00} \\ b_{01} \\ \vdots \\ b_{0j} \end{bmatrix} + \begin{bmatrix} x(t-1) \\ x(t-2) \\ \vdots \\ x(t-J-1) \end{bmatrix}^T * \begin{bmatrix} b_{10} \\ b_{11} \\ \vdots \\ b_{1J} \end{bmatrix} + \cdots + \begin{bmatrix} x(t-N-J) \\ x(t-N-J+1) \\ \vdots \\ x(t-N) \end{bmatrix}^T * \begin{bmatrix} b_{N0} \\ b_{N1} \\ \vdots \\ b_{NJ} \end{bmatrix}$$

When y(t) is represented in the form shown above one can interpolate the value of y(t) for any factional value of t=t+Δ. Specifically, three values of y(t) can be used in a polynomial interpolation. The expected statistical precision of the fractional value A is inversely proportional to J+1, which is the number of "rows" in the immediately preceding expression for y(t).

In embodiments of the invention, the quantity t+Δ may be regarded as a mathematical abstract to explain the idea in time-domain. In practice, one need not estimate the exact "t+Δ". Instead, the signal y(t) may be transformed into the frequency-domain, so there is no such explicit "t+Δ". Instead an estimation of a frequency-domain function $F(b_i)$is sufficient to provide the equivalent of a fractional delay Δ. The above equation for the time domain output signal y(t) may be transformed from the time domain to the frequency domain, e.g., by taking a Fourier transform, and the resulting equation may be solved for the frequency domain output signal Y(k). This is equivalent to performing a Fourier transform (e.g., with a fast Fourier transform (fft)) for J+1 frames where each frequency bin in the Fourier transform is a (J+1)×1 column vector. The number of frequency bins is equal to N+1.

The finite impulse response filter coefficients $b_{ij}$ for each row of the equation above may be determined by taking a Fourier transform of x(t) and determining the $b_{ij}$ through semi-blind source separation. Specifically, for each "row" of the above equation becomes:

$$\begin{aligned} X_0 &= FT(x(t, t-1, \ldots, t-N)) = [X_{00}, X_{01}, \ldots, X_{0N}] \\ X_1 &= FT(x(t-1, t-2, \ldots, t-(N+1)) = [X_{10}, X_{11}, \ldots, X_{1N}] \\ &\vdots \\ X_J &= FT(x(t, t-1, \ldots, t-(N+J))) = [X_{J0}, X_{J1}, \ldots, X_{JN}], \end{aligned}$$

where FT( ) represents the operation of taking the Fourier transform of the quantity in parentheses.

Furthermore, although the preceding deals with only a single microphone, embodiments of the invention may use arrays of two or more microphones. In such cases the input signal x(t) may be represented as an M+1-dimensional vector: $x(t)=(x_0(t), x_1(t), \ldots, x_M(t))$, where M+1 is the number of microphones in the array.

Figure 12B:
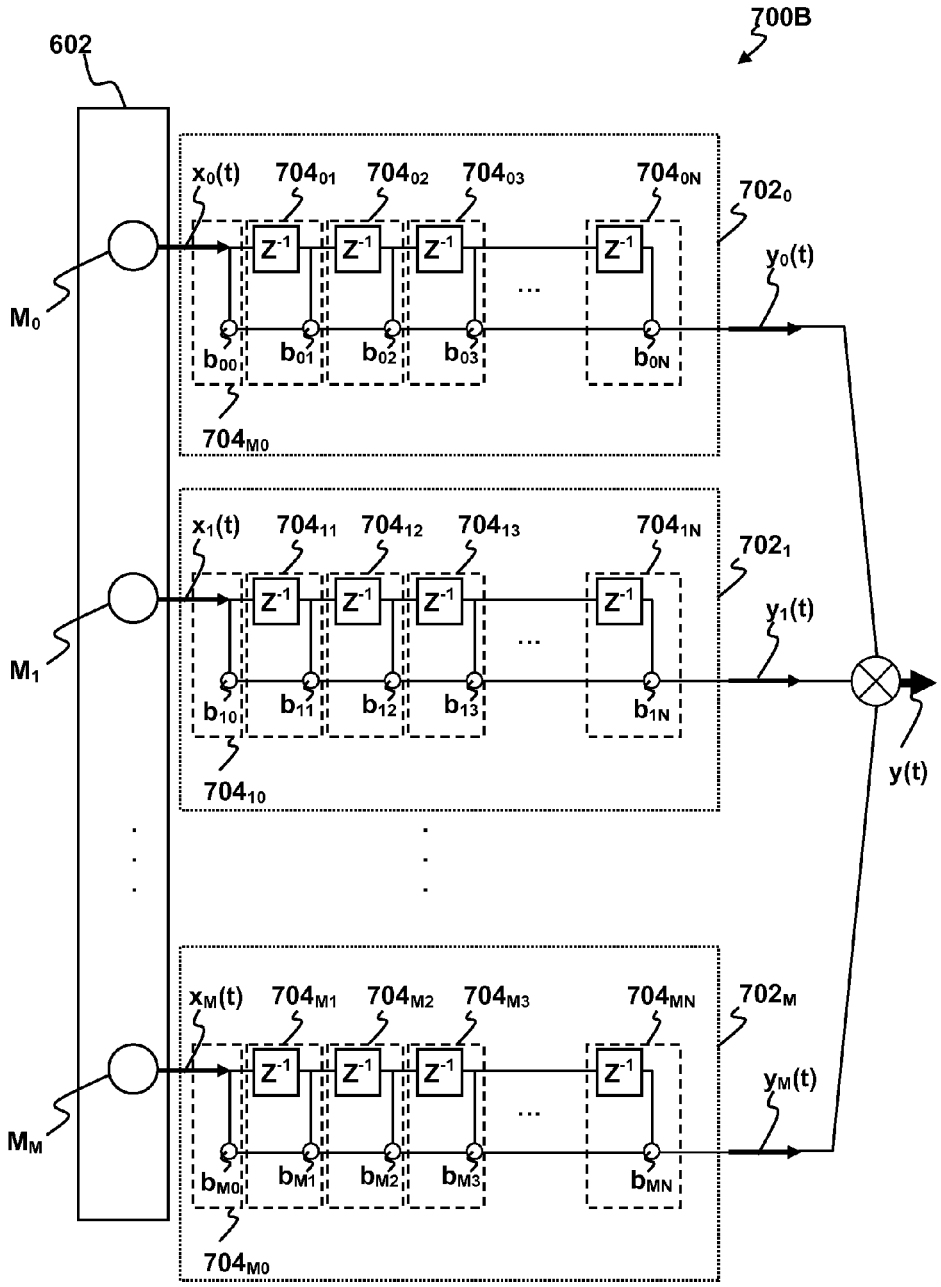
FIG. 12B is a schematic diagram of an alternative microphone array and filter apparatus with which methods and apparatuses according to certain embodiments of the invention may be implemented.

FIG. 12B depicts an apparatus 700B having microphone array 602 of M+1 microphones $M_0, M_1 \ldots M_M$. Each microphone is connected to one of M+1 corresponding filters $\mathbf{702}_0$, $\mathbf{702}_1 \ldots \mathbf{702}_M$. Each of the filters $\mathbf{702}_0$, $\mathbf{702}_1 \ldots \mathbf{702}_M$ includes a corresponding set of N+1 filter taps $\mathbf{704}_{00} \ldots \mathbf{704}_{0N} \ldots \mathbf{704}_{10} \ldots \mathbf{704}_{1N}$, $\mathbf{704}_{M0}, \ldots \mathbf{704}_{MN}$. Each filter tap $\mathbf{704}_{mi}$ includes a finite impulse response filter $b_{mi}$, where m=0 . . . M, i=0 . . . N. Except for the first filter tap $\mathbf{704}_{m0}$ in each filter $\mathbf{702}_m$, the filter taps also include delays indicated by $Z^{-1}$. Each filter $\mathbf{702}_m$ produces a corresponding output $y_m(t)$, which may be regarded as the components of the combined output y(t) of the filters. Fractional delays may be applied to each of the output signals $y_m(t)$ as described above.

For an array having M+1 microphones, the quantities $X_j$ are generally (M+1)-dimensional vectors. By way of example, for a 4-channel microphone array, there are 4 input signals: $x_0(t)$, $x_1(t)$, $x_2(t)$, and $x_3(t)$. The 4-channel inputs $x_m(t)$ are transformed to the frequency domain, and collected as a 1×4 vector "$X_{jk}$". The outer product of the vector $X_{jk}$ becomes a 4×4 matrix, the statistical average of this matrix becomes a "Covariance" matrix, which shows the correlation between every vector element.

By way of example, the four input signals $x_0(t)$, $x_1(t)$, $x_2(t)$ and $x_3(t)$ may be transformed into the frequency domain with J+1=10 blocks. Specifically:

For channel 0:

$$\begin{aligned} X_{00} &= FT([x_0(t-0), x_0(t-1), x_0(t-2), \ldots x_0(t-N-1+0)]) \\ X_{01} &= FT([x_0(t-1), x_0(t-2), x_0(t-3), \ldots x_0(t-N-1+1)]) \\ &\ldots \\ X_{09} &= FT([x_0(t-9), x_0(t-10)x_0(t-2), \ldots x_0(t-N-1+10)]) \end{aligned}$$

For channel 1:

$$\begin{aligned} X_{01} &= FT([x_1(t-0), x_1(t-1), x_1(t-2), \ldots x_1(t-N-1+0)]) \\ X_{11} &= FT([x_1(t-1), x_1(t-2), x_1(t-3), \ldots x_1(t-N-1+1)]) \\ &\ldots \\ X_{19} &= FT([x_1(t-9), x_1(t-10)x_1(t-2), \ldots x_1(t-N-1+10)]) \end{aligned}$$

For channel 2:

$$\begin{aligned} X_{20} &= FT([x_2(t-0), x_2(t-1), x_2(t-2), \ldots x_2(t-N-1+0)]) \\ X_{21} &= FT([x_2(t-1), x_2(t-2), x_2(t-3), \ldots x_2(t-N-1+1)]) \\ &\ldots \\ X_{29} &= FT([x_2(t-9), x_2(t-10)x_2(t-2), \ldots x_2(t-N-1+10)]) \end{aligned}$$

For channel 3:

$$\begin{aligned} X_{30} &= FT([x_3(t-0), x_3(t-1), x_3(t-2), \ldots x_3(t-N-1+0)]) \\ X_{31} &= FT([x_3(t-1), x_3(t-2), x_3(t-3), \ldots x_3(t-N-1+1)]) \\ &\ldots \\ X_{39} &= FT([x_3(t-9), x_3(t-10)x_3(t-2), \ldots x_3(t-N-1+10)]) \end{aligned}$$

By way of example 10 frames may be used to construct a fractional delay. For every frame j, where j=0:9, for every frequency bin <k>, where n=0:N−1, one can construct a 1×4 vector:

$$X_{jk}=[X_{0j}(k),X_{1j}(k),X_{2j}(k),X_{3j}(k)].$$

The vector $X_{jk}$ is fed into the SBSS algorithm to find the filter coefficients $b_{jn}$. The SBSS algorithm is an independent component analysis (ICA) based on $2^{nd}$-order independence, but the mixing matrix A (e.g., a 4×4 matrix for 4-mic-array) is replaced with 4×1 mixing weight vector $b_{jk}$, which is a diagonal of A1=A*$C^{-1}$ (i.e., $b_{jk}$=Diagonal (A1)), where $C^{-1}$ is the inverse eigenmatrix obtained from the calibration procedure described above. It is noted that the frequency domain calibration signal vectors $X'_{jk}$ may be generated as described in the preceding discussion.

The mixing matrix A may be approximated by a runtime covariance matrix Cov(j,k)=E(($X_{jk}$)$^T$*$X_{jk}$), where E refers to the operation of determining the expectation value and ($X_{jk}$)$^T$ is the transpose of the vector $X_{jk}$. The components of each vector $b_{jk}$ are the corresponding filter coefficients for each frame j and each frequency bin k, i.e., $$b_{jk}=[b_{0j}(k),b_{1j}(k),b_{2j}(k),b_{3j}(k)].$$

The independent frequency-domain components of the individual sound sources making up each vector $X_{jk}$ may be determined from:

S(j,k)$^T$=$b_{jk}^{-1}\cdot X_{jk}$=[($b_{0j}$(k))$^{-1}X_{0j}$(k), ($b_{1j}$(k))$^{-1}X_{1j}$(k), ($b_{2j}$(k))$^{-1}X_{2j}$(k), ($b_{3j}$(k))$^{-1}X_{3j}$(k)], where each S(j,k)$^T$ is a 1×4 vector containing the independent frequency-domain components of the original input signal x(t).

The ICA algorithm is based on "Covariance" independence, in the microphone array 302. It is assumed that there are always M+1 independent components (sound sources) and that their 2nd-order statistics are independent. In other words, the cross-correlations between the signals $x_0$(t), $x_1$(t), $x_2$(t) and $x_3$(t) should be zero. As a result, the non-diagonal elements in the covariance matrix Cov(j,k) should be zero as well.

By contrast, if one considers the problem inversely, if it is known that there are M+1 signal sources one can also determine their cross-correlation "covariance matrix", by finding a matrix A that can de-correlate the cross-correlation, i.e., the matrix A can make the covariance matrix Cov(j,k) diagonal (all non-diagonal elements equal to zero), then A is the "unmixing matrix" that holds the recipe to separate out the 4 sources.

Because solving for "unmixing matrix A" is an "inverse problem", it is actually very complicated, and there is normally no deterministic mathematical solution for A. Instead an initial guess of A is made, then for each signal vector $x_m$(t) (m=0, 1 . . . M), A is adaptively updated in small amounts (called adaptation step size). In the case of a four-microphone array, the adaptation of A normally involves determining the inverse of a 4×4 matrix in the original ICA algorithm. Hopefully, adapted A will converge toward the true A. According to embodiments of the present invention, through the use of semi-blind-source-separation, the unmixing matrix A becomes a vector A1, since it is has already been decorrelated by the inverse eigenmatrix $C^{-1}$ which is the result of the prior calibration described above.

Multiplying the run-time covariance matrix Cov(j,k) with the pre-calibrated inverse eigenmatrix $C^{-1}$ essentially picks up the diagonal elements of A and makes them into a vector A1. Each element of A1 is the strongest cross-correlation, the inverse of A will essentially remove this correlation. Thus, embodiments of the present invention simplify the conventional ICA adaptation procedure, in each update, the inverse of A becomes a vector inverse $b^{-1}$. It is noted that computing a matrix inverse has N-cubic complexity, while computing a vector inverse has N-linear complexity. Specifically, for the case of N=4, the matrix inverse computation requires 64 times more computation that the vector inverse computation.

Also, by cutting a (M+1)×(M+1) matrix to a (M+1)×1 vector, the adaptation becomes much more robust, because it requires much fewer parameters and has considerably less problems with numeric stability, referred to mathematically as "degree of freedom". Since SBSS reduces the number of degrees of freedom by (M+1) times, the adaptation convergence becomes faster. This is highly desirable since, in real world acoustic environment, sound sources keep changing, i.e., the unmixing matrix A changes very fast. The adaptation of A has to be fast enough to track this change and converge to its true value in real-time. If instead of SBSS one uses a conventional ICA-based BSS algorithm, it is almost impossible to build a real-time application with an array of more than two microphones. Although some simple microphone arrays use BSS, most, if not all, use only two microphones.

The frequency domain output Y(k) may be expressed as an N+1 dimensional vector Y=[$Y_0$, $Y_1$, . . . , $Y_N$], where each component $Y_i$ may be calculated by:

$$Y_i = [\, X_{i0} \quad X_{i1} \quad \cdots \quad X_{iJ} \,] \cdot \begin{bmatrix} b_{i0} \\ b_{i1} \\ \vdots \\ b_{iJ} \end{bmatrix}$$

Each component $Y_i$ may be normalized to achieve a unit response for the filters.

$$Y'_i = \frac{Y_i}{\sqrt{\sum_{j=0}^{J} (b_{ij})^2}}$$

Although in embodiments of the invention N and J may take on any values, it has been shown in practice that N=511 and J=9 provides a desirable level of resolution, e.g., about 1/10 of a wavelength for an array containing 16 kHz microphones.

Figure 13:
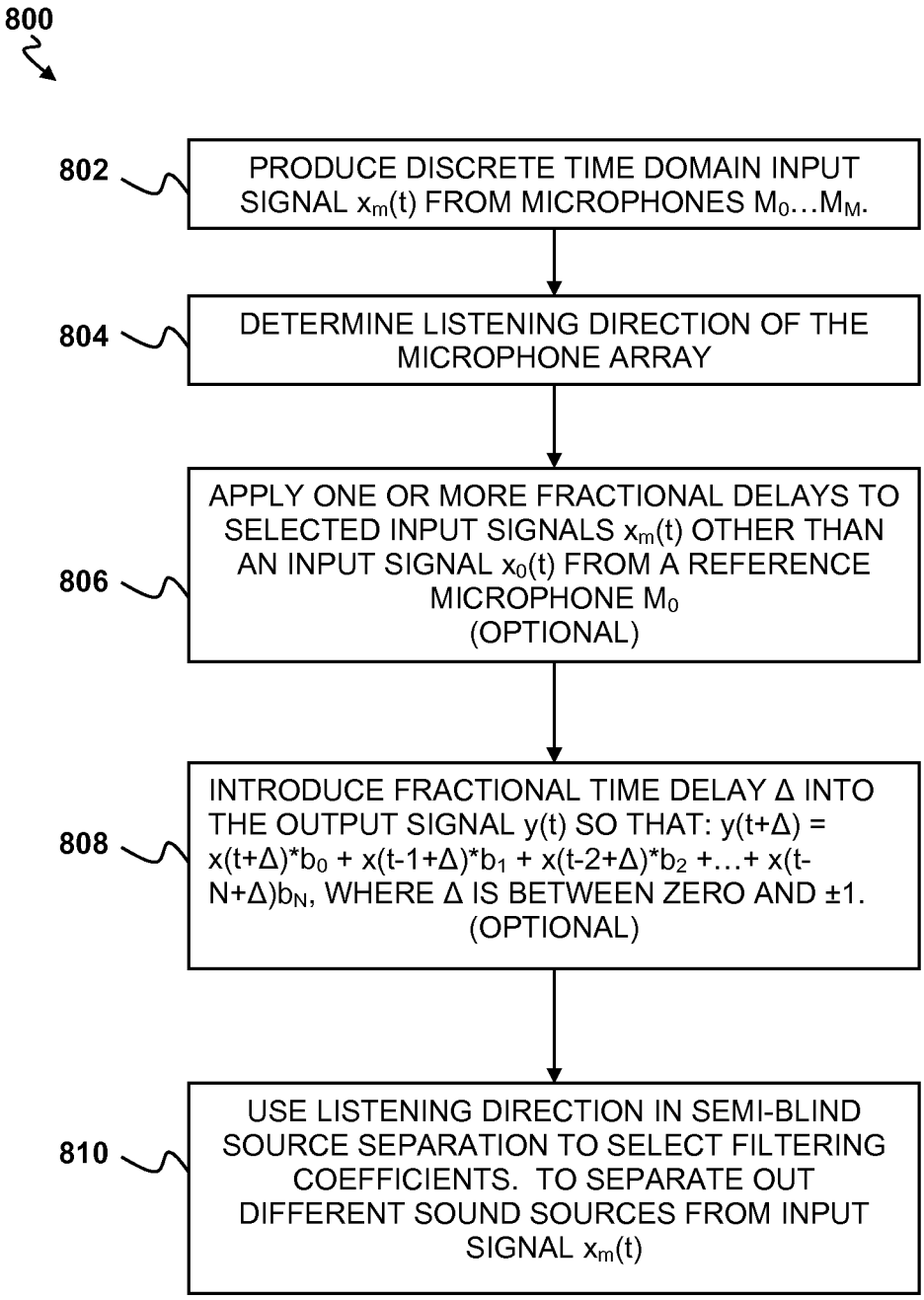
FIG. 13 is a flow diagram for processing a signal from an array of two or more microphones according to embodiments of the present invention.

FIG. 13 depicts a flow diagram 800 illustrating one embodiment of the invention. In Block 802, a discrete time domain input signal $x_m$(t) may be produced from microphones $M_0$. . . $M_m$. In Block 804, a listening direction may be determined for the microphone array, e.g., by computing an inverse eigenmatrix $C^{-1}$ for a calibration covariance matrix as described above. As discussed above, the listening direction may be determined during calibration of the microphone array during design or manufacture or may be re-calibrated at runtime. Specifically, a signal from a source located in a preferred listening direction with respect to the microphone array may be recorded for a predetermined period of time. Analysis frames of the signal may be formed at predetermined intervals and the analysis frames may be transformed into the frequency domain. A calibration covariance matrix may be estimated from a vector of the analysis frames that have been transformed into the frequency domain. An eigenmatrix C of the calibration covariance matrix may be computed and an inverse of the eigenmatrix provides the listening direction.

In Block 806, one or more fractional delays may be applied to selected input signals $x_m$(t) other than an input signal $x_0$(t) from a reference microphone $M_0$. Each fractional delay is selected to optimize a signal to noise ratio of a discrete time domain output signal y(t) from the microphone array. The fractional delays are selected to such that a signal from the reference microphone $M_0$ is first in time relative to signals from the other microphone(s) of the array.

In Block 808 a fractional time delay A is introduced into the output signal Y(t) so that: $y(t+\Delta)=x(t+\Delta)*b_0+x(t-1+\Delta)*b_1+x(t-2+\Delta)*b_2+\ldots+x(t-N+\Delta)b_N$, where Δ is between zero and ±1. The fractional delay may be introduced as described above with respect to FIGS. 4A and 4B. Specifically, each time domain input signal $x_m(t)$ may be delayed by j+1 frames and the resulting delayed input signals may be transformed to a frequency domain to produce a frequency domain input signal vector $X_{jk}$ for each of k=0:N frequency bins.

In Block 810, the listening direction (e.g., the inverse eigenmatrix $C^{-1}$) determined in the Block 804 is used in a semi-blind source separation to select the finite impulse response filter coefficients $b_0, b_1 \ldots, b_N$ to separate out different sound sources from input signal $x_m(t)$. Specifically, filter coefficients for each microphone m, each frame j and each frequency bin k, $[b_{0j}(k), b_{1j}(k), \ldots b_{mj}(k)]$ may be computed that best separate out two or more sources of sound from the input signals $x_m(t)$. Specifically, a runtime covariance matrix may be generated from each frequency domain input signal vector $X_{jk}$. The runtime covariance matrix may be multiplied by the inverse $C^{-1}$ of the eigenmatrix C to produce a mixing matrix A and a mixing vector may be obtained from a diagonal of the mixing matrix A. The values of filter coefficients may be determined from one or more components of the mixing vector. Further, the filter coefficients may represent a location relative to the microphone array in one embodiment. In another embodiment, the filter coefficients may represent an area relative to the microphone array.

Figure 14:
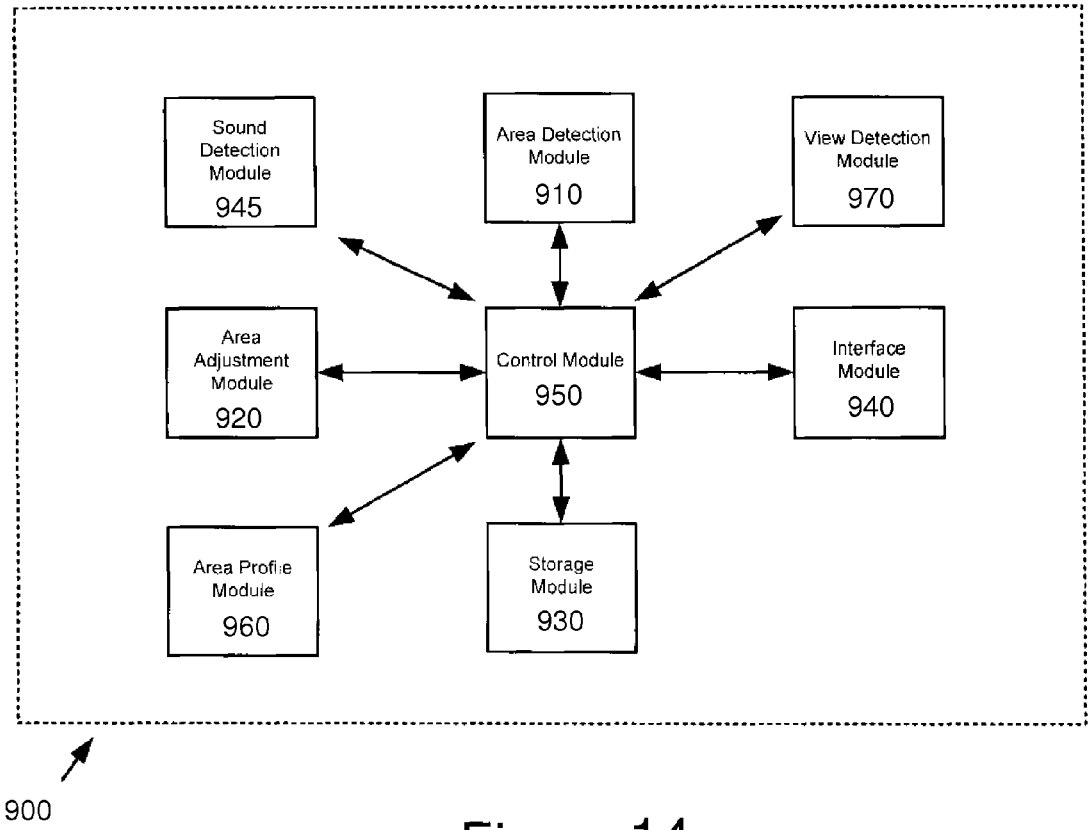
FIG. 14 is a simplified block diagram illustrating a system, consistent with embodiments of methods and apparatus for adjusting a listening area for capturing sounds or capturing an audio signal based on a visual image or a location of the signal.

FIG. 14 illustrates one embodiment of a system 900 for capturing an audio signal based on a location of the signal. The system 900 includes an area detection module 910, an area adjustment module 920, a storage module 930, an interface module 940, a sound detection module 945, a control module 950, an area profile module 960, and a view detection module 970. The control module 950 may communicate with the area detection module 910, the area adjustment module 920, the storage module 930, the interface module 940, the sound detection module 945, the area profile module 960, and the view detection module 970.

The control module 950 may coordinate tasks, requests, and communications between the area detection module 910, the area adjustment module 920, the storage module 930, the interface module 940, the sound detection module 945, the area profile module 960, and the view detection module 970.

The area detection module 910 may detect the listening zone that is being monitored for sounds. In one embodiment, a microphone array detects the sounds through a particular electronic device 410. For example, a particular listening zone that encompasses a predetermined area can be monitored for sounds originating from the particular area. In one embodiment, the listening zone is defined by finite impulse response filter coefficients $b_0, b_1 \ldots, b_N$, as described above.

In one embodiment, the area adjustment module 920 adjusts the area defined by the listening zone that is being monitored for sounds. For example, the area adjustment module 920 is configured to change the predetermined area that comprises the specific listening zone as defined by the area detection module 910. In one embodiment, the predetermined area is enlarged. In another embodiment, the predetermined area is reduced. In one embodiment, the finite impulse response filter coefficients $b_0, b_1 \ldots, b_N$ are modified to reflect the change in area of the listening zone.

The storage module 930 may store a plurality of profiles wherein each profile is associated with a different specification for detecting sounds. In one embodiment, the profile stores various information, e.g., as shown in an exemplary profile in FIG. 15. In one embodiment, the storage module 930 is located within the server device 430. In another embodiment, portions of the storage module 930 are located within the electronic device 410. In another embodiment, the storage module 930 also stores a representation of the sound detected.

In one embodiment, the interface module 940 detects the electronic device 410 as the electronic device 410 is connected to the network 420.

In another embodiment, the interface module 940 detects input from the interface device 415 such as a keyboard, a mouse, a microphone, a still camera, a video camera, and the like.

In yet another embodiment, the interface module 940 provides output to the interface device 415 such as a display, speakers, external storage devices, an external network, and the like.

In one embodiment, the sound detection module 945 is configured to detect sound that originates within the listening zone. In one embodiment, the listening zone is determined by the area detection module 910. In another embodiment, the listening zone is determined by the area adjustment module 920.

In one embodiment, the sound detection module 945 captures the sound originating from the listening zone. In another embodiment, the sound detection module 945 detects a location of the sound within the listening zone. The location of the sound may be expressed in terms of finite impulse response filter coefficients $b_0, b_1 \ldots, b_N$.

In one embodiment, the area profile module 960 processes profile information related to the specific listening zones for sound detection. For example, the profile information may include parameters that delineate the specific listening zones that are being detected for sound. These parameters may include finite impulse response filter coefficients $b_0, b_1 \ldots, b_N$.

Figure 15:
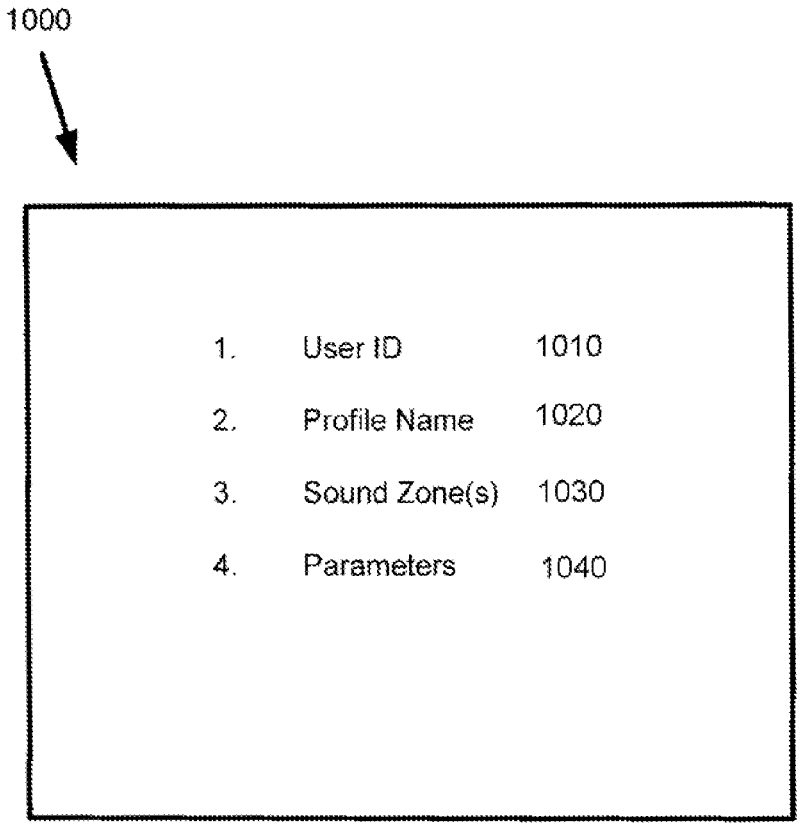
FIG. 15 illustrates an exemplary record consistent with embodiments of methods and apparatus for adjusting a listening area for capturing sounds or capturing an audio signal based on a visual image or a location of the signal.

In one embodiment, exemplary profile information is shown within a record illustrated in FIG. 15. In one embodiment, the area profile module 960 utilizes the profile information. In another embodiment, the area profile module 960 creates additional records having additional profile information.

In one embodiment, the view detection module 970 detects the field of view of a image capture unit such as a still camera or video camera. For example, the view detection module 970 is configured to detect the viewing angle of the image capture unit as seen through the image capture unit. In one instance, the view detection module 970 detects the magnification level of the image capture unit. For example, the magnification level may be included within the metadata describing the particular image frame. In another embodiment, the view detection module 970 periodically detect the field of view such that as the image capture unit zooms in or zooms out, the current field of view is detected by the view detection module 970.

In another embodiment, the view detection module 970 detects the horizontal and vertical rotational positions of the image capture unit relative to the microphone array.

The system 900 in FIG. 14 is shown for the purpose of example and is merely one embodiment of the methods and apparatuses for capturing an audio signal based on a location of the signal. Additional modules may be added to the system 900 without departing from the scope of the methods and apparatuses for capturing an audio signal based on a location of the signal. Similarly, modules may be combined or deleted without departing from the scope of the methods and apparatuses for adjusting a listening area for capturing sounds or for capturing an audio signal based on a visual image or a location of a source of a sound signal.

FIG. 15 illustrates a simplified record 1000 that corresponds to a profile that describes the listening area. In one embodiment, the record 1000 is stored within the storage module 930 and utilized within the system 900. In one embodiment, the record 1000 includes a user identification field 1010, a profile name field 1020, a listening zone field 1030, and a parameters field 1040.

In one embodiment, the user identification field 1010 provides a customizable label for a particular user. For example, the user identification field 1010 may be labeled with arbitrary names such as "Bob", "Emily's Profile", and the like.

In one embodiment, the profile name field 1020 uniquely identifies each profile for detecting sounds. For example, in one embodiment, the profile name field 1020 describes the location and/or participants. For example, the profile name field 1020 may be labeled with a descriptive name such as "The XYZ Lecture Hall", "The Sony PlayStation® ABC Game", and the like. Further, the profile name field 1020 may be further labeled "The XYZ Lecture Hall with half capacity", The Sony PlayStation® ABC Game with 2 other Participants", and the like.

In one embodiment, the listening zone field 1030 identifies the different areas that are to be monitored for sounds. For example, the entire XYZ Lecture Hall may be monitored for sound. However, in another embodiment, selected portions of the XYZ Lecture Hall are monitored for sound such as the front section, the back section, the center section, the left section, and/or the right section.

In another example, the entire area surrounding the Sony PlayStation® may be monitored for sound. However, in another embodiment, selected areas surrounding the Sony PlayStation® are monitored for sound such as in front of the Sony PlayStation®, within a predetermined distance from the Sony PlayStation®, and the like.

In one embodiment, the listening zone field 1030 includes a single area for monitoring sounds. In another embodiment, the listening zone field 1030 includes multiple areas for monitoring sounds.

In one embodiment, the parameter field 1040 describes the parameters that are utilized in configuring the sound detection device to properly detect sounds within the listening zone as described within the listening zone field 1030.

In one embodiment, the parameter field 1040 may include finite impulse response filter coefficients $b_0, b_1 \ldots, b_N$.

The flow diagrams as depicted in FIGS. 16, 17, 18, and 19 illustrate examples of embodiments of methods and apparatus for adjusting a listening area for capturing sounds or for capturing an audio signal based on a visual image or a location of a source of a sound signal. The blocks within the flow diagrams can be performed in a different sequence without departing from the spirit of the methods and apparatus for capturing an audio signal based on a location of the signal. Further, blocks can be deleted, added, or combined without departing from the spirit of such methods and apparatus.

Figure 16:
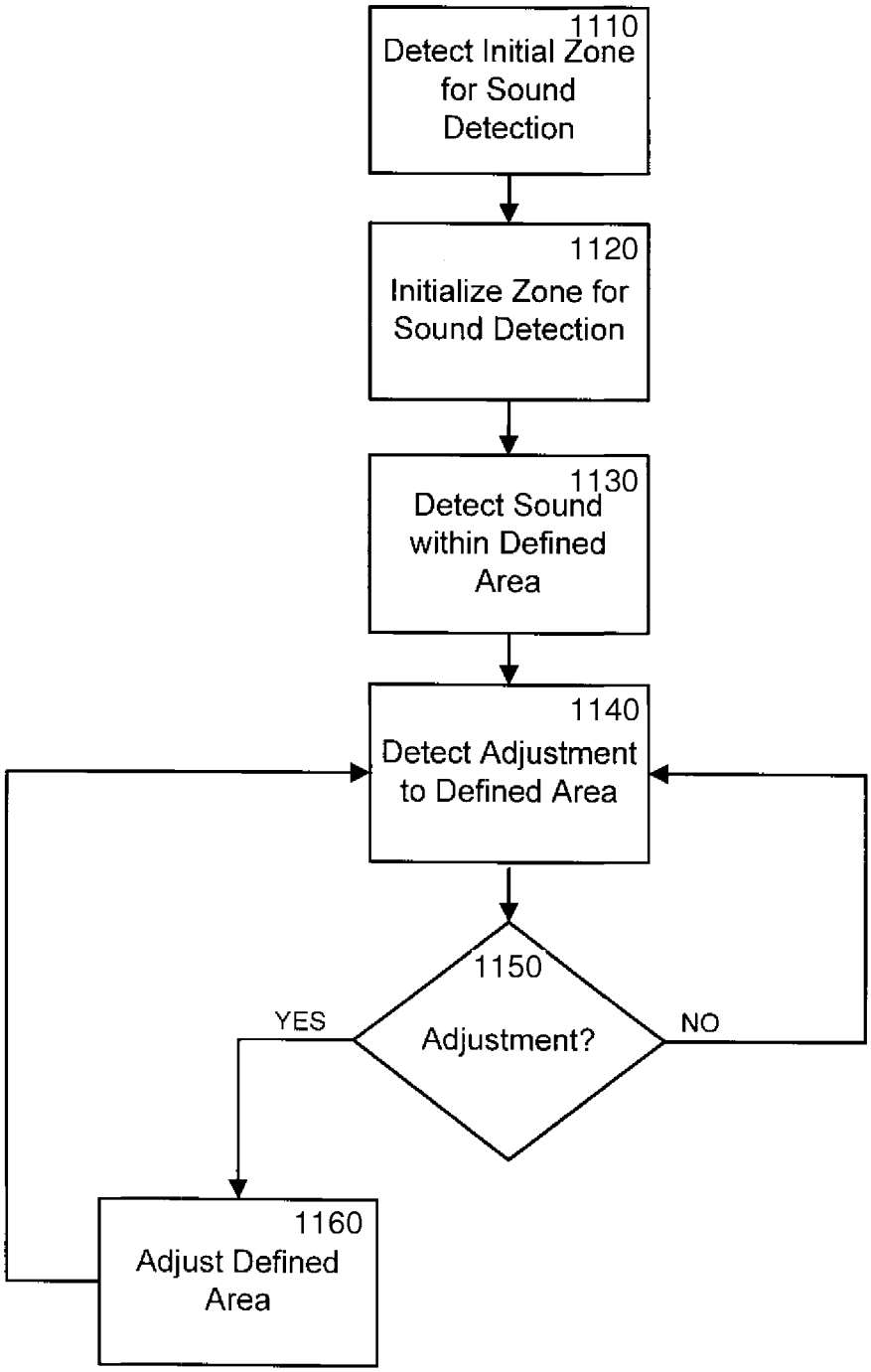
FIG. 16 is a flow diagram consistent with embodiments of methods and apparatus for adjusting a listening area for capturing sounds or capturing an audio signal based on a visual image or a location of the signal.
Figure 17:
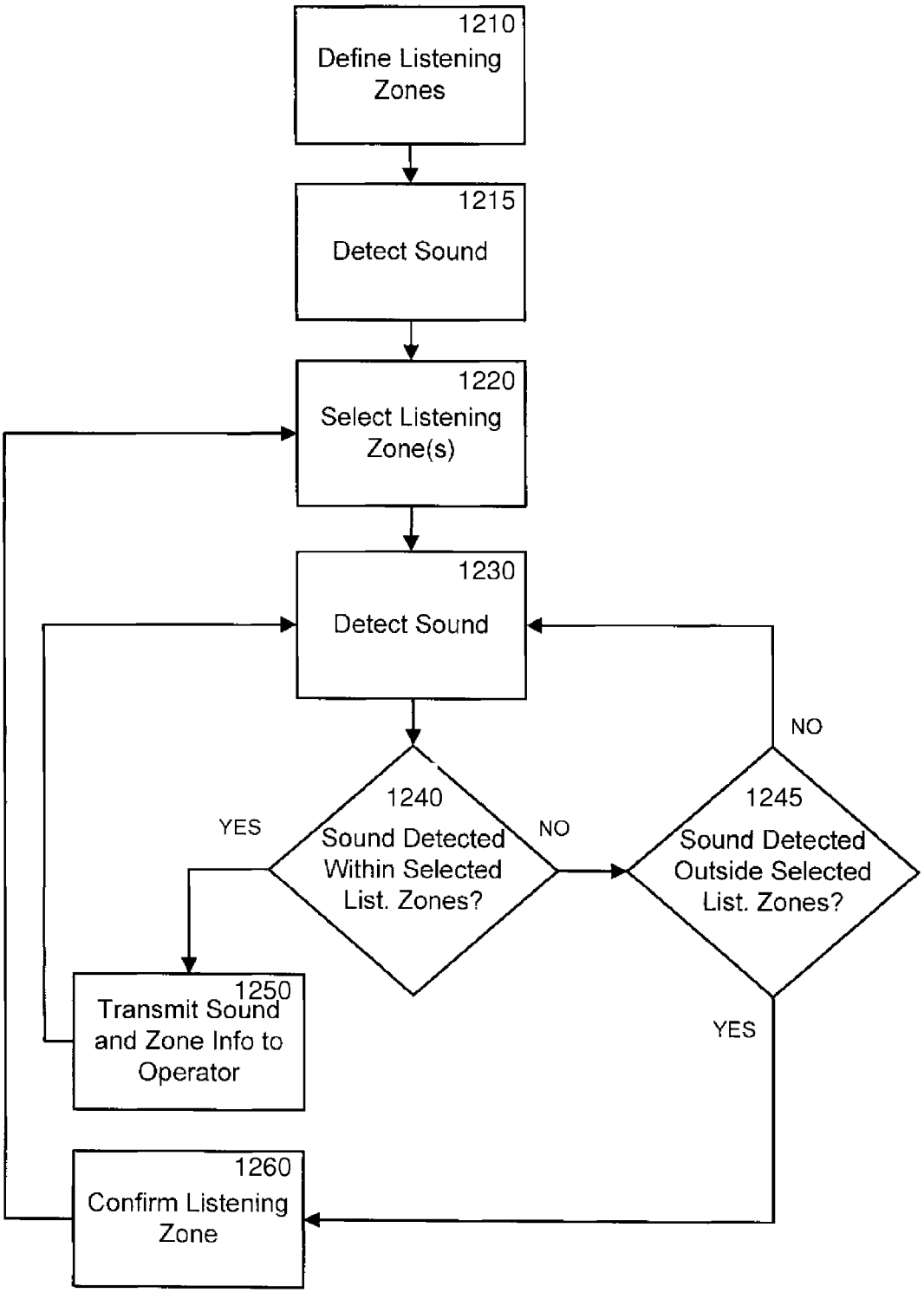
FIG. 17 is a flow diagram consistent with embodiments of methods and apparatus for adjusting a listening area for capturing sounds or capturing an audio signal based on a visual image or a location of the signal.

The flow diagram in FIG. 16 illustrates adjusting a method for listening area for capturing sounds adjusting a listening area for capturing sounds. Such a method may be used in conjunction with capturing an audio signal based on a location of a source of a sound signal according to one embodiment of the invention.

In Block 1110, an initial listening zone is identified for detecting sound. For example, the initial listening zone may be identified within a profile associated with the record 1000. Further, the area profile module 960 may provide parameters associated with the initial listening zone.

In another example, the initial listening zone is pre-programmed into the particular electronic device 410. In yet another embodiment, the particular location such as a room, lecture hall, or a car are determined and defined as the initial listening zone.

In another embodiment, multiple listening zones are defined that collectively comprise the audibly detectable areas surrounding the microphone array. Each of the listening zones is represented by finite impulse response filter coefficients $b_0, b_1 \ldots, b_N$. The initial listening zone is selected from the multiple listening zones in one embodiment.

In Block 1120, the initial listening zone is initiated for sound detection. In one embodiment, a microphone array begins detecting sounds. In one instance, only the sounds within the initial listening zone are recognized by the device 410. In one example, the microphone array may initially detect all sounds. However, sounds that originate or emanate from outside of the initial listening zone are not recognized by the device 410. In one embodiment, the area detection module 1110 detects the sound originating from within the initial listening zone.

In Block 1130, sound detected within the defined area is captured. In one embodiment, a microphone detects the sound. In one embodiment, the captured sound is stored within the storage module 930. In another embodiment, the sound detection module 945 detects the sound originating from the defined area. In one embodiment, the defined area includes the initial listening zone as determined by the Block 1110. In another embodiment, the defined area includes the area corresponding to the adjusted defined area of the Block 1160.

In Block 1140, adjustments to the defined area are detected. In one embodiment, the defined area may be enlarged. For example, after the initial listening zone is established, the defined area may be enlarged to encompass a larger area to monitor sounds.

In another embodiment, the defined area may be reduced. For example, after the initial listening zone is established, the defined area may be reduced to focus on a smaller area to monitor sounds.

In another embodiment, the size of the defined area may remain constant, but the defined area is rotated or shifted to a different location. For example, the defined area may be pivoted relative to the microphone array.

Further, adjustments to the defined area may also be made after the first adjustment to the initial listening zone is performed.

In one embodiment, the signals indicating an adjustment to the defined area may be initiated based on the sound detected by the sound detection module 945, the field of view detected by the view detection module 970, and/or input received through the interface module 940 indicating a change an adjustment in the defined area.

In Block 1150, if an adjustment to the defined area is detected, then the defined area is adjusted in Block 1160. In one embodiment, the finite impulse response filter coefficients $b_0, b_1 \ldots, b_N$ are modified to reflect an adjusted defined area in the Block 1160. In another embodiment, different filter coefficients are utilized to reflect the addition or subtraction of listening zone(s).

In Block 1150, if an adjustment to the defined area is not detected, then sound within the defined area is detected in the Block 830.

The flow diagram in FIG. 12 illustrates creating a listening zone, selecting a listening zone, and monitoring sounds according to one embodiment of the invention.

In Block 1210, the listening zones are defined. In one embodiment, the field covered by the microphone array includes multiple listening zones. In one embodiment, the listening zones are defined by segments relative to the microphone array. For example, the listening zones may be defined as four different quadrants such as Northeast, Northwest, Southeast, and Southwest, where each quadrant is relative to the location of the microphone array located at the center. In another example, the listening area may be divided into any number of listening zones. For illustrative purposes, the listening area may be defined by listening zones encompassing X number of degrees relative to the microphone array. If the entire listening area is a full coverage of 360 degrees around the microphone array, and there are 10 distinct listening zones, then each listening zone or segment would encompass 36 degrees.

In one embodiment, the entire area where sound can be detected by the microphone array is covered by one of the listening zones. In one embodiment, each of the listening zones corresponds with a set of finite impulse response filter coefficients $b_0, b_1 \ldots, b_N$.

In one embodiment, the specific listening zones may be saved within a profile stored within the record 1000. Further, the finite impulse response filter coefficients $b_0, b_1 \ldots, b_N$ may also be saved within the record 1000.

In Block 1215, sound is detected by the microphone array for the purpose of selecting a listening zone. The location of the detected sound may also be detected. In one embodiment, the location of the detected sound is identified through a set of finite impulse response filter coefficients $b_0, b_1 \ldots, b_N$.

In Block 1220, at least one listening zone is selected. In one instance, the selection of particular listening zone(s) is utilized to prevent extraneous noise from interfering with sound intended to be detected by the microphone array. By limiting the listening zone to a smaller area, sound originating from areas that are not being monitored can be minimized.

In one embodiment, the listening zone is automatically selected. For example, a particular listening zone can be automatically selected based on the sound detected within the Block 1215. The particular listening zone that is selected can correlate with the location of the sound detected within the Block 1215. Further, additional listening zones can be selected that are in adjacent or proximal to listening zones relative to the detected sound. In another example, the particular listening zone is selected based on a profile within the record 1000.

In another embodiment, the listening zone is manually selected by an operator. For example, the detected sound may be graphically displayed to the operator such that the operator can visually detect a graphical representation that shows which listening zone corresponds with the location of the detected sound. Further, selection of the particular listening zone(s) may be performed based on the location of the detected sound. In another example, the listening zone may be selected solely based on the anticipation of sound.

In Block 1230, sound is detected by the microphone array. In one embodiment, any sound is captured by the microphone array regardless of the selected listening zone. In another embodiment, the information representing the sound detected may be analyzed for intensity prior to further analysis. In one instance, if the intensity of the detected sound does not meet a predetermined threshold, then the sound is characterized as noise and is discarded.

In Block 1240, if the sound detected within the Block 1230 is found within one of the selected listening zones from the Block 1220, then information representing the sound is transmitted to the operator in Block 1250. In one embodiment, the information representing the sound may be played, recorded, and/or further processed.

In the Block 1240, if the sound detected within the Block 1230 is not found within one of the selected listening zones then further analysis may then be performed per Block 1245.

If the sound is not detected outside of the selected listening zones within the Block 1245, then detection of sound may continue in the Block 1230.

However, if the sound is detected outside of the selected listening zones within the Block 1245, then a confirmation is requested by the operator in Block 1260. In one embodiment, the operator may be informed of the sound detected outside of the selected listening zones and is presented an additional listening zone that includes the region that the sound originates from within. In this example, the operator is given the opportunity to include this additional listening zone as one of the selected listening zones. In another embodiment, a preference of including or not including the additional listening zone can be made ahead of time such that additional selection by the operator is not requested. In this example, the inclusion or exclusion of the additional listening zone is automatically performed by the system 900.

After Block 1260, the selected listening zones may be updated in the Block 1220 based on the selection in the Block 1260. For example, if the additional listening zone is selected, then the additional listening zone is included as one of the selected listening zones.

Figure 18:
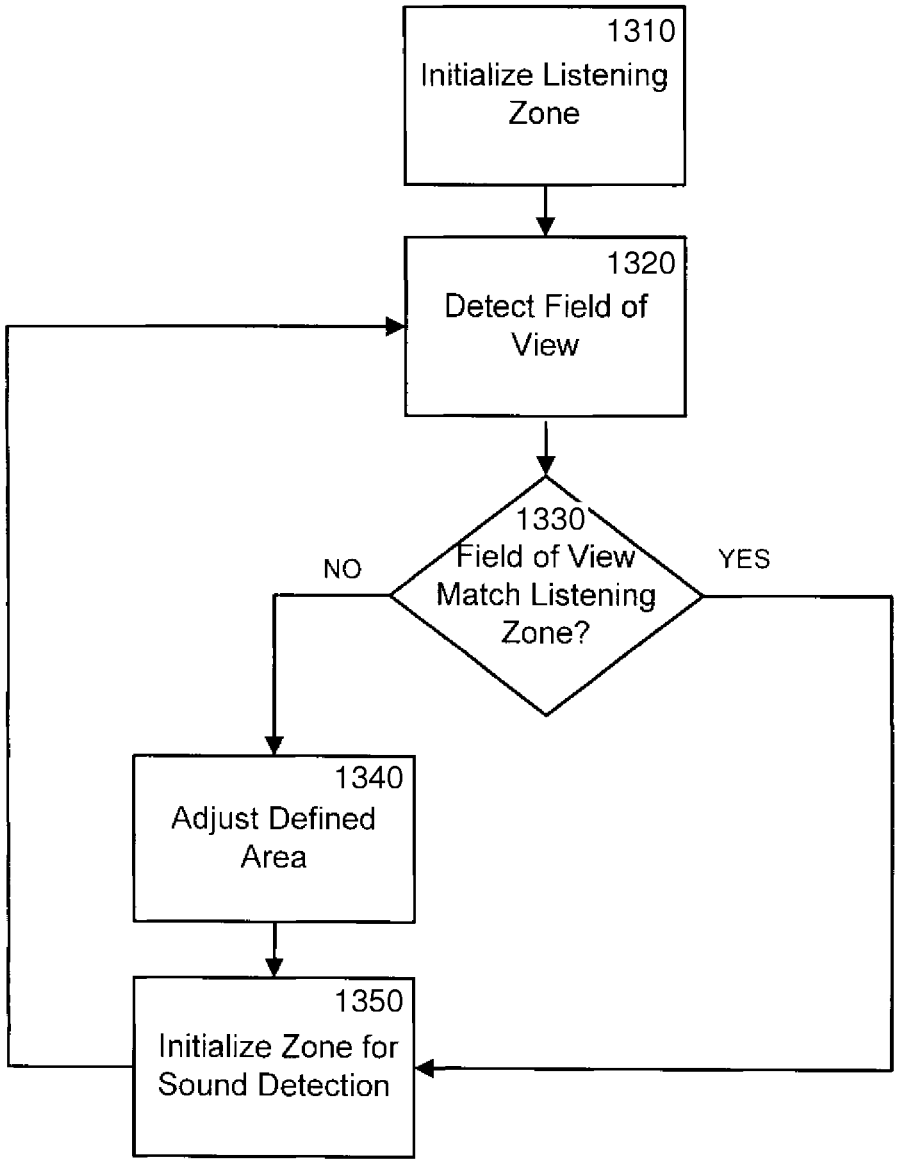
FIG. 18 is a flow diagram consistent with embodiments of methods and apparatus for adjusting a listening area for capturing sounds or capturing an audio signal based on a visual image or a location of the signal.

The flow diagram in FIG. 18 illustrates adjusting a listening zone based on the field of view according to one embodiment of the invention.

In Block 1310, a listening zone is selected and initialized. In one embodiment, a single listening zone is selected from a plurality of listening zones. In another embodiment, multiple listening zones are selected. In one embodiment, the microphone array monitors the listening zone. Further, a listening zone can be represented by finite impulse response filter coefficients $b_0, b_1 \ldots, b_N$ or a predefined profile illustrated in the record 1000.

In Block 1320, the field of view is detected. In one embodiment, the field of view represents the image viewed through a image capture unit such as a still camera, a video camera, and the like. In one embodiment, the view detection module 970 is utilized to detect the field of view. The current field of view can change as the effective focal length (magnification) of the image capture unit is varied. Further, the current view of field can also change if the image capture unit rotates relative to the microphone array.

In Block 1330, the current field of view is compared with the current listening zone(s). In one embodiment, the magnification of the image capture unit and the rotational relationship between the image capture unit and the microphone array are utilized to determine the field of view. This field of view of the image capture unit may be compared with the current listening zone(s) for the microphone array.

If there is a match between the current field of view of the image capture unit and the current listening zone(s) of the microphone array, then sound may be detected within the current listening zone(s) in Block 1350.

If there is not a match between the current field of view of the image capture unit and the current listening zone(s) of the microphone array, then the current listening zone may be adjusted in Block 1340. If the rotational position of the current field of view and the current listening zone of the microphone array are not aligned, then a different listening zone may be selected that encompasses the rotational position of the current field of view.

Further, in one embodiment, if the current field of view of the image capture unit is narrower than the current listening zones, then one of the current listening zones may be deactivated such that the deactivated listening zone is no longer able to detect sounds from this deactivated listening zone. In another embodiment, if the current field of view of the image capture unit is narrower than the single, current listening zone, then the current listening zone may be modified through manipulating the finite impulse response filter coefficients $b_0$, $b_1 \ldots, b_N$ to reduce the area that sound is detected by the current listening zone.

Further, in one embodiment, if the current field of view of the image capture unit is broader than the current listening zone(s), then an additional listening zone that is adjacent to the current listening zone(s) may be added such that the additional listening zone increases the area that sound is detected. In another embodiment, if the current field of view of the image capture unit is broader than the single, current listening zone, then the current listening zone may be modified through manipulating the finite impulse response filter coefficients $b_0$, $b_1 \ldots, b_N$ to increase the area that sound is detected by the current listening zone.

After adjustment to the listening zone in the Block 1340, sound is detected within the current listening zone(s) in Block 1350.

Figure 19:
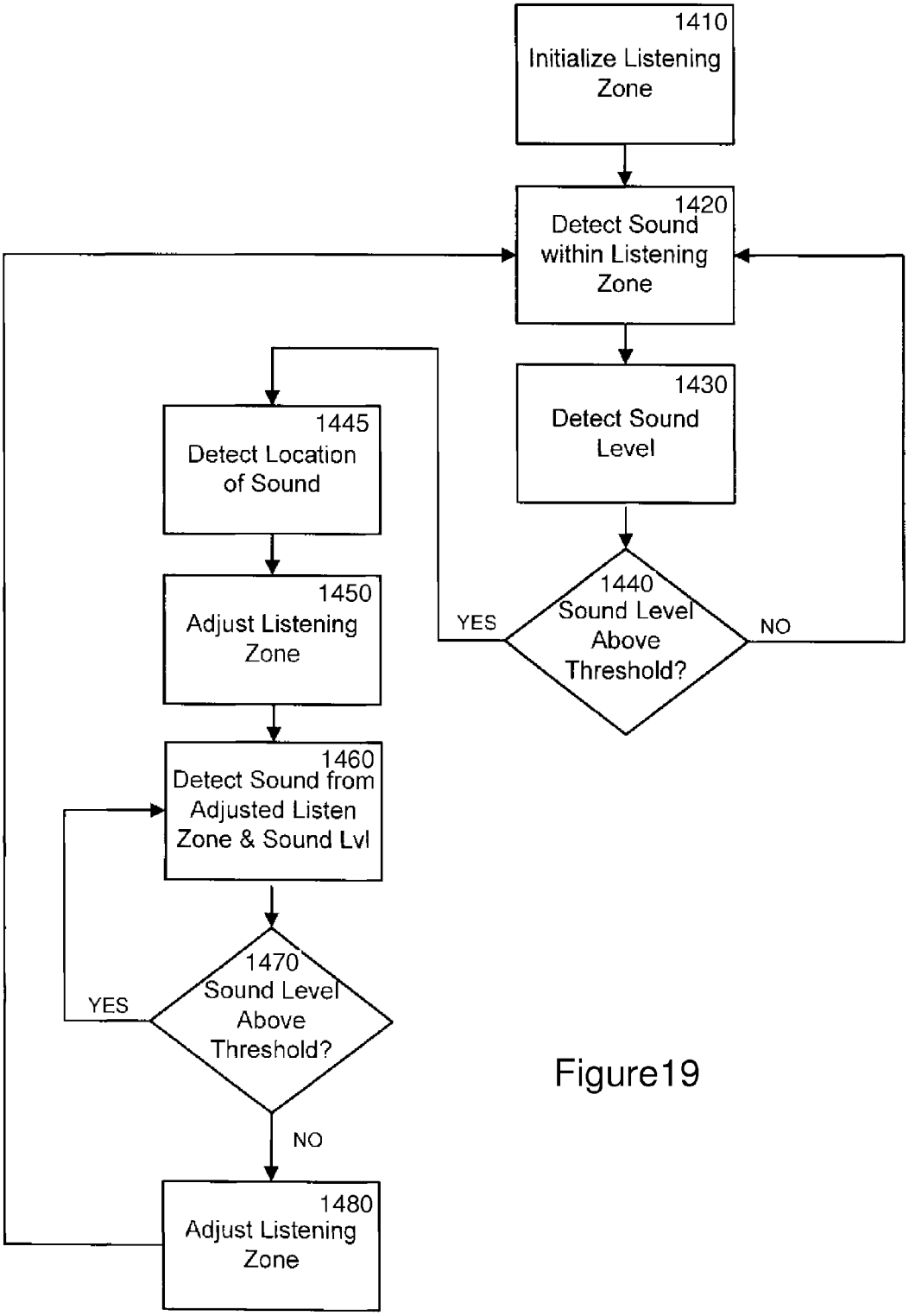
FIG. 19 is a flow diagram consistent with embodiments of methods and apparatus for adjusting a listening area for capturing sounds or capturing an audio signal based on a visual image or a location of the signal.

The flow diagram in FIG. 19 illustrates adjusting a listening zone based on the field of view according to one embodiment of the invention.

In Block 1410, a listening zone may be selected and initialized. In one embodiment, a single listening zone is selected from a plurality of listening zones. In another embodiment, multiple listening zones are selected. In one embodiment, the microphone array monitors the listening zone. Further, a listening zone can be represented by finite impulse response filter coefficients $b_0$, $b_1 \ldots, b_N$ or a predefined profile illustrated in the record 1000.

In Block 1420, sound is detected within the current listening zone(s). In one embodiment, the sound is detected by the microphone array through the sound detection module 945.

In Block 1430, a sound level is determined from the sound detected within the Block 1420.

In Block 1440, the sound level determined from the Block 1430 is compared with a sound threshold level. In one embodiment, the sound threshold level is chosen based on sound models that exclude extraneous, unintended noise. In another embodiment, the sound threshold is dynamically chosen based on the current environment of the microphone array. For example, in a very quiet environment, the sound threshold may be set lower to capture softer sounds. In contrast, in a loud environment, the sound threshold may be set higher to exclude background noises.

If the sound level from the Block 1430 is below the sound threshold level as described within the Block 1140, then sound continues to be detected within the Block 1420.

If the sound level from the Block 1430 is above the sound threshold level as described within the Block 1440, then the location of the detected sound is determined in Block 1445. In one embodiment, the location of the detected sound is expressed in the form of finite impulse response filter coefficients $b_0$, $b_1 \ldots, b_N$.

In Block 1450, the listening zone that is initially selected in the Block 1410 is adjusted. In one embodiment, the area covered by the initial listening zone may be decreased. For example, the location of the detected sound identified from the Block 1445 is utilized to focus the initial listening zone such that the initial listening zone is adjusted to include the area adjacent to the location of this sound.

In one embodiment, there may be multiple listening zones that comprise the initial listening zone. In this example with multiple listening zones, the listening zone that includes the location of the sound is retained as the adjusted listening zone. In a similar example, the listening zone that that includes the location of the sound and an adjacent listening zone are retained as the adjusted listening zone.

In another embodiment, there may be a single listening zone as the initial listening zone. In this example, the adjusted listening zone can be configured as a smaller area around the location of the sound. In one embodiment, the smaller area around the location of the sound can be represented by finite impulse response filter coefficients $b_0$, $b_1 \ldots, b_N$ that identify the area immediately around the location of the sound.

In Block 1460, the sound is detected within the adjusted listening zone(s). In one embodiment, the sound is detected by the microphone array through the sound detection module 945. Further, the sound level is also detected from the adjusted listening zone(s). In addition, the sound detected within the adjusted listening zone(s) may be recorded, streamed, transmitted, and/or further processed by the system 900.

In Block 1470, the sound level determined from the Block 1460 is compared with a sound threshold level. In one embodiment, the sound threshold level is chosen to determine whether the sound originally detected within the Block 1420 is continuing.

If the sound level from the Block 1460 is above the sound threshold level as described within the Block 1470, then sound continues to be detected within the Block 1460.

If the sound level from the Block 1460 is below the sound threshold level as described within the Block 1470, then the adjusted listening zone(s) is further adjusted in Block 1480. In one embodiment, the adjusted listening zone reverts back to the initial listening zone shown in the Block 1410.

Figure 20:
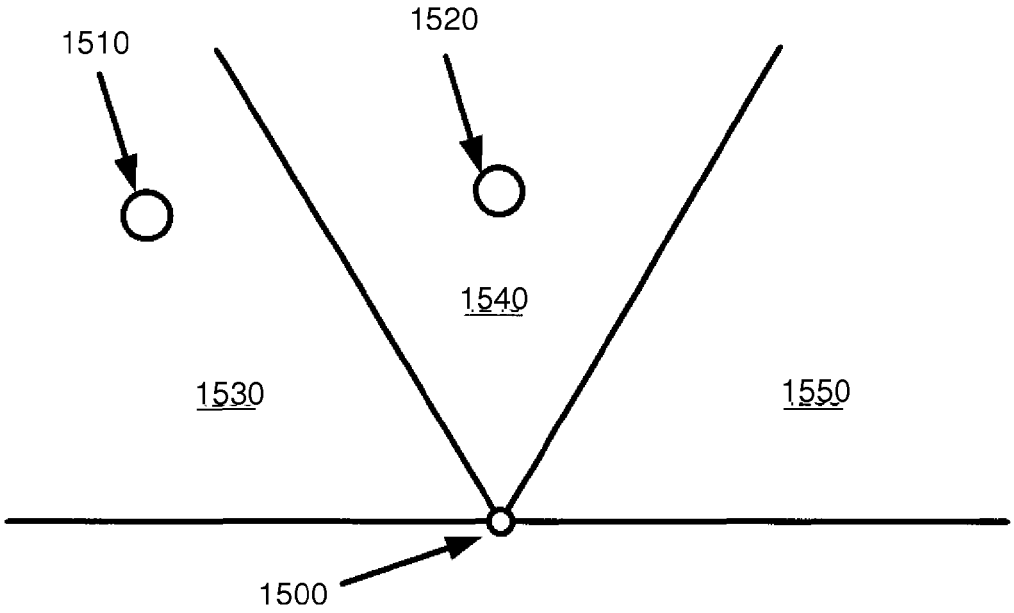
FIG. 20 is a diagram illustrating monitoring a listening zone based on a field of view consistent with embodiments of methods and apparatus for adjusting a listening area for capturing sounds or capturing an audio signal based on a visual image or a location of the signal.

The diagram in FIG. 20 illustrates a use of the field of view application as described within FIG. 18. In FIG. 20 an electronic device 1500 includes a microphone array and an image capture unit, e.g., as describe above. Objects 1510, 1520 can be regarded as sources of sound. In one embodiment, the device 1500 is a camcorder. The device 1500 is capable of capturing sounds and visual images within regions 1530, 1540, and 1550. Furthermore, the device 1500 can adjust a field of view for capturing visual images and can adjust the listening zone for capturing sounds. The regions 1530, 1540, and 1550 are chosen as arbitrary regions. There can be fewer or additional regions that are larger or smaller in different instances.

In one embodiment, the device 1500 captures the visual image of the region 1540 and the sound from the region 1540. Accordingly, sound and visual images from the object 1520 may be captured. However, sounds and visual images from the object 1510 will not be captured in this instance.

In one instance, the field of view of the device 1500 may be enlarged from the region 1540 to encompass the object 1510. Accordingly, the sound captured by the device 1500 follows the visual field of view and also enlarges the listening zone from the region 1540 to encompass the object 1510.

In another instance, the visual image of the device 1500 may cover the same footprint as the region 1540 but be rotated to encompass the object 1510. Accordingly, the sound captured by the device 1500 follows the visual field of view and the listening zone rotates from the region 1540 to encompass the object 1510.

Figure 21:
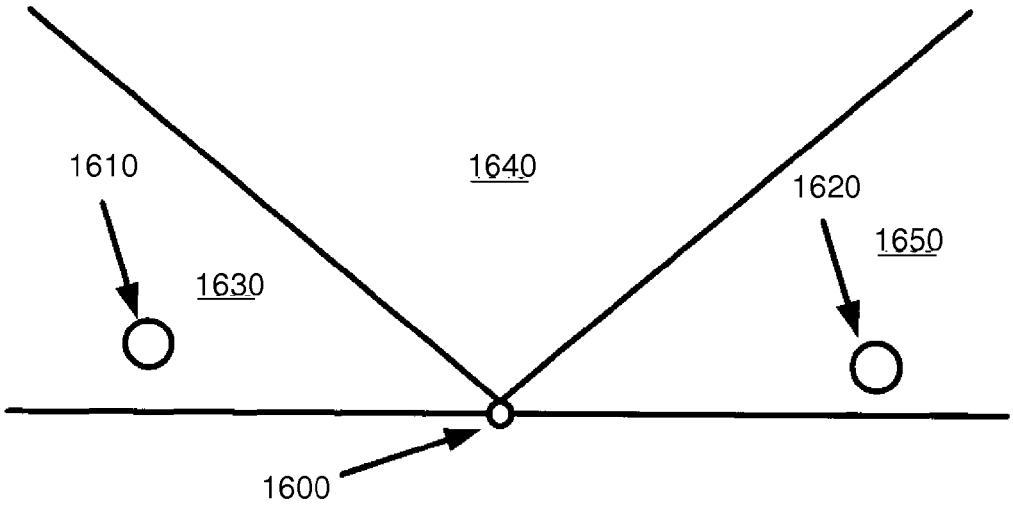
FIG. 21 is a diagram illustrating several listening zones consistent with embodiments of methods and apparatus for adjusting a listening area for capturing sounds or capturing an audio signal based on a visual image or a location of the signal.

FIG. 21 illustrates a diagram that illustrates a use of the method described in FIG. 19. FIG. 21 depicts a microphone array 1600, and objects 1610, 1620. The microphone array 1600 is capable of capturing sounds within regions 1630, 1640, and 1650. Further, the microphone array 1600 can adjust the listening zone for capturing sounds. The regions 1630, 1640, and 1650 are chosen as arbitrary regions. There can be fewer or additional regions that are larger or smaller in different instances.

In one embodiment, the microphone array 1600 may monitor sounds from the regions 1630, 1640, and 1650. When the object 1620 produces a sound that exceeds a sound level threshold the microphone array 1600 narrows sound detection to the region 1650. After the sound from the object 1620 terminates, the microphone array 1600 is capable of detecting sounds from the regions 1630, 1640, and 1650.

In one embodiment, the microphone array 1600 can be integrated within a Sony PlayStation® gaming device. In this application, the objects 1610 and 1620 represent players to the left and right of the user of the PlayStation® device, respectively. In this application, the user of the PlayStation® device can monitor fellow players or friends on either side of the user while blocking out unwanted noises by narrowing the listening zone that is monitored by the microphone array 1600 for capturing sounds.

Figure 22:
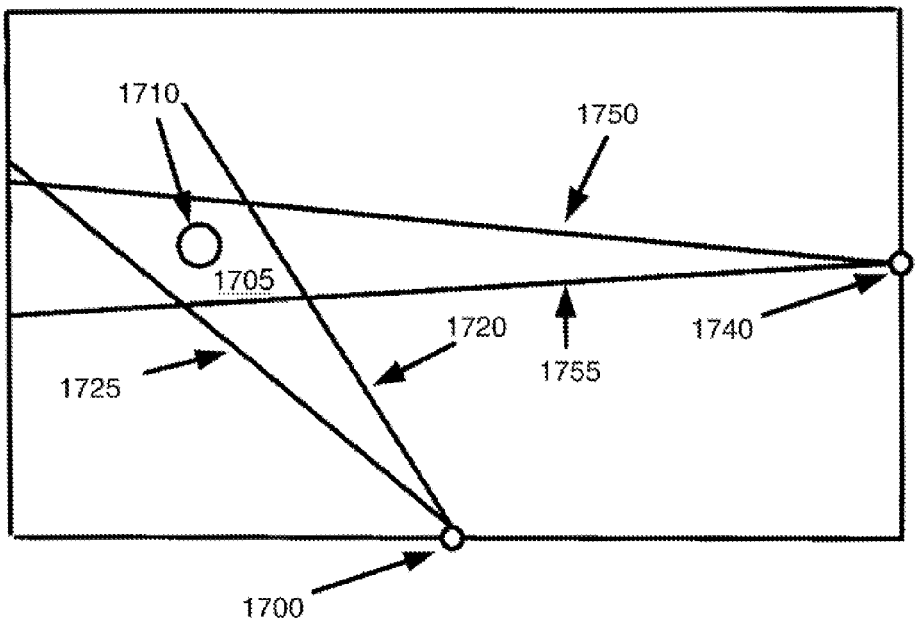
FIG. 22 is a diagram focusing sound detection consistent with embodiments of methods and apparatus for adjusting a listening area for capturing sounds or capturing an audio signal based on a visual image or a location of the signal.

FIG. 22 illustrates a diagram that illustrates a use of an application in conjunction with the system 900 as described within FIG. 14. FIG. 22 depicts a microphone array 1700, an object 1710, and a microphone array 1740. The microphone arrays 1700 and 1740 are capable of capturing sounds within a region 1705 which includes a region 1750. Further, both microphone arrays 1700 and 1740 can adjust their respective listening zones for capturing sounds.

In one embodiment, the microphone arrays 1700 and 1740 monitor sounds within the region 1705. When the object 1710 produces a sound that exceeds the sound level threshold, then the microphone arrays 1700 and 1740 narrows sound detection to the region 1750. In one embodiment, the region 1705 is bounded by traces 1720, 1725, 1750, and 1755. After the sound terminates, the microphone arrays 1700 and 1740 return to monitoring sounds within the region 1705.

In another embodiment, the microphone arrays 1700 and 1740 may be combined within a single microphone array that has a convex shape such that the single microphone array can be functionally substituted for the microphone arrays 1700 and 1740.

Figure 23A:
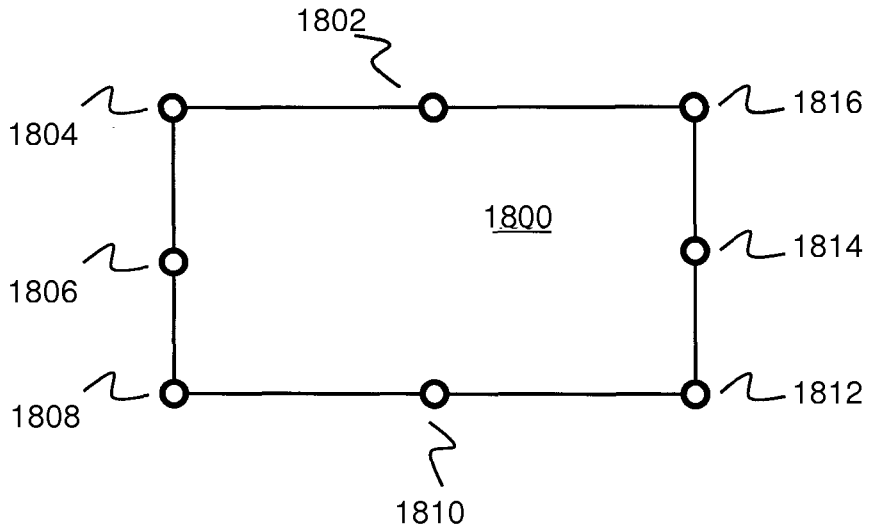
FIGS. 23A, 23B, and 23C are schematic diagrams that illustrate a microphone array in which the methods and apparatuses for capturing an audio signal based on a location of the signal are implemented.
Figure 23B:
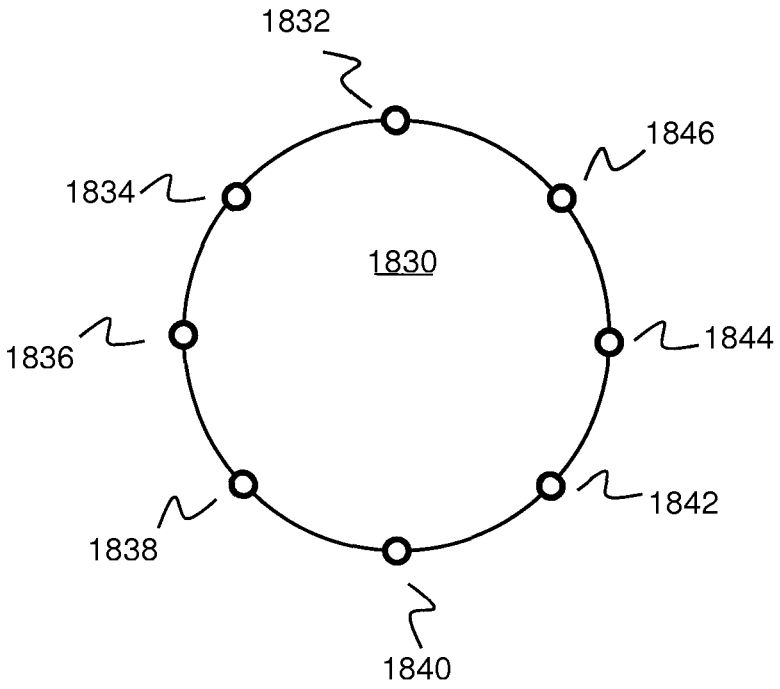
Figure 23C:
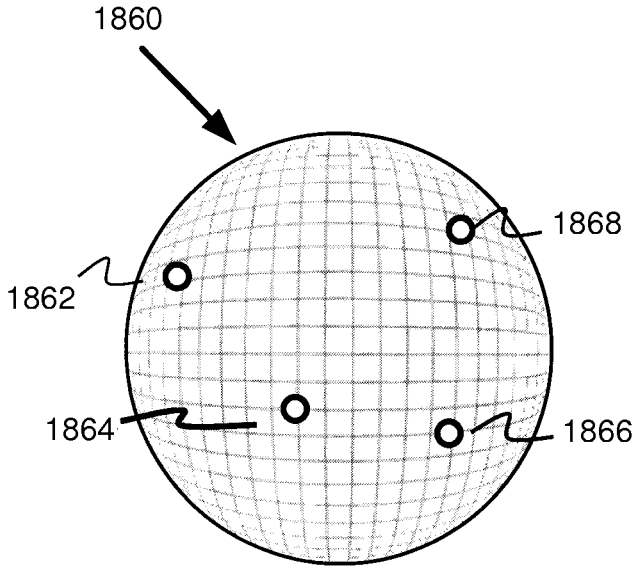

The microphone array 602 as shown within FIG. 11A illustrates one embodiment for a microphone array. FIGS. 23A, 23B, and 23C illustrate other embodiments of microphone arrays.

FIG. 23A illustrates a microphone array 1800 that includes microphones 1802, 1804, 1806, 1808, 1810, 1812, 1814, and 1816. In one embodiment, the microphone array 1810 may be shaped as a rectangle and the microphones 1802, 1804, 1806, 1808, 1810, 1812, 1814, and 1816 are located on the same plane relative to each other and are positioned along the perimeter of the microphone array 1800. In other embodiments, there may be fewer or additional microphones. Further, the positions of the microphones 1802, 1804, 1806, 1808, 1810, 1812, 1814, and 1816 can vary in other embodiments.

FIG. 23B illustrates a microphone array 1830 that includes microphones 1832, 1834, 1836, 1838, 1840, 1842, 1844, and 1846. In one embodiment, the microphone array 1830 may be shaped as a circle and the microphones 1832, 1834, 1836, 1838, 1840, 1842, 1844, and 1846 are located on the same plane relative to each other and are positioned along the perimeter of the microphone array 1830. In other embodiments, there may be fewer or additional microphones. Further, the positions of the microphones 1832, 1834, 1836, 1838, 1840, 1842, 1844, and 1846 can vary in other embodiments.

FIG. 23C illustrates a microphone array 1860 that includes microphones 1862, 1864, 1866, and 1868. In one embodiment, the microphones 1862, 1864, 1866, and 1868 distributed may be a three dimensional arrangement such that at least one of the microphones is located on a different plane relative to the other three. By way of example, the microphones 1862, 1864, 1866, and 1868 may be located along the outer surface of a three dimensional sphere. In other embodiments, there may be fewer or additional microphones. Further, the positions of the microphones 1862, 1864, 1866, and 1868 can vary in other embodiments.

Figure 24:
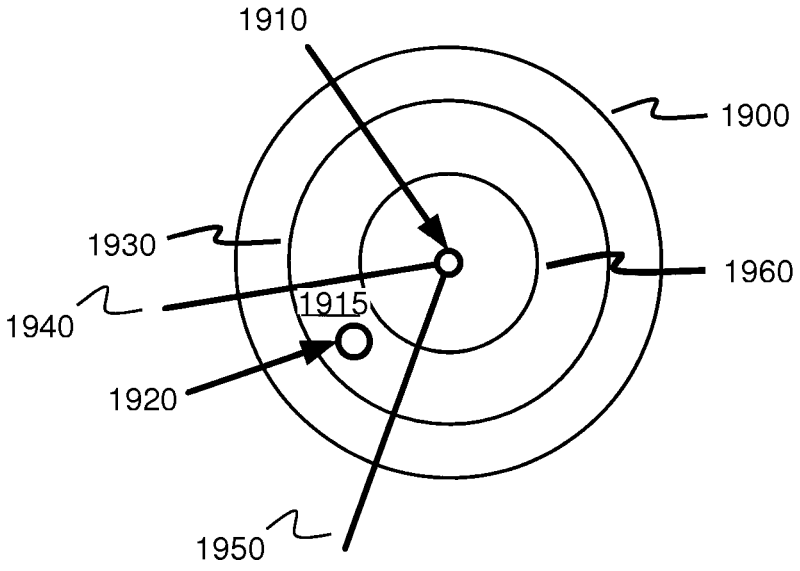
FIG. 24 is a diagram focusing sound detection consistent with one embodiment of the methods and apparatuses for capturing an audio signal based on a location of the signal.

FIG. 24 illustrates a diagram that illustrates a use of an application in conjunction with the system 900 as described within FIG. 14. FIG. 24 includes a microphone array 1910 and an object 1915. The microphone array 1910 is capable of capturing sounds within a region 1900. Further, the microphone array 1910 can adjust the listening zones for capturing sounds from the object 1915.

In one embodiment, the microphone array 1910 may monitor sounds within the region 1900. When the object 1915 produces a sound that exceeds the sound level threshold, a component of a controller coupled to the microphone array 1910 (e.g., area adjustment module 620 of system 600 of FIG. 6) may narrow the detection of sound to the region 1915. In one embodiment, the region 1915 is bounded by traces 1930, 1940, 1950, and 1960. Further, the region 1915 represents a three dimensional spatial volume in which sound is captured by the microphone array 1910.

In one embodiment, the microphone array 1910 may utilize a two dimensional array. For example, the microphone arrays 1800 and 1830 as shown in FIGS. 23A and 23B, respectively, are each one embodiment of a two dimensional array. By having the microphone array 1910 as a two dimensional array, the region 1915 can be represented by finite impulse response filter coefficients $b_0, b_1 \ldots, b_N$ as a spatial volume. In one embodiment, by utilizing a two dimensional microphone array, the region 1915 is bounded by traces 1930, 1940, 1950, and 1960. In contrast to a two dimensional microphone array, by utilizing a linear microphone array, the region 1915 is bounded by traces 1940 and 1950 in another embodiment.

In another embodiment, the microphone array 1910 may utilize a three dimensional array such as the microphone array 1860 as shown within FIG. 23C. By having the microphone array 1910 as a three dimensional array, the region 1915 can be represented by finite impulse response filter coefficients $b_0, b_1 \ldots, b_N$ as a spatial volume. In one embodiment, by utilizing a three dimensional microphone array, the region 1915 is bounded by traces 1930, 1940, 1950, and 1960. Further, to determine the location of the object 1920, the three dimensional array utilizes TDA detection in one embodiment.

Figure 25A:
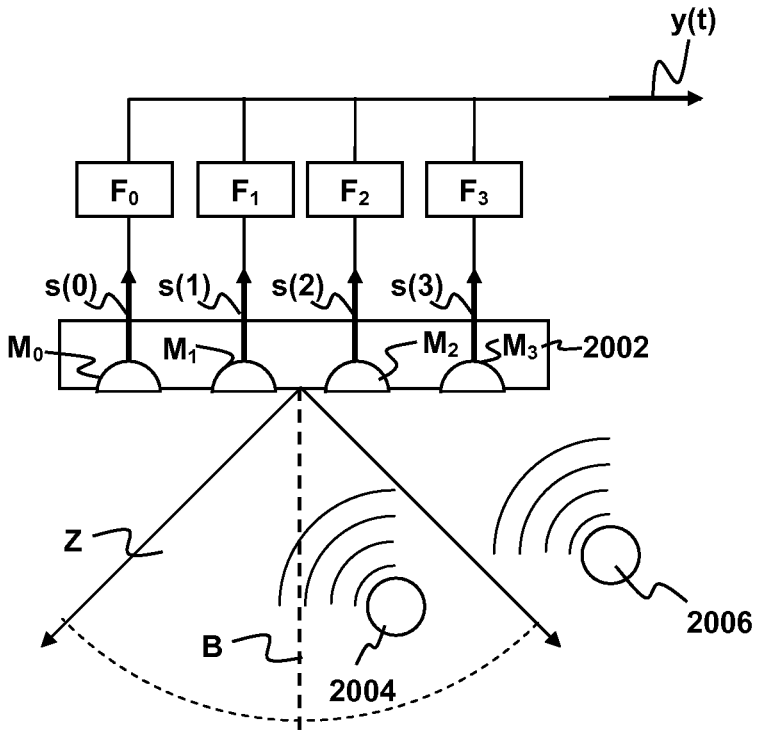
FIG. 25A is a schematic diagram of a microphone array according to an embodiment of the present invention.

Certain embodiments of the invention are directed to methods and apparatus for targeted sound detection using precalibrated listening zones. Such embodiments may be implemented with a microphone array having two or more microphones. As depicted in FIG. 25A, a microphone array 2002 may include four microphones $M_0$, $M_1$, $M_2$, and $M_3$ that are coupled to corresponding signal filters $F_0$, $F_1$, $F_2$ and $F_3$.

Each of the filters may implement some combination of finite impulse response (FIR) filtering and time delay of arrival (TDA) filtering. In general, the microphones $M_0$, $M_1$, $M_2$, and $M_3$ may be omni-directional microphones, i.e., microphones that can detect sound from essentially any direction. Omni-directional microphones are generally simpler in construction and less expensive than microphones having a preferred listening direction. The microphones $M_0$, $M_1$, $M_2$, and $M_3$ produce corresponding outputs $x_0(t)$, $x_1(t)$, $x_2(t)$, $x_3(t)$. These outputs serve as inputs to the filters $F_0$, $F_1$, $F_2$ and $F_3$. Each filter may apply a time delay of arrival (TDA) and/or a finite impulse response (FIR) to its input. The outputs of the filters may be combined into a filtered output y(t). Although four microphones $M_0$, $M_1$, $M_2$ and $M_3$ and four filters $F_0$, $F_1$, $F_2$ and $F_3$ are depicted in FIG. 25A for the sake of example, those of skill in the art will recognize that embodiments of the present invention may include any number of microphones greater than two and any corresponding number of filters. Although FIG. 25A depicts a linear array of microphones for the sake of example, embodiments of the invention are not limited to such configurations. Alternatively, three or more microphones may be arranged in a two-dimensional array, or four or more microphones may be arranged in a three-dimensional array as discussed above. In one particular embodiment, a system based on 2-microphone array may be incorporated into a controller unit for a video game.

An audio signal arriving at the microphone array 2002 from one or more sources 2004, 2006 may be expressed as a vector $x=[x_0, x_1, x_2, x_3]$, where $x_0$, $x_1$, $x_2$ and $x_3$ are the signals received by the microphones $M_0$, $M_1$, $M_2$ and $M_3$ respectively. Each signal $x_m$ generally includes subcomponents due to different sources of sounds. The subscript m ranges from 0 to 3 in this example and is used to distinguish among the different microphones in the array. The subcomponents may be expressed as a vector $s=[s_1, s_2, \ldots s_K]$, where K is the number of different sources.

Figure 6:
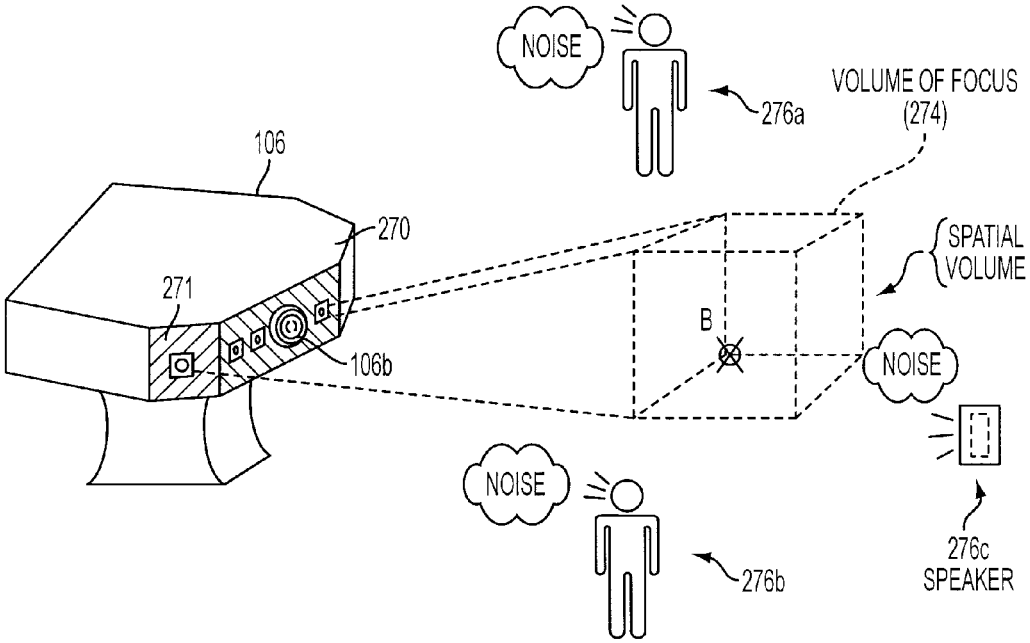
FIG. 6 illustrates an example in which sound is identified at a particular spatial volume using microphones in different planes, in accordance with one embodiment of the present invention.

To separate out sounds from the signal s originating from different sources one must determine the best TDA filter for each of the filters $F_0$, $F_1$, $F_2$ and $F_3$. To facilitate separation of sounds from the sources 2004, 2006, the filters $F_0$, $F_1$, $F_2$ and $F_3$ are pre-calibrated with filter parameters (e.g., FIR filter coefficients and/or TDA values) that define one or more pre-calibrated listening zones Z. Each listening zone Z is a region of space proximate the microphone array 2002. The parameters are chosen such that sounds originating from a source 2004 located within the listening zone Z are detected while sounds originating from a source 2006 located outside the listening zone Z are filtered out, i.e., substantially attenuated. In the example depicted in FIG. 25A, the listening zone Z is depicted as being a more or less wedge-shaped sector having an origin located at or proximate the center of the microphone array 2002. Alternatively, the listening zone Z may be a discrete volume, e.g., a rectangular, spherical, conical or arbitrarily-shaped volume in space. Wedge-shaped listening zones can be robustly established using a linear array of microphones. Robust listening zones defined by arbitrarily-shaped volumes may be established using a planar array or an array of at least four microphones where in at least one microphone lies in a different plane from the others, e.g., as illustrated in FIG. 6 and in FIG. 23C. Such an array is referred to herein as a "concave" microphone array.

As depicted in the flow diagram of FIG. 25B, a method 2010 for targeted voice detection using the microphone array 2002 may proceed as follows. As indicated at 2012, one or more sets of the filter coefficients for the filters $F_0$, $F_1$, $F_2$ and $F_3$ are determined corresponding to one or more pre-calibrated listening zones Z. The filters $F_0$, $F_1$, $F_2$, and $F_3$ may be implemented in hardware or software, e.g., using filters $\mathbf{702}_0 \ldots \mathbf{702}_M$ with corresponding filter taps $\mathbf{704}_{mi}$ having delays $z^{-1}$ and finite impulse response filter coefficients $b_{mi}$ as described above with respect to FIG. 12A and FIG. 12B. Each set of filter coefficients is selected to detect portions of the input signals corresponding to sounds originating within a given listening sector and filters out sounds originating outside the given listening sector. To pre-calibrate the listening sectors S one or more known calibration sound sources may be placed at several different known locations within and outside the sector S. During calibration, the calibration source(s) may emit sounds characterized by known spectral distributions similar to sounds the microphone array 2002 is likely to encounter at runtime. The known locations and spectral characteristics of the sources may then be used to select the values of the filter parameters for the filters $F_0$, $F_1$, $F_2$ and $F_3$ By way of example, and without limitation, Blind Source Separation (BSS) may be used to pre-calibrate the filters $F_0$, $F_1$, $F_2$ and $F_3$ to define the listening zone Z. Blind source separation separates a set of signals into a set of other signals, such that the regularity of each resulting signal is maximized, and the regularity between the signals is minimized (i.e., statistical independence is maximized or decorrelation is minimized). The blind source separation may involve an independent component analysis (ICA) that is based on second-order statistics. In such a case, the data for the signal arriving at each microphone may be represented by the random vector $x_m=[x_1, \ldots x_n]$ and the components as a random vector $s=[s_1, \ldots s_n]$ The observed data $x_m$ may be transformed using a linear static transformation s=Wx, into maximally independent components s measured by some function $F(s_1, \ldots s_n)$ of independence, e.g., as discussed above with respect to FIGS. 11A, 11B, 12A, 12B and 13. The listening zones Z of the microphone array 2002 can be calibrated prior to run time (e.g., during design and/or manufacture of the microphone array) and may optionally be re-calibrated at run time. By way of example, the listening zone Z may be pre-calibrated by recording a person speaking within the listening and applying second order statistics to the recorded speech as described above with respect to FIGS. 11A, 11B, 12A, 12B and 13 regarding the calibration of the listening direction.

The calibration process may be refined by repeating the above procedure with the user standing at different locations within the listening zone Z. In microphone-array noise reduction it is preferred for the user to move around inside the listening sector during calibration so that the beamforming has a certain tolerance (essentially forming a listening cone area) that provides a user some flexible moving space while talking. In embodiments of the present invention, by contrast, voice/sound detection need not be calibrated for the entire cone area of the listening sector S. Instead the listening sector is preferably calibrated for a very narrow beam B along the center of the listening zone Z, so that the final sector determination based on noise suppression ratio becomes more robust. The process may be repeated for one or more additional listening zones.

Referring again to FIG. 25B, as indicated at 2014 a particular pre-calibrated listening zone Z may be selected at a runtime by applying to the filters $F_0$, $F_1$, $F_2$ and $F_3$ a set of filter parameters corresponding to the particular pre-calibrated listening zone Z. As a result, the microphone array may detect sounds originating within the particular listening sector and filter out sounds originating outside the particular listening sector. Although a single listening sector is shown in FIG. 25A, embodiments of the present invention may be extended to situations in which a plurality of different listening sectors are pre-calibrated. As indicated at 2016 of FIG. 25B, the microphone array 2002 can then track between two or more pre-calibrated sectors at runtime to determine in which sector a sound source resides. For example as illustrated in FIG. 25C, the space surrounding the microphone array 2002 may be divided into multiple listening zones in the form of eighteen different pre-calibrated 20 degree wedge-shaped listening sectors $S_0 \ldots S_{17}$ that encompass about 360 degrees surrounding the microphone array 2002 by repeating the calibration procedure outlined above each of the different sectors and associating a different set of FIR filter coefficients and TDA values with each different sector. By applying an appropriate set of pre-determined filter settings (e.g., FIR filter coefficients and/or TDA values determined during calibration as described above) to the filters $F_0$, $F_1$, $F_2$, $F_3$ any of the listening sectors $S_0 \ldots S_{17}$ may be selected.

By switching from one set of pre-determined filter settings to another, the microphone array 2002 can switch from one sector to another to track a sound source 2004 from one sector to another. For example, referring again to FIG. 25C, consider a situation where the sound source 2004 is located in sector $S_7$ and the filters $F_0, F_1, F_2, F_3$ are set to select sector $S_4$. Since the filters are set to filter out sounds coming from outside sector $S_4$ the input energy E of sounds from the sound source 2004 will be attenuated. The input energy E may be defined as a dot product:

$$E = 1/M \sum_m x_m^T(t) \cdot x_m(t)$$

Where $x_m^T(t)$ is the transpose of the vector $x_m(t)$, which represents microphone output $x_m(t)$. And the sum is an average taken over all M microphones in the array.

The attenuation of the input energy E may be determined from the ratio of the input energy E to the filter output energy, i.e.:

$$\text{Attenuation} = 1/M \frac{\sum_m x_m^T(t) \cdot x_m(t)}{y^T(t) \cdot y(t)}.$$

If the filters are set to select the sector containing the sound source 2004 the attenuation is approximately equal to 1. Thus, the sound source 2004 may be tracked by switching the settings of the filters $F_0$, $F_1$, $F_2$, $F_3$ from one sector setting to another and determining the attenuation for different sectors. A targeted voice detection 2020 method using determination of attenuation for different listening sectors may proceed as depicted in the flow diagram of FIG. 25D. At 2022 any pre-calibrated listening sector may be selected initially. For example, sector $S_4$, which corresponds roughly to a forward listening direction, may be selected as a default initial listening sector. At 2024 an input signal energy attenuation is determined for the initial listen sector. If, at 2026 the attenuation is not an optimum value another pre-calibrated sector may be selected at 2028. If, at 2026 the attenuation is an optimum value the tracking is stopped at 2029.

There are a number of different ways to search through the sectors $S_0 \ldots S_{17}$ for the sector containing the sound source 2004. For example, by comparing the input signal energies for the microphones $M_0$ and $M_3$ at the far ends of the array it is possible to determine whether the sound source 2004 is to one side or the other of the default sector $S_4$. For example, in some cases the correct sector may be "behind" the microphone array 2002, e.g., in sectors $S_9 \ldots S_{17}$. In many cases the mounting of the microphone array may introduce a built-in attenuation of sounds coming from these sectors such that there is a minimum attenuation, e.g., of about 1 dB, when the source 2004 is located in any of these sectors. Consequently it may be determined from the input signal attenuation whether the source 2004 is "in front" or "behind" the microphone array 2002.

As a first approximation, the sound source 2004 might be expected to be closer to the microphone having the larger input signal energy. In the example depicted in FIG. 25C, it would be expected that the right hand microphone $M_3$ would have the larger input signal energy and, by process of elimination, the sound source 2004 would be in one of sectors $S_6$, $S_7$, $S_8$, $S_9$, $S_{10}$, $S_{11}$, $S_{12}$. Preferably, the next sector selected is one that is approximately 90 degrees away from the initial sector $S_4$ in a direction toward the right hand microphone $M_3$, e.g., sector $S_8$. The input signal energy attenuation for sector $S_8$ may be determined as indicated at 2024. If the attenuation is not the optimum value another sector may be selected at 2026. By way of example, the next sector may be one that is approximately 45 degrees away from the previous sector in the direction back toward the initial sector, e.g., sector $S_6$. Again the input signal energy attenuation may be determined and compared to the optimum attenuation. If the input signal energy is not close to the optimum only two sectors remain in this example. Thus, for the example depicted in FIG. 25C, in a maximum of four sector switches, the correct sector may be determined. The process of determining the input signal energy attenuation and switching between different listening sectors may be accomplished in about 100 milliseconds if the input signal is sufficiently strong.

Sound source location as described above may be used in conjunction with a sound source location and characterization technique referred to herein as "acoustic radar". FIG. 25E depicts an example of a sound source location and characterization apparatus 2030 having a microphone array 2002 described above coupled to an electronic device 2032 having a processor 2034 and memory 2036. The device may be a video game, television or other consumer electronic device. The processor 2034 may execute instructions that implement the FIR filters and time delays described above. The memory 2036 may contain data 2038 relating to pre-calibration of a plurality of listening zones. By way of example the pre-calibrated listening zones may include wedge shaped listening sectors $S_0$, $S_1$, $S_2$, $S_3$, $S_4$, $S_5$, $S_6$, $S_7$, $S_8$.

Figure 25B:
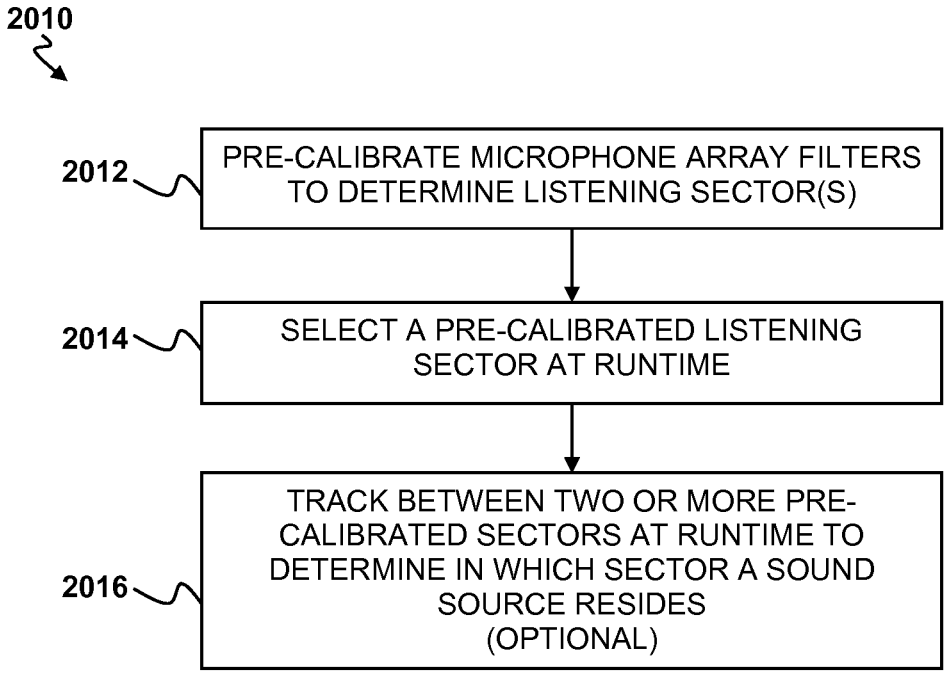
FIG. 25B is a flow diagram illustrating a method for targeted sound detection according to an embodiment of the present invention.
Figure 25E:
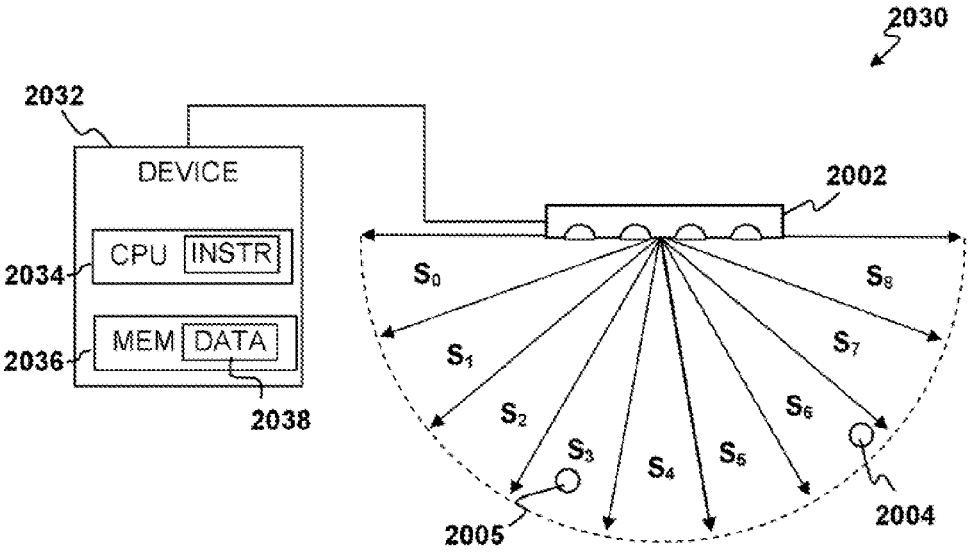
FIG. 25E is a top plan view of a sound source location and characterization apparatus according to an embodiment of the present invention.
Figure 25F:
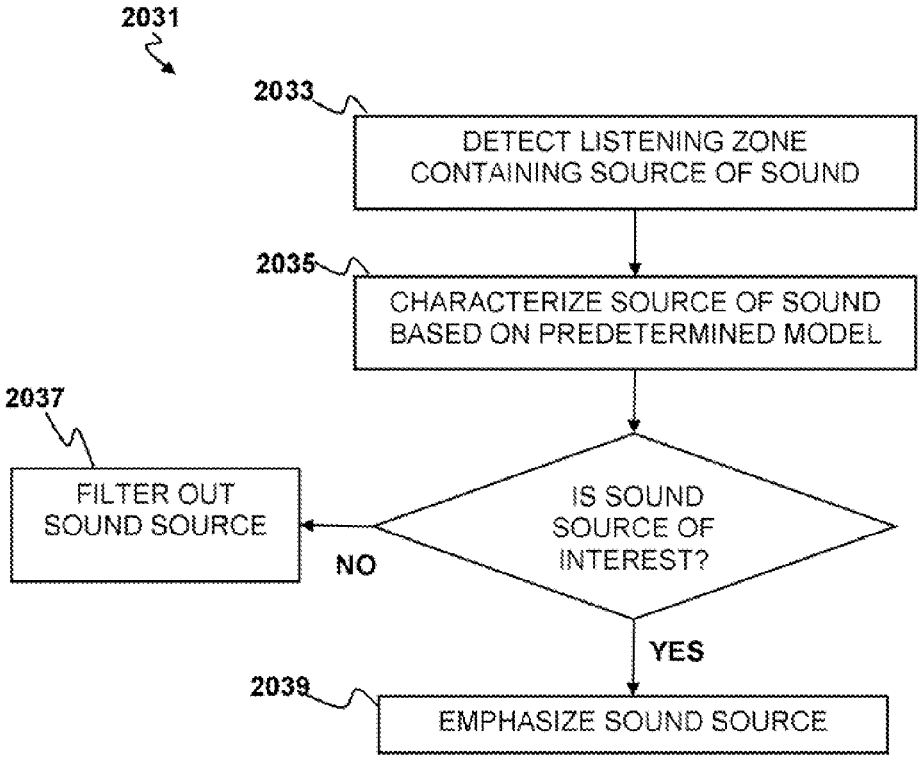
FIG. 25F is a flow diagram illustrating a method for sound source location and characterization according to an embodiment of the present invention.

The instructions run by the processor 2034 may operate the apparatus 2030 according to a method as set forth in the flow diagram 2031 of FIG. 25F. Sound sources 2004, 2005 within the listening zones can be detected using the microphone array 2002. One sound source 2004 may be of interest to the device 2032 or a user of the device. Another sound source 2005 may be a source of background noise or otherwise not of interest to the device 2032 or its user. Once the microphone array 2002 detects a sound the apparatus 2030 determines which listening zone contains the sound's source 2004 as indicated at 2033 of FIG. 25F. By way of example, the iterative sound source sector location routine described above with respect to FIGS. 25C through 25D may be used to determine the pre-calibrated listening zones containing the sound sources 2004, 2005 (e.g., sectors $S_3$ and $S_6$ respectively).

Once a listening zone containing the sound source has been identified, the microphone array may be refocused on the sound source, e.g., using adaptive beam forming. The use of adaptive beam forming techniques is described, e.g., in US Patent Application Publication No. 2005/0047611 A1. to Xiadong Mao, which is incorporated herein by reference. The sound source 2004 may then be characterized as indicated at 2035, e.g., through analysis of an acoustic spectrum of the sound signals originating from the sound source. Specifically, a time domain signal from the sound source may be analyzed over a predetermined time window and a fast Fourier transform (FFT) may be performed to obtain a frequency distribution characteristic of the sound source. The detected frequency distribution may be compared to a known acoustic model. The known acoustic model may be a frequency distribution generated from training data obtained from a known source of sound. A number of different acoustic models may be stored as part of the data 2038 in the memory 2036 or other storage medium and compared to the detected frequency distribution. By comparing the detected sounds from the sources 2004, 2005 against these acoustic models a number of different possible sound sources may be identified.

Based upon the characterization of the sound source 2004, 2005, the apparatus 2032 may take appropriate action depending upon whether the sound source is of interest or not. For example, if the sound source 2004 is determined to be one of interest to the device 2032, the apparatus may emphasize or amplify sounds coming from sector $S_3$ and/or take other appropriate action as indicated at 2039. For example, if the device 2032 is a video game controller and the source 2004 is a video game player, the device 2032 may execute game instructions such as "jump" or "swing" in response to sounds from the source 2004 that are interpreted as game commands. Similarly, if the sound source 2005 is determined not to be of interest to the device 2032 or its user, the device may filter out sounds coming from sector $S_6$ or take other appropriate action as indicated at 2037. In some embodiments, for example, an icon may appear on a display screen indicating the listening zone containing the sound source and the type of sound source.

In some embodiments, amplifying sound or taking other appropriate action may include reducing noise disturbances associated with a source of sound. For example, a noise disturbance of an audio signal associated with sound source 104 may be magnified relative to a remaining component of the audio signal. Then, a sampling rate of the audio signal may be decreased and an even order derivative is applied to the audio signal having the decreased sampling rate to define a detection signal. Then, the noise disturbance of the audio signal may be adjusted according to a statistical average of the detection signal. A system capable of canceling disturbances associated with an audio signal, a video game controller, and an integrated circuit for reducing noise disturbances associated with an audio signal are included. Details of a such a technique are described, e.g., in commonly-assigned U.S. patent application Ser. No. 10/820,469, to Xiadong Mao entitled "METHOD AND APPARATUS TO DETECT AND REMOVE AUDIO DISTURBANCES", which was filed Apr. 7, 2004 and published on Oct. 13, 2005 as US Patent Application Publication 20050226431, the entire disclosures of which are incorporated herein by reference.

By way of example, the apparatus 2030 may be used in a baby monitoring application. Specifically, an acoustic model stored in the memory 2036 may include a frequency distribution characteristic of a baby or even of a particular baby. Such a sound may be identified as being of interest to the device 130 or its user. Frequency distributions for other known sound sources, e.g., a telephone, television, radio, computer, persons talking, etc., may also be stored in the memory 2036. These sound sources may be identified as not being of interest.

Sound source location and characterization apparatus and methods may be used in ultrasonic- and sonic-based consumer electronic remote controls, e.g., as described in commonly assigned U.S. patent application Ser. No. 11/418,993 to Steven Osman, entitled "SYSTEM AND METHOD FOR CONTROL BY AUDIBLE DEVICE", the entire disclosures of which are incorporated herein by reference. Specifically, a sound received by the microphone array may 2002 be analyzed to determine whether or not it has one or more predetermined characteristics. If it is determined that the sound does have one or more predetermined characteristics, at least one control signal may be generated for the purpose of controlling at least one aspect of the device 2032.

Figure 25G:
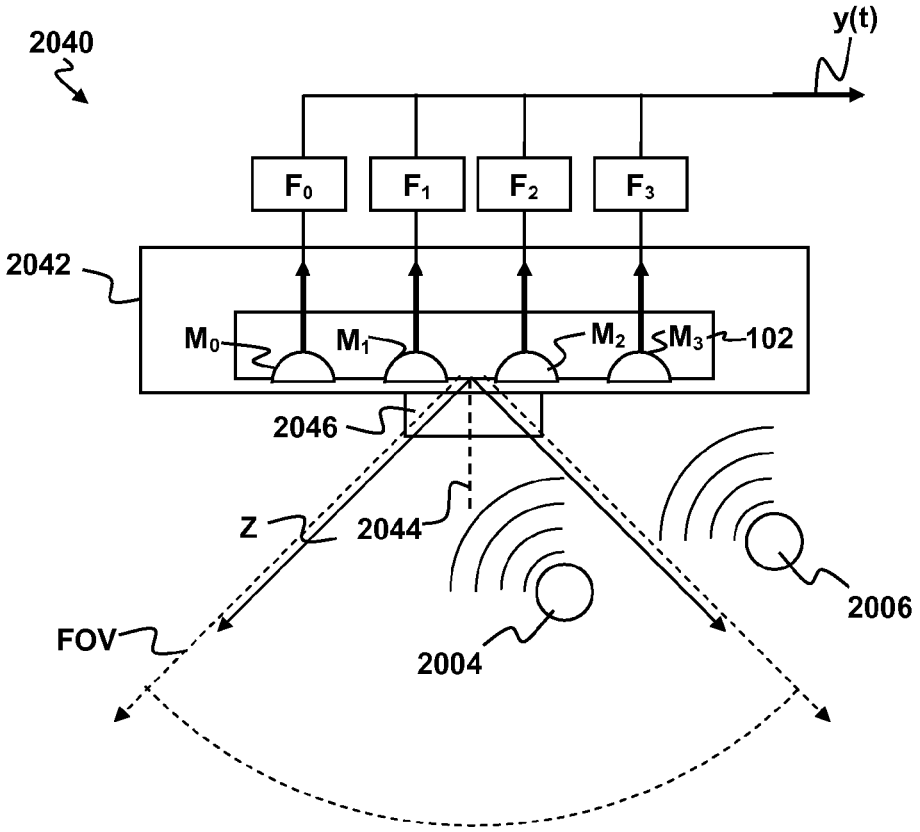
FIG. 25G is a top plan view schematic diagram of an apparatus having a camera and a microphone array for targeted sound detection from within a field of view of the camera according to an embodiment of the present invention.
Figure 25H:
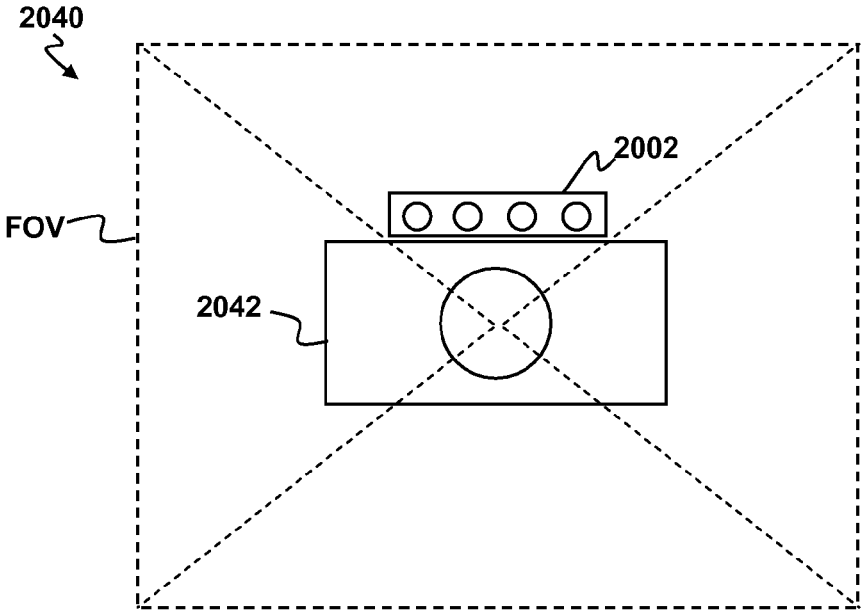
FIG. 25H is a front elevation view of the apparatus of FIG. 25E.

In some embodiments of the present invention, the pre-calibrated listening zone Z may correspond to the field-of-view of a camera. For example, as illustrated in FIGS. 25G-25H an audio-video apparatus 2040 may include a microphone array 2002 and signal filters $F_0$, $F_1$, $F_2$, $F_3$, e.g., as described above, and an image capture unit 2042. By way of example, the image capture unit 2042 may be a digital camera. An example of a suitable digital camera is a color digital camera sold under the name "EyeToy" by Logitech of Fremont, Calif. The image capture unit 2042 may be mounted in a fixed position relative to the microphone array 2002, e.g., by attaching the microphone array 2002 to the image capture unit 2042 or vice versa. Alternatively, both the microphone array 2002 and image capture unit 2042 may be attached to a common frame or mount (not shown). Preferably, the image capture unit 2042 is oriented such that an optical axis 2044 of its lens system 2046 is aligned parallel to an axis perpendicular to a common plane of the microphones $M_0$, $M_1$, $M_2$, $M_3$ of the microphone array 2002. The lens system 2046 may be characterized by a volume of focus FOV that is sometimes referred to as the field of view of the image capture unit. In general, objects outside the field of view FOV do not appear in images generated by the image capture unit 2042. The settings of the filters $F_0$, $F_1$, $F_2$, $F_3$ may be pre-calibrated such that the microphone array 2002 has a listening zone Z that corresponds to the field of view FOV of the image capture unit 2042. As used herein, the listening zone Z may be said to "correspond" to the field of view FOV if there is a significant overlap between the field of view FOV and the listening zone Z. As used herein, there is "significant overlap" if an object within the field of view FOV is also within the listening zone Z and an object outside the field of view FOV is also outside the listening zone Z. It is noted that the foregoing definitions of the terms "correspond" and "significant overlap" within the context of the embodiment depicted in FIGS. 25G-25H allow for the possibility that an object may be within the listening zone Z and outside the field of view FOV.

The listening zone Z may be pre-calibrated as described above, e.g., by adjusting FIR filter coefficients and TDA values for the filters $F_0$, $F_1$, $F_2$, $F_3$ using one or more known sources placed at various locations within the field of view FOV during the calibration stage. The FIR filter coefficients and TDA values are selected (e.g., using ICA) such that sounds from a source 2004 located within the FOV are detected and sounds from a source 2006 outside the FOV are filtered out. The apparatus 2040 allows for improved processing of video and audio images. By pre-calibrating a listening zone Z to correspond to the field of view FOV of the image capture unit 2042 sounds originating from sources within the FOV may be enhanced while those originating outside the FOV may be attenuated. Applications for such an apparatus include audio-video (AV) chat.

Figure 25I:
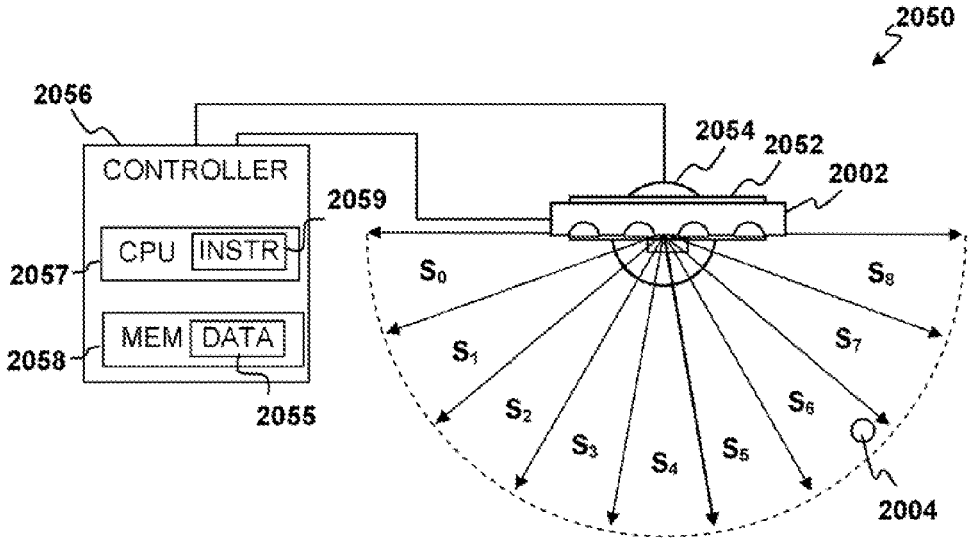
FIGS. 25I-25J are plan view schematic diagrams of an audio-video apparatus according to an alternative embodiment of the present invention.
Figure 25J:
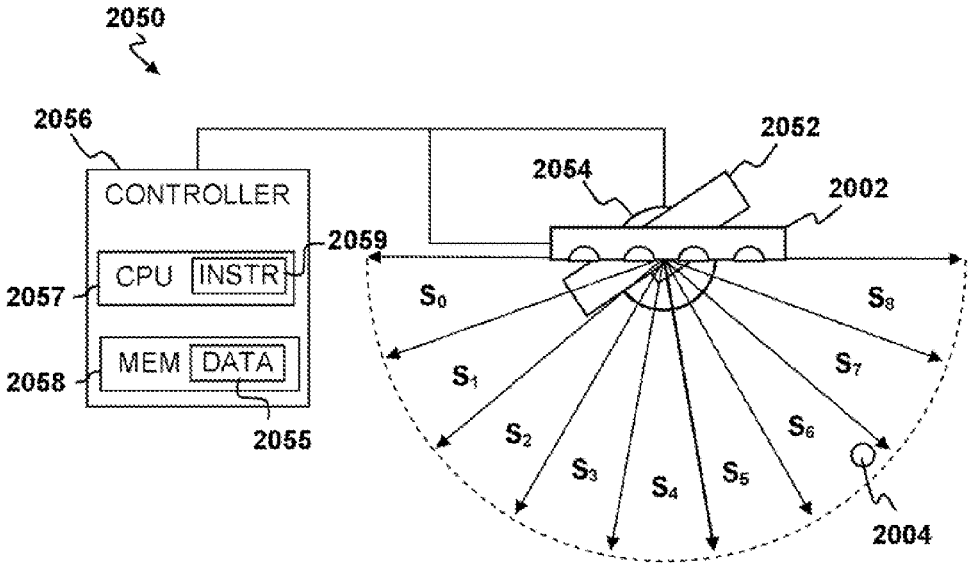

Although only a single pre-calibrated listening sector is depicted in FIGS. 25G through 25H, embodiments of the present invention may use multiple pre-calibrated listening sectors in conjunction with a camera. For example, FIGS. 25I-25J depict an apparatus 2050 having a microphone array 2002 and an image capture unit 2052 (e.g., a digital camera) that is mounted to one or more pointing actuators 2054 (e.g., servo-motors). The microphone array 2002, image capture unit 2052 and actuators may be coupled to a controller 2056 having a processor 2057 and memory 2058. Software data 2055 stored in the memory 2058 and instructions 2059 stored in the memory 2058 and executed by the processor 2057 may implement the signal filter functions described above. The software data may include FIR filter coefficients and TDA values that correspond to a set of pre-calibrated listening zones, e.g., nine wedge-shaped sectors $S_0 \ldots S_8$ of twenty degrees each covering a 180 degree region in front of the microphone array 2002. The pointing actuators 2050 may point the image capture unit 2052 in a viewing direction in response to signals generated by the processor 2057. In embodiments of the present invention a listening zone containing a sound source 2004 may be determined, e.g., as described above with respect to FIGS. 25C through 25D. Once the sector containing the sound source 2004 has been determined, the actuators 2054 may point the image capture unit 2052 in a direction of the particular pre-calibrated listening zone containing the sound source 2004 as shown in FIG. 25J. The microphone array 2002 may remain in a fixed position while the pointing actuators point the camera in the direction of a selected listening zone.

Figure 26:
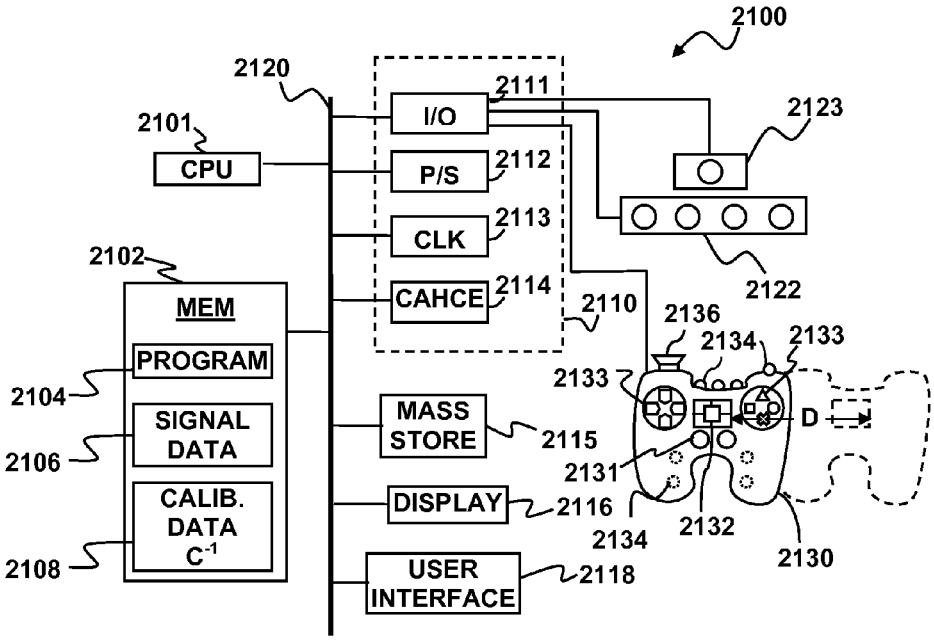
FIG. 26 is a block diagram illustrating a signal processing apparatus according to an embodiment of the present invention.

According to embodiments of the present invention, a signal processing method of the type described above with respect to FIGS. 25A through 25J operating as described above may be implemented as part of a signal processing apparatus 2100, as depicted in FIG. 26. The apparatus 2100 may include a processor 2101 and a memory 2102 (e.g., RAM, DRAM, ROM, and the like). In addition, the signal processing apparatus 2100 may have multiple processors 2101 if parallel processing is to be implemented. The memory 2102 includes data and code configured as described above. Specifically, the memory 2102 may include signal data 2106 which may include a digital representation of the input signals $x_m(t)$, and code and/or data implementing the filters $\mathbf{702}_0 \ldots \mathbf{702}_M$ with corresponding filter taps $\mathbf{704}_{mi}$ having delays $z^{-1}$ and finite impulse response filter coefficients $b_{mi}$ as described above with respect to FIG. 12A and FIG. 12B. The memory 2102 may also contain calibration data 2108, e.g., data representing one or more inverse eigenmatrices $C^{-1}$ for one or more corresponding pre-calibrated listening zones obtained from calibration of a microphone array 2122 as described above. By way of example the memory 2102 may contain eignematrices for eighteen 20 degree sectors that encompass a microphone array 2122. The memory 2102 may also contain profile information, e.g., as described above with respect to FIG. 15.

The apparatus 2100 may also include well-known support functions 2110, such as input/output (I/O) elements 2111, power supplies (P/S) 2112, a clock (CLK) 2113 and cache 2114. The apparatus 2100 may optionally include a mass storage device 2115 such as a disk drive, CD-ROM drive, tape drive, or the like to store programs and/or data. The controller may also optionally include a display unit 2116 and user interface unit 2118 to facilitate interaction between the controller 2100 and a user. The display unit 2116 may be in the form of a cathode ray tube (CRT) or flat panel screen that displays text, numerals, graphical symbols or images. The user interface 2118 may include a keyboard, mouse, joystick, light pen or other device. In addition, the user interface 2118 may include a microphone, video camera or other signal transducing device to provide for direct capture of a signal to be analyzed. The processor 2101, memory 2102 and other components of the system 2100 may exchange signals (e.g., code instructions and data) with each other via a system bus 2120 as shown in FIG. 26.

The microphone array 2122 may be coupled to the apparatus 2100 through the I/O functions 2111. The microphone array may include between about 2 and about 8 microphones, preferably about 4 microphones with neighboring microphones separated by a distance of less than about 4 centimeters, preferably between about 1 centimeter and about 2 centimeters. Preferably, the microphones in the array 2122 are omni-directional microphones. An optional image capture unit 2123 (e.g., a digital camera) may be coupled to the apparatus 2100 through the I/O functions 2111. One or more pointing actuators 2125 that are mechanically coupled to the camera may exchange signals with the processor 2101 via the I/O functions 2111.

As used herein, the term I/O generally refers to any program, operation or device that transfers data to or from the system 2100 and to or from a peripheral device. Every data transfer may be regarded as an output from one device and an input into another. Peripheral devices include input-only devices, such as keyboards and mouses, output-only devices, such as printers as well as devices such as a writable CD-ROM that can act as both an input and an output device. The term "peripheral device" includes external devices, such as a mouse, keyboard, printer, monitor, microphone, game controller, camera, external Zip drive or scanner as well as internal devices, such as a CD-ROM drive, CD-R drive or internal modem or other peripheral such as a flash memory reader/writer, hard drive.

In certain embodiments of the invention, the apparatus 2100 may be a video game unit, which may include a joystick controller 2130 coupled to the processor via the I/O functions 2111 either through wires (e.g., a USB cable) or wirelessly. The joystick controller 2130 may have analog joystick controls 2131 and conventional buttons 2133 that provide control signals commonly used during playing of video games. Such video games may be implemented as processor readable data and/or instructions which may be stored in the memory 2102 or other processor readable medium such as one associated with the mass storage device 2115.

The joystick controls 2131 may generally be configured so that moving a control stick left or right signals movement along the X axis, and moving it forward (up) or back (down) signals movement along the Y axis. In joysticks that are configured for three-dimensional movement, twisting the stick left (counter-clockwise) or right (clockwise) may signal movement along the Z axis. These three axis—X Y and Z—are often referred to as roll, pitch, and yaw, respectively, particularly in relation to an aircraft.

In addition to conventional features, the joystick controller 2130 may include one or more inertial sensors 2132, which may provide position and/or orientation information to the processor 2101 via an inertial signal. Orientation information may include angular information such as a tilt, roll or yaw of the joystick controller 2130. By way of example, the inertial sensors 2132 may include any number and/or combination of accelerometers, gyroscopes or tilt sensors. In a preferred embodiment, the inertial sensors 2132 include tilt sensors adapted to sense orientation of the joystick controller with respect to tilt and roll axes, a first accelerometer adapted to sense acceleration along a yaw axis and a second accelerometer adapted to sense angular acceleration with respect to the yaw axis. An accelerometer may be implemented, e.g., as a MEMS device including a mass mounted by one or more springs with sensors for sensing displacement of the mass relative to one or more directions. Signals from the sensors that are dependent on the displacement of the mass may be used to determine an acceleration of the joystick controller 2130. Such techniques may be implemented by program code instructions 2104 which may be stored in the memory 2102 and executed by the processor 2101.

In addition, the program code 2104 may optionally include processor executable instructions including one or more instructions which, when executed adjust the mapping of controller manipulations to game a environment. Such a feature allows a user to change the "gearing" of manipulations of the joystick controller 2130 to game state. For example, a 45 degree rotation of the joystick controller 2130 may be mapped to a 45 degree rotation of a game object. However this mapping may be modified so that an X degree rotation (or tilt or yaw or "manipulation") of the controller translates to a Y rotation (or tilt or yaw or "manipulation") of the game object. Such modification of the mapping gearing or ratios can be adjusted by the program code 2104 according to game play or game state or through a user modifier button (key pad, etc.) located on the joystick controller 2130. In certain embodiments the program code 2104 may change the mapping over time from an X to X ratio to a X to Y ratio in a predetermined time-dependent manner.

In addition, the joystick controller 2130 may include one or more light sources 2134, such as light emitting diodes (LEDs). The light sources 2134 may be used to distinguish one controller from the other. For example one or more LEDs can accomplish this by flashing or holding an LED pattern code. By way of example, 5 LEDs can be provided on the joystick controller 2130 in a linear or two-dimensional pattern. Although a linear array of LEDs is preferred, the LEDs may alternatively, be arranged in a rectangular pattern or an arcuate pattern to facilitate determination of an image plane of the LED array when analyzing an image of the LED pattern obtained by the image capture unit 2123. Furthermore, the LED pattern codes may also be used to determine the positioning of the joystick controller 2130 during game play. For instance, the LEDs can assist in identifying tilt, yaw and roll of the controllers. This detection pattern can assist in providing a better user/feel in games, such as aircraft flying games, etc. The image capture unit 2123 may capture images containing the joystick controller 2130 and light sources 2134. Analysis of such images can determine the location and/or orientation of the joystick controller. Such analysis may be implemented by program code instructions 2104 stored in the memory 2102 and executed by the processor 2101. To facilitate capture of images of the light sources 2134 by the image capture unit 2123, the light sources 2134 may be placed on two or more different sides of the joystick controller 2130, e.g., on the front and on the back (as shown in phantom). Such placement allows the image capture unit 2123 to obtain images of the light sources 2134 for different orientations of the joystick controller 2130 depending on how the joystick controller 2130 is held by a user.

In addition the light sources 2134 may provide telemetry signals to the processor 2101, e.g., in pulse code, amplitude modulation or frequency modulation format. Such telemetry signals may indicate which joystick buttons are being pressed and/or how hard such buttons are being pressed. Telemetry signals may be encoded into the optical signal, e.g., by pulse coding, pulse width modulation, frequency modulation or light intensity (amplitude) modulation. The processor 2101 may decode the telemetry signal from the optical signal and execute a game command in response to the decoded telemetry signal. Telemetry signals may be decoded from analysis of images of the joystick controller 2130 obtained by the image capture unit 2123. Alternatively, the apparatus 2101 may include a separate optical sensor dedicated to receiving telemetry signals from the lights sources 2134. The use of LEDs in conjunction with determining an intensity amount in interfacing with a computer program is described, e.g., in commonly-assigned U.S. patent application Ser. No. 11/429,414, to Richard L. Marks et al., entitled "COMPUTER IMAGE AND AUDIO PROCESSING ON INTENSITY AND INPUT DEVICES WHEN INTERFACING WITH A COMPUTER PROGRAM", which is incorporated herein by reference in its entirety. In addition, analysis of images containing the light sources 2134 may be used for both telemetry and determining the position and/or orientation of the joystick controller 2130. Such techniques may be implemented by program code instructions 2104 which may be stored in the memory 2102 and executed by the processor 2101.

The processor 2101 may use the inertial signals from the inertial sensor 2132 in conjunction with optical signals from light sources 2134 detected by the image capture unit 2123 and/or sound source location and characterization information from acoustic signals detected by the microphone array 2122 to deduce information on the location and/or orientation of the joystick controller 2130 and/or its user. For example, "acoustic radar" sound source location and characterization may be used in conjunction with the microphone array 2122 to track a moving voice while motion of the joystick controller is independently tracked (through the inertial sensor 2132 and or light sources 2134). Any number of different combinations of different modes of providing control signals to the processor 2101 may be used in conjunction with embodiments of the present invention. Such techniques may be implemented by program code instructions 2104 which may be stored in the memory 2102 and executed by the processor 2101.

Signals from the inertial sensor 2132 may provide part of a tracking information input and signals generated from the image capture unit 2123 from tracking the one or more light sources 2134 may provide another part of the tracking information input. By way of example, and without limitation, such "mixed mode" signals may be used in a football type video game in which a Quarterback pitches the ball to the right after a head fake head movement to the left. Specifically, a game player holding the controller 2130 may turn his head to the left and make a sound while making a pitch movement swinging the controller out to the right like it was the football. The microphone array 2120 in conjunction with "acoustic radar" program code can track the user's voice. The image capture unit 2123 can track the motion of the user's head or track other commands that do not require sound or use of the controller. The sensor 2132 may track the motion of the joystick controller (representing the football). The image capture unit 2123 may also track the light sources 2134 on the controller 2130. The user may release of the "ball" upon reaching a certain amount and/or direction of acceleration of the joystick controller 2130 or upon a key command triggered by pressing a button on the joystick controller 2130.

In certain embodiments of the present invention, an inertial signal, e.g., from an accelerometer or gyroscope may be used to determine a location of the joystick controller 2130. Specifically, an acceleration signal from an accelerometer may be integrated once with respect to time to determine a change in velocity and the velocity may be integrated with respect to time to determine a change in position. If values of the initial position and velocity at some time are known then the absolute position may be determined using these values and the changes in velocity and position. Although position determination using an inertial sensor may be made more quickly than using the image capture unit 2123 and light sources 2134 the inertial sensor 2132 may be subject to a type of error known as "drift" in which errors that accumulate over time can lead to a discrepancy D between the position of the joystick 2130 calculated from the inertial signal (shown in phantom) and the actual position of the joystick controller 2130. Embodiments of the present invention allow a number of ways to deal with such errors.

For example, the drift may be cancelled out manually by re-setting the initial position of the joystick controller 2130 to be equal to the current calculated position. A user may use one or more of the buttons on the joystick controller 2130 to trigger a command to reset the initial position. Alternatively, image-based drift compensation may be implemented by re-setting the current position to a position determined from an image obtained from the image capture unit 2123 as a reference. Such image-based drift compensation may be implemented manually, e.g., when the user triggers one or more of the buttons on the joystick controller 2130. Alternatively, image-based drift compensation may be implemented automatically, e.g., at regular intervals of time or in response to game play. Such techniques may be implemented by program code instructions 2104 which may be stored in the memory 2102 and executed by the processor 2101.

In certain embodiments it may be desirable to compensate for spurious data in the inertial sensor signal. For example the signal from the inertial sensor 2132 may be oversampled and a sliding average may be computed from the oversampled signal to remove spurious data from the inertial sensor signal. In some situations it may be desirable to oversample the signal and reject a high and/or low value from some subset of data points and compute the sliding average from the remaining data points. Furthermore, other data sampling and manipulation techniques may be used to adjust the signal from the inertial sensor to remove or reduce the significance of spurious data. The choice of technique may depend on the nature of the signal, computations to be performed with the signal, the nature of game play or some combination of two or more of these. Such techniques may be implemented by program code instructions 2104 which may be stored in the memory 2102 and executed by the processor 2101.

The processor 2101 may perform digital signal processing on signal data 2106 as described above in response to the data 2106 and program code instructions of a program 2104 stored and retrieved by the memory 2102 and executed by the processor module 2101. Code portions of the program 2104 may conform to any one of a number of different programming languages such as Assembly, C++, JAVA or a number of other languages. The processor module 2101 forms a general-purpose computer that becomes a specific purpose computer when executing programs such as the program code 2104. Although the program code 2104 is described herein as being implemented in software and executed upon a general purpose computer, those skilled in the art will realize that the method of task management could alternatively be implemented using hardware such as an application specific integrated circuit (ASIC) or other hardware circuitry. As such, it should be understood that embodiments of the invention can be implemented, in whole or in part, in software, hardware or some combination of both.

In one embodiment, among others, the program code 2104 may include a set of processor readable instructions that implement a method having features in common with the method 2010 of FIG. 25B, the method 2020 of FIG. 25D, the method 2040 of FIG. 25F or the methods illustrated in FIGS., 7, 8, 13, 16, 17, 18 or 19 or some combination of two or more of these. In one embodiment, the program code 2104 may generally include one or more instructions that direct the one or more processors to select a pre-calibrated listening zone at runtime and filter out sounds originating from sources outside the pre-calibrated listening zone. The pre-calibrated listening zones may include a listening zone that corresponds to a volume of focus or field of view of the image capture unit 2123.

The program code may include one or more instructions which, when executed, cause the apparatus 2100 to select a pre-calibrated listening sector that contains a source of sound. Such instructions may cause the apparatus to determine whether a source of sound lies within an initial sector or on a particular side of the initial sector. If the source of sound does not lie within the default sector, the instructions may, when executed, select a different sector on the particular side of the default sector. The different sector may be characterized by an attenuation of the input signals that is closest to an optimum value. These instructions may, when executed, calculate an attenuation of input signals from the microphone array 2122 and the attenuation to an optimum value. The instructions may, when executed, cause the apparatus 2100 to determine a value of an attenuation of the input signals for one or more sectors and select a sector for which the attenuation is closest to an optimum value.

The program code 2104 may optionally include one or more instructions that direct the one or more processors to produce a discrete time domain input signal $x_m(t)$ from the microphones $M_0 \ldots M_M$, determine a listening sector, and use the listening sector in a semi-blind source separation to select the finite impulse response filter coefficients to separate out different sound sources from input signal $x_m(t)$. The program 2104 may also include instructions to apply one or more fractional delays to selected input signals $x_m(t)$ other than an input signal $x_0(t)$ from a reference microphone $M_0$. Each fractional delay may be selected to optimize a signal to noise ratio of a discrete time domain output signal y(t) from the microphone array. The fractional delays may be selected to such that a signal from the reference microphone $M_0$ is first in time relative to signals from the other microphone(s) of the array. The program 2104 may also include instructions to introduce a fractional time delay Δ into an output signal y(t) of the microphone array so that: $y(t+\Delta)=x(t+\Delta)*b_0+x(t-1+\Delta)*b_1+x(t-2+\Delta)*b_2+\ldots+x(t-N+\Delta)b_N$, where Δ is between zero and ±1.

The program code 2104 may optionally include processor executable instructions including one or more instructions which, when executed cause the image capture unit 2123 to monitor a field of view in front of the image capture unit 2123, identify one or more of the light sources 2134 within the field of view, detect a change in light emitted from the light source(s) 2134; and in response to detecting the change, triggering an input command to the processor 2101. The use of LEDs in conjunction with an image capture device to trigger actions in a game controller is described e.g., in commonly-assigned, U.S. patent application Ser. No. 10/759,782 to Richard L. Marks, filed Jan. 16, 2004 and entitled: METHOD AND APPARATUS FOR LIGHT INPUT DEVICE, which is incorporated herein by reference in its entirety.

The program code 2104 may optionally include processor executable instructions including one or more instructions which, when executed, use signals from the inertial sensor and signals generated from the image capture unit from tracking the one or more light sources as inputs to a game system, e.g., as described above. The program code 2104 may optionally include processor executable instructions including one or more instructions which, when executed compensate for drift in the inertial sensor 2132.

In addition, the program code 2104 may optionally include processor executable instructions including one or more instructions which, when executed adjust the gearing and mapping of controller manipulations to game a environment. Such a feature allows a user to change the "gearing" of manipulations of the joystick controller 2130 to game state. For example, a 45 degree rotation of the joystick controller 2130 may be geared to a 45 degree rotation of a game object. However this 1:1 gearing ratio may be modified so that an X degree rotation (or tilt or yaw or "manipulation") of the controller translates to a Y rotation (or tilt or yaw or "manipulation") of the game object. Gearing may be 1:1 ratio, 1:2 ratio, 1:X ratio or X:Y ratio, where X and Y can take on arbitrary values. Additionally, mapping of input channel to game control may also be modified over time or instantly. Modifications may comprise changing gesture trajectory models, modifying the location, scale, threshold of gestures, etc. Such mapping may be programmed, random, tiered, staggered, etc., to provide a user with a dynamic range of manipulatives. Modification of the mapping, gearing or ratios can be adjusted by the program code 2104 according to game play, game state, through a user modifier button (key pad, etc.) located on the joystick controller 2130, or broadly in response to the input channel. The input channel may include, but may not be limited to elements of user audio, audio generated by controller, tracking audio generated by the controller, controller button state, video camera output, controller telemetry data, including accelerometer data, tilt, yaw, roll, position, acceleration and any other data from sensors capable of tracking a user or the user manipulation of an object.

In certain embodiments the program code 2104 may change the mapping or gearing over time from one scheme or ratio to another scheme, respectively, in a predetermined time-dependent manner. Gearing and mapping changes can be applied to a game environment in various ways. In one example, a video game character may be controlled under one gearing scheme when the character is healthy and as the character's health deteriorates the system may gear the controller commands so the user is forced to exacerbate the movements of the controller to gesture commands to the character. A video game character who becomes disoriented may force a change of mapping of the input channel as users, for example, may be required to adjust input to regain control of the character under a new mapping. Mapping schemes that modify the translation of the input channel to game commands may also change during gameplay. This translation may occur in various ways in response to game state or in response to modifier commands issued under one or more elements of the input channel. Gearing and mapping may also be configured to influence the configuration and/or processing of one or more elements of the input channel.

In addition, a speaker 2136 may be mounted to the joystick controller 2130. In "acoustic radar" embodiments wherein the program code 2104 locates and characterizes sounds detected with the microphone array 2122, the speaker 2136 may provide an audio signal that can be detected by the microphone array 2122 and used by the program code 2104 to track the position of the joystick controller 2130. The speaker 2136 may also be used to provide an additional "input channel" from the joystick controller 2130 to the processor 2101. Audio signals from the speaker 2136 may be periodically pulsed to provide a beacon for the acoustic radar to track location. The audio signals (pulsed or otherwise) may be audible or ultrasonic. The acoustic radar may track the user manipulation of the joystick controller 2130 and where such manipulation tracking may include information about the position and orientation (e.g., pitch, roll or yaw angle) of the joystick controller 2130. The pulses may be triggered at an appropriate duty cycle as one skilled in the art is capable of applying. Pulses may be initiated based on a control signal arbitrated from the system. The apparatus 2100 (through the program code 2104) may coordinate the dispatch of control signals amongst two or more joystick controllers 2130 coupled to the processor 2101 to assure that multiple controllers can be tracked.

Figure 27:
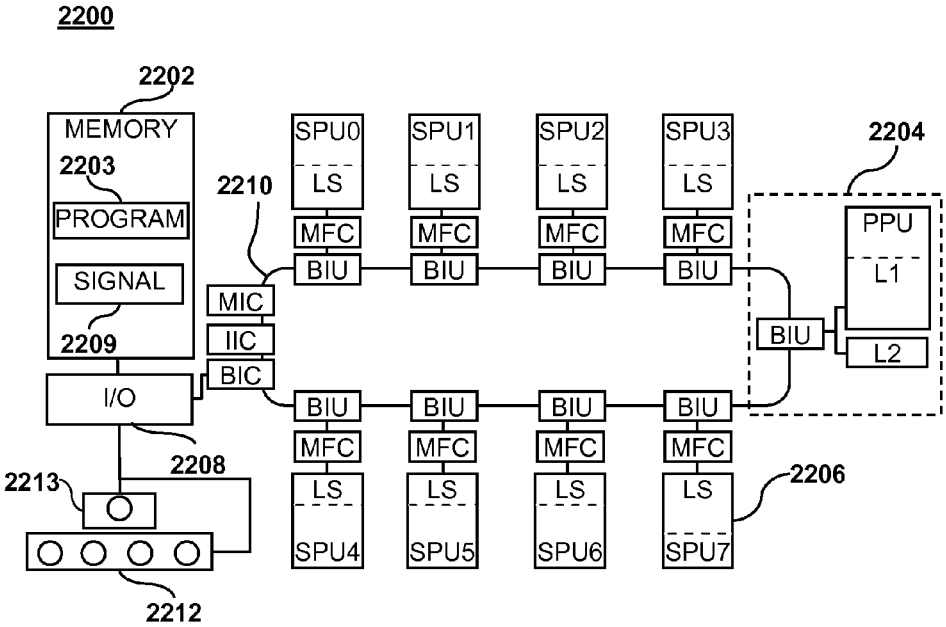
FIG. 27 is a block diagram of a cell processor implementation of a signal processing system according to an embodiment of the present invention.

By way of example, embodiments of the present invention may be implemented on parallel processing systems. Such parallel processing systems typically include two or more processor elements that are configured to execute parts of a program in parallel using separate processors. By way of example, and without limitation, FIG. 27 illustrates a type of cell processor 2200 according to an embodiment of the present invention. The cell processor 2200 may be used as the processor 2101 of FIG. 26. In the example depicted in FIG. 27, the cell processor 2200 includes a main memory 2202, power processor element (PPE) 2204, and a number of synergistic processor elements (SPEs) 2206. In the example depicted in FIG. 27, the cell processor 2200 includes a single PPE 2204 and eight SPE 2206. In such a configuration, seven of the SPE 2206 may be used for parallel processing and one may be reserved as a back-up in case one of the other seven fails. A cell processor may alternatively include multiple groups of PPEs (PPE groups) and multiple groups of SPEs (SPE groups). In such a case, hardware resources can be shared between units within a group. However, the SPEs and PPEs must appear to software as independent elements. As such, embodiments of the present invention are not limited to use with the configuration shown in FIG. 27.

The main memory 2202 typically includes both general-purpose and nonvolatile storage, as well as special-purpose hardware registers or arrays used for functions such as system configuration, data-transfer synchronization, memory-mapped I/O, and I/O subsystems. In embodiments of the present invention, a signal processing program 2203 and a signal 2209 may be resident in main memory 2202. The signal processing program 2203 may be configured as described with respect to FIGS. 7, 8, 13, 16, 17, 18, 19 25B, 25D or 25F above or some combination of two or more of these. The signal processing program 2203 may run on the PPE. The program 2203 may be divided up into multiple signal processing tasks that can be executed on the SPEs and/or PPE.

By way of example, the PPE 2204 may be a 64-bit PowerPC Processor Unit (PPU) with associated caches L1 and L2. The PPE 2204 is a general-purpose processing unit, which can access system management resources (such as the memory-protection tables, for example). Hardware resources may be mapped explicitly to a real address space as seen by the PPE. Therefore, the PPE can address any of these resources directly by using an appropriate effective address value. A primary function of the PPE 2204 is the management and allocation of tasks for the SPEs 2206 in the cell processor 2200.

Although only a single PPE is shown in FIG. 27, some cell processor implementations, such as cell broadband engine architecture (CBEA), the cell processor 2200 may have multiple PPEs organized into PPE groups, of which there may be more than one. These PPE groups may share access to the main memory 2202. Furthermore the cell processor 2200 may include two or more groups SPEs. The SPE groups may also share access to the main memory 2202. Such configurations are within the scope of the present invention.

Each SPE 2206 is includes a synergistic processor unit (SPU) and its own local storage area LS. The local storage LS may include one or more separate areas of memory storage, each one associated with a specific SPU. Each SPU may be configured to only execute instructions (including data load and data store operations) from within its own associated local storage domain. In such a configuration, data transfers between the local storage LS and elsewhere in a system 2200 may be performed by issuing direct memory access (DMA) commands from the memory flow controller (MFC) to transfer data to or from the local storage domain (of the individual SPE). The SPUs are less complex computational units than the PPE 2204 in that they do not perform any system management functions. The SPU generally have a single instruction, multiple data (SIMD) capability and typically process data and initiate any required data transfers (subject to access properties set up by the PPE) in order to perform their allocated tasks. The purpose of the SPU is to enable applications that require a higher computational unit density and can effectively use the provided instruction set. A significant number of SPEs in a system managed by the PPE 2204 allow for cost-effective processing over a wide range of applications.

Each SPE 2206 may include a dedicated memory flow controller (MFC) that includes an associated memory management unit that can hold and process memory-protection and access-permission information. The MFC provides the primary method for data transfer, protection, and synchronization between main storage of the cell processor and the local storage of an SPE. An MFC command describes the transfer to be performed. Commands for transferring data are sometimes referred to as MFC direct memory access (DMA) commands (or MFC DMA commands).

Each MFC may support multiple DMA transfers at the same time and can maintain and process multiple MFC commands. Each MFC DMA data transfer command request may involve both a local storage address (LSA) and an effective address (EA). The local storage address may directly address only the local storage area of its associated SPE. The effective address may have a more general application, e.g., it may be able to reference main storage, including all the SPE local storage areas, if they are aliased into the real address space.

To facilitate communication between the SPEs 2206 and/or between the SPEs 2206 and the PPE 2204, the SPEs 2206 and PPE 2204 may include signal notification registers that are tied to signaling events. The PPE 2204 and SPEs 2206 may be coupled by a star topology in which the PPE 2204 acts as a router to transmit messages to the SPEs 2206. Alternatively, each SPE 2206 and the PPE 2204 may have a one-way signal notification register referred to as a mailbox. The mailbox can be used by an SPE 2206 to host operating system (OS) synchronization.

The cell processor 2200 may include an input/output (I/O) function 2208 through which the cell processor 2200 may interface with peripheral devices, such as a microphone array 2212 and optional image capture unit 2213. In addition an Element Interconnect Bus 2210 may connect the various components listed above. Each SPE and the PPE can access the bus 2210 through a bus interface units BIU. The cell processor 2200 may also includes two controllers typically found in a processor: a Memory Interface Controller MIC that controls the flow of data between the bus 2210 and the main memory 2202, and a Bus Interface Controller BIC, which controls the flow of data between the I/O 2208 and the bus 2210. Although the requirements for the MIC, BIC, BIUs and bus 2210 may vary widely for different implementations, those of skill in the art will be familiar their functions and circuits for implementing them.

The cell processor 2200 may also include an internal interrupt controller IIC. The IIC component manages the priority of the interrupts presented to the PPE. The IIC allows interrupts from the other components the cell processor 2200 to be handled without using a main system interrupt controller. The IIC may be regarded as a second level controller. The main system interrupt controller may handle interrupts originating external to the cell processor.

In embodiments of the present invention, certain computations, such as the fractional delays described above, may be performed in parallel using the PPE 2204 and/or one or more of the SPE 2206. Each fractional delay calculation may be run as one or more separate tasks that different SPE 2206 may take as they become available.

Embodiments of the present invention may utilize arrays of between about 2 and about 8 microphones in an array characterized by a microphone spacing d between about 0.5 cm and about 2 cm. The microphones may have a dynamic range from about 120 Hz to about 16 kHz. It is noted that the introduction of fractional delays in the output signal y(t) as described above allows for much greater resolution in the source separation than would otherwise be possible with a digital processor limited to applying discrete integer time delays to the output signal. It is the introduction of such fractional time delays that allows embodiments of the present invention to achieve high resolution with such small microphone spacing and relatively inexpensive microphones. Embodiments of the invention may also be applied to ultrasonic position tracking by adding an ultrasonic emitter to the microphone array and tracking objects locations through analysis of the time delay of arrival of echoes of ultrasonic pulses from the emitter.

Methods and apparatus of the present invention may use microphone arrays that are small enough to be utilized in portable hand-held devices such as cell phones personal digital assistants, video/digital cameras, and the like. In certain embodiments of the present invention increasing the number of microphones in the array has no beneficial effect and in some cases fewer microphones may work better than more. Specifically a four-microphone array has been observed to work better than an eight-microphone array.

The methods and apparatus described herein may be used to enhance online gaming, e.g., by mixing remote partner's background sound with game character. A game console equipped with a microphone can continuously gather local background sound. A microphone array can selectively gathering sound based on predefined listening zone. For example, one can define ±20° cone or other region of microphone focus. Anything outside this cone would be considered as background sound. Audio processing can robustly subtract background from foreground gamer's voice. Background sound can be mixed with the pre-recorded voice of a game character that is currently speaking. This newly mixed sound signal is transferred to a remote partner, such as another game player over a network. Similarly, the same method may be applied to the remote side as well, so that the local player is presented with background audio from the remote partner. This can enhance the gaming reality experience comparing with real world. By recording background sound, as said with a microphone array, it is rather straight forward with the array's select listening ability with a single microphone. Voice Activity Detection (VAD) can be used to discriminate a player's voice from background. Once voice activity is detected, the previous silence signal may be used to replace the background.

Many video displays or audio degrade when the user is not in the "sweet spot." Since it is not known where the user is, the conventional approach is to widen the sweet spot as much as possible. In embodiments of the present invention, by contrast, with knowledge where the user is, e.g., from video images or "acoustic radar", the display or audio parameters can be adjusted to move the sweet spot. The user's location may be determined, e.g., using head detection and tracking with an image capture unit, such as a digital camera. The LCD angle or other electronic parameters may be correspondingly changed to improve display quality dynamically. For audio, phase and amplitude of each channel could be adjusted to adjust sweet spot. Embodiments of the present invention can provide head or user position tracking via a video camera and/or microphone array input.

Embodiments of the present invention may be used as presented herein or in combination with other user input mechanisms and notwithstanding mechanisms that track or profile the angular direction or volume of sound and/or mechanisms that track the position of the object actively or passively, mechanisms using machine vision, combinations thereof and where the object tracked may include ancillary controls or buttons that manipulate feedback to the system and where such feedback may include but is not limited light emission from light sources, sound distortion means, or other suitable transmitters and modulators as well as controls, buttons, pressure pad, etc. that may influence the transmission or modulation of the same, encode state, and/or transmit commands from or to a device, including devices that are tracked by the system and whether such devices are part of, interacting with or influencing a system used in connection with embodiments of the present invention.

The foregoing descriptions of specific embodiments of the invention have been presented for purposes of illustration and description. They are not intended to be exhaustive or to limit the invention to the precise embodiments disclosed, and naturally many modifications and variations are possible in light of the above teaching. The embodiments were chosen and described in order to explain the principles of the invention and its practical application, to thereby enable others skilled in the art to best utilize the invention and various embodiments with various modifications as are suited to the particular use contemplated. Embodiments of the invention may be applied to a variety of other applications.

With the above embodiments in mind, it should be understood that the invention may employ various computer-implemented operations involving data stored in computer systems. These operations include operations requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

The above described invention may be practiced with other computer system configurations including hand-held devices, microprocessor systems, microprocessor-based or programmable consumer electronics, minicomputers, mainframe computers and the like. The invention may also be practiced in distributing computing environments where tasks are performed by remote processing devices that are linked through a communications network.

The invention can also be embodied as computer readable code on a computer readable medium. The computer readable medium is any data storage device that can store data which can be thereafter read by a computer system, including an electromagnetic wave carrier. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer system so that the computer readable code is stored and executed in a distributed fashion.

Although the foregoing invention has been described in some detail for purposes of clarity of understanding, it will be apparent that certain changes and modifications may be practiced within the scope of the appended claims. Any feature described herein, whether preferred or not, may be combined with any other feature described herein, whether preferred or not. Accordingly, the present embodiments are to be considered as illustrative and not restrictive, and the invention is not to be limited to the details given herein, but may be modified within the scope and equivalents of the appended claims.

What is claimed is:

1. A method for controlling actions in a video game unit having a hand held controller configured for three-dimensional movement, the method comprising configuring a processor for:

receiving an inertial signal from an inertial sensor on the controller;

receiving an optical signal generated with one or more light sources on the controller;

determining a current position of the controller using the inertial signal, the current position determined using the inertial signal being subject to drift that accumulates over time, the drift being a discrepancy between the determined current position of the controller and an actual position of the controller;

receiving one or more images of the light sources obtained with a single camera;

separately determining a reference position of the controller from the one or more images; and correcting for the drift that accumulates over time by resetting the current position of the controller to the reference position separately determined from the one or more images.

2. The method of claim 1, wherein the inertial signal is generated with an accelerometer or gyroscope mounted to the controller.

3. The method of claim 1 further comprising tracking a position and/or orientation of the controller by receiving one or more images including the optical signal and tracking the motion of the light sources from the one or more images.

4. The method of claim 1, wherein the inertial signal is generated with an accelerometer or gyroscope mounted to the controller, the method further comprising generating an optical signal with one or more light sources mounted to the controller.

5. The method of claim 4 wherein both the inertial signal and the optical signal are used as inputs to the game unit.

6. The method of claim 5 wherein the inertial signal provides part of a tracking information input to the game unit and the optical signal provides another part of the tracking information.

7. The method of claim 1, further comprising compensating for spurious data in the inertial signal.

8. The method of claim 1 further comprising decoding a telemetry signal from the optical signal and executing a game command in response to the decoded telemetry signal.

9. An apparatus for controlling actions in a video game, comprising:

a processor;

a memory coupled to the processor;

a controller coupled to the processor, the controller having an inertial sensor and one or more light sources;

a single camera coupled to the processor; and one or more processor executable instructions stored in the memory, which, when executed by the processor cause the apparatus to: determine a current position of the controller using an inertial signal from the inertial sensor, the current position determined using the inertial signal being subject to drift that accumulates over time, the drift being a discrepancy between the determined current position of the controller and an actual position of the controller;

obtain one or more images of the one or more light sources with a single camera;

separately determine a reference position of the controller from the one or more images; and correct for the drift that accumulates over time by re-setting the current position of the controller to the reference position separately determined from the one or more images.

10. The apparatus of claim 9, wherein the inertial sensor is an accelerometer or gyroscope mounted to the controller.

11. The apparatus of claim 9 wherein light source includes one or more light-emitting diodes mounted to the controller.

12. The apparatus of claim 9, wherein the one or more processor executable instructions include one or more instructions which, when executed cause the single camera to capture one or more images of the light sources and one or more instructions which, when executed track the motion of the light sources from the one or more images.

13. The apparatus of claim 9, wherein the inertial sensor is an accelerometer mounted to the controller and wherein light source includes one or more light-emitting diodes mounted to the controller.

14. The apparatus of claim 13 wherein both an inertial signal from the accelerometer and an optical signal from the light-emitting diodes are used as inputs to the video game unit.

15. The apparatus of claim 14 wherein the inertial signal provides part of a tracking information input to the game unit and the one or more images provides another part of the tracking information.

16. The apparatus of claim 15 wherein the processor executable instructions include one or more instructions which, when executed compensate for spurious data in the inertial signal.

17. A method for controlling actions in a video game unit having a controller, the method comprising:

receiving one or more optical signals generated with one or more light sources mounted to the controller;

determining a current position of the controller with an inertial signal received from an inertial sensor on the controller, the current position determined using the inertial signal being subject to drift that accumulates over time, the drift being a discrepancy between the determined current position of the controller and an actual position of the controller;

obtaining one or more images of the light sources from a single image capture unit;

separately determining a reference position of the controller from the one or more images; and correcting for the drift that accumulates over time by re-setting the current position determined using the inertial signal to the reference position separately determined from the one or more images;

decoding one or more telemetry signals encoded into the one or more optical signals; and executing one or more game instructions in response to the position and orientation of the controller; and executing one or more game instructions in response to the one or more telemetry signals encoded in the one or more optical signals.

18. The method of claim 17 wherein the light sources include two or more light sources in a linear array.

19. The method of claim 17 wherein the light sources include rectangular or arcuate configuration of a plurality of light sources.

20. The method of claim 17 wherein the one or more light sources are disposed on two or more different sides of the controller to facilitate viewing of the light sources by the single image capture unit.

21. An apparatus for controlling actions in a video game, comprising:

a processor;

a memory coupled to the processor;

a controller coupled to the processor, the controller having one or more light sources and an inertial sensor mounted to the controller;

one or more processor executable instructions stored in the memory, which, when executed by the processor cause the apparatus to: generate one or more optical signals with the one or more light sources; determine a current position of the controller with one or more signals from the inertial sensor, the current position determined with the one or more signals from the inertial sensor being subject to drift that accumulates over time, the drift being a discrepancy between the determined current position of the controller and an actual position of the controller; separately determine a reference position of the controller from the one or more images of the light sources obtained with a single camera; and correct for the drift that accumulates over time by re-setting the current position determined with the one or more inertial sensor signals to the reference position separately determined from the one or more images.

22. The apparatus of claim 21 wherein the one or more light sources include two or more light sources in a linear array.

23. The apparatus of claim 21 wherein the one or more light sources include a rectangular or arcuate configuration of a plurality of light sources.

24. The apparatus of claim 21 wherein the one or more light sources are disposed on two or more different sides of the controller to facilitate viewing of the light sources by the image capture unit.

25. The method of claim 1, wherein the re-setting is triggered by a user command input to the controller.

26. The method of claim 1, wherein the re-setting is triggered automatically at regular intervals.

27. The method of claim 1, wherein the re-setting is triggered in response to game play.

28. The method of claim 1, wherein determining the current position of the controller using the inertial signal includes integrating an acceleration signal corresponding to the inertial signal received from the inertial sensor to obtain a change in velocity signal with time, and subsequently integrating the change in velocity signal to obtain a change in position signal with time and using a known initial position and a known initial velocity of the controller and the determined change in position signal and change in velocity signal to determine the current position of the controller.

* * * * *